US007650846B2

(12) United States Patent
McKim

(10) Patent No.: US 7,650,846 B2
(45) Date of Patent: Jan. 26, 2010

(54) MAINSAIL REEFING SYSTEM

(76) Inventor: Michael McKim, PMB 364, 3213 W. Wheeler St., Seattle, WA (US) 98199

( * ) Notice: Subject to any disclaimer, the term of this patent is extended or adjusted under 35 U.S.C. 154(b) by 1 day.

(21) Appl. No.: 12/202,927

(22) Filed: Sep. 2, 2008

(65) Prior Publication Data

US 2009/0084298 A1 Apr. 2, 2009

Related U.S. Application Data

(60) Provisional application No. 60/969,574, filed on Aug. 31, 2007.

(51) Int. Cl.
*B63H 9/08* (2006.01)

(52) U.S. Cl. ..... 114/104; 114/107

(58) Field of Classification Search ..... 114/102.1, 114/104, 105, 106, 107, 108
See application file for complete search history.

(56) References Cited

U.S. PATENT DOCUMENTS

| | | | | |
|---|---|---|---|---|
| 2,605,053 | A | 7/1952 | Broden | |
| 3,135,478 | A | 6/1964 | Harlander | |
| 3,834,670 | A | 9/1974 | Pityo | |
| 4,061,101 | A * | 12/1977 | Cook | 114/106 |
| 4,240,369 | A | 12/1980 | Molz | |
| 4,250,826 | A * | 2/1981 | Katshen | 114/106 |
| 4,487,147 | A | 12/1984 | Hoyt | |
| 5,169,075 | A | 12/1992 | Galanty | |
| 5,619,946 | A * | 4/1997 | Wallasch | 114/106 |
| 5,706,750 | A | 1/1998 | Spademan | |
| 5,779,226 | A | 7/1998 | Wudtke | |
| 6,019,353 | A | 2/2000 | Atfield | |
| 2005/0213216 | A1 | 9/2005 | May et al. | |
| 2006/0169961 | A1 | 8/2006 | Ledford | |

(Continued)

FOREIGN PATENT DOCUMENTS

| | | |
|---|---|---|
| DE | 3317339 | 11/1984 |

(Continued)

OTHER PUBLICATIONS

International Search Report Issued Nov. 21, 2008 for PCT/US2008/10582.

*Primary Examiner*—Lars A Olson
(74) *Attorney, Agent, or Firm*—David H. Jaffer; Pillsbury Winthrop Shaw Pittman LLP

(57) ABSTRACT

A mainsail reefing system comprises: a drum assembly including first and second coaxial drums for collecting luff-end and leech-end reefing lines, respectively; a drive mechanism for rotating the drum assembly; and a levelwind mechanism including a cam shaft configured to convert rotational motion to reciprocating motion, and first and second line guides mechanically coupled to the cam shaft, where the line guides are configured to move in a reciprocating motion across the width of the first and second drums, respectively, for guiding the reefing lines onto their respective drums. The levelwind mechanism is mechanically coupled to the reefing mechanism for coordination of movement of the line guides with rotation of the drum assembly. A preferred drive assembly comprises a third drum attached coaxially to the first and second drums, and a larger diameter threaded disc coaxially attached to an end of the third drum. During the reefing process a cockpit line is pulled off the third drum and then transitions to the larger diameter threaded disc, providing extra leverage during the outhaul tensioning of the mainsail.

25 Claims, 40 Drawing Sheets

U.S. PATENT DOCUMENTS

| | | | |
|---|---|---|---|
| 2006/0174810 | A1 | 8/2006 | Ma |
| 2006/0207829 | A1 | 9/2006 | Mauthner |
| 2006/0231814 | A1 | 10/2006 | Birdsall et al. |
| 2007/0144686 | A1 | 6/2007 | Drew |

FOREIGN PATENT DOCUMENTS

| | | |
|---|---|---|
| FR | 2603551 | 3/1988 |

* cited by examiner

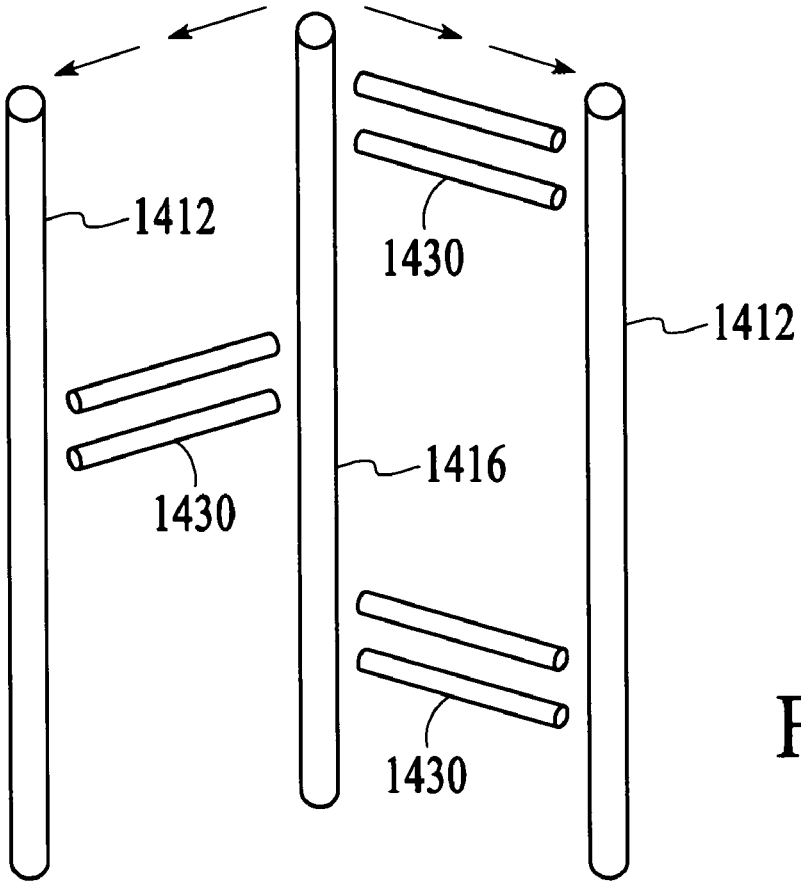
FIG.15A
FIG.15B
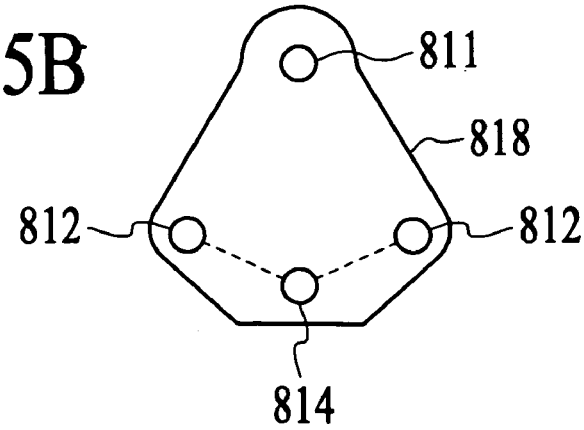

FIG.33A
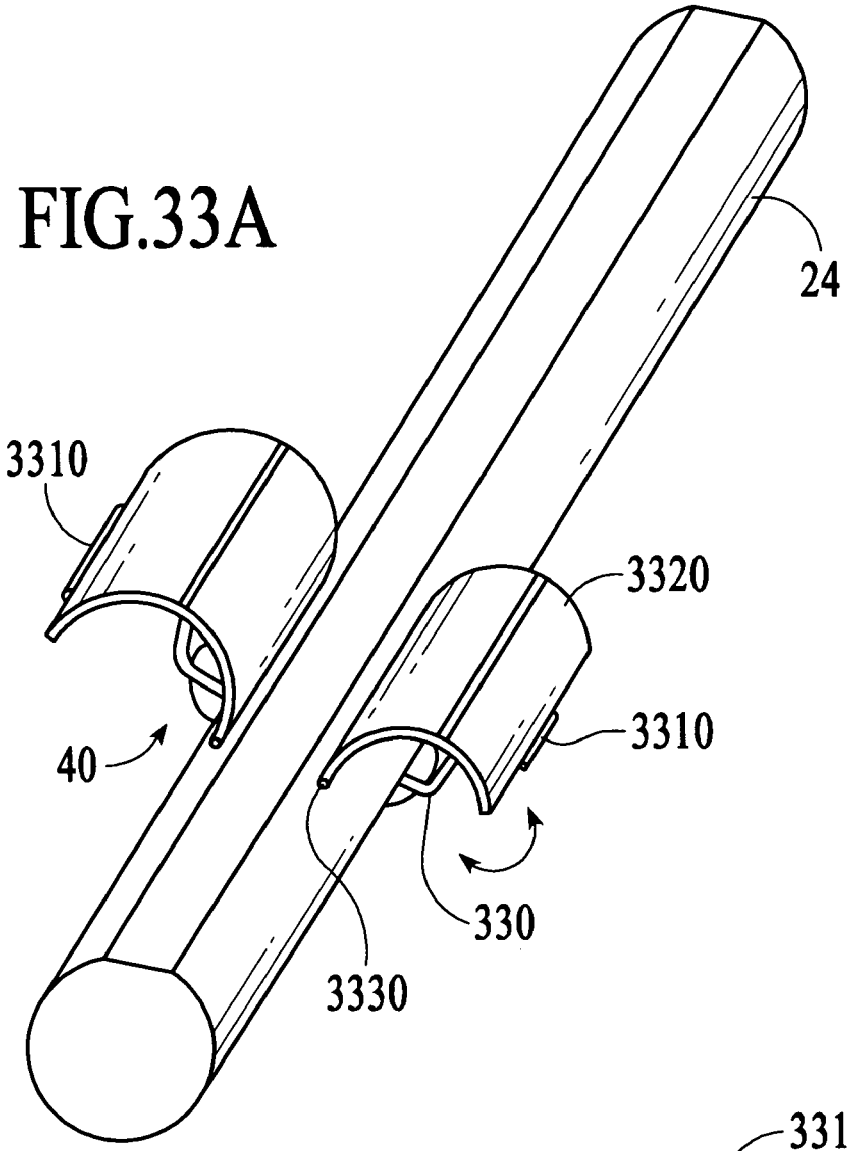
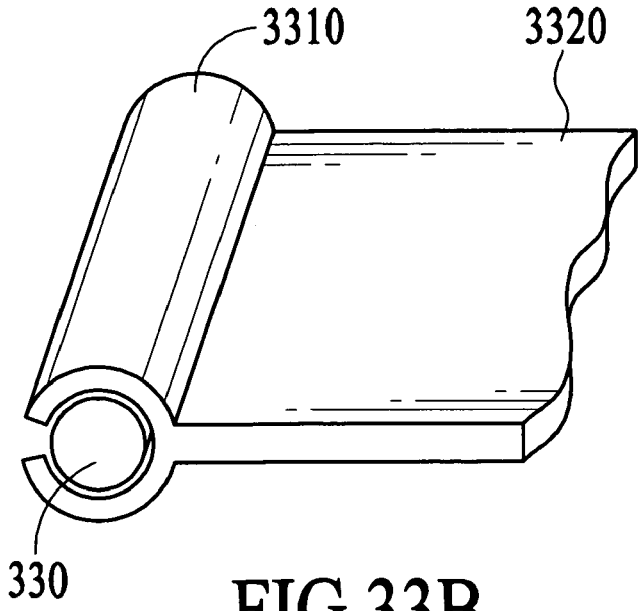
FIG.33B

MAINSAIL REEFING SYSTEM

CROSS-REFERENCE TO RELATED APPLICATIONS

This application claims the benefit of U.S. Provisional Application Ser. No. 60/969,574, filed Aug. 31, 2007, which is expressly incorporated by reference herein.

BACKGROUND OF THE INVENTION

1. Field of the Invention

This invention relates to the field of marine equipment, and more particularly to systems for reefing sails on sailboats.

2. Description of the Related Art

Reefing is a procedure used in sailing for reducing the area of a sail on a sailboat or sailing ship. Reefing can improve the boat's stability and reduce the risk of capsizing, broaching, or damaging sails or boat hardware in strong winds.

There are three common methods of reefing: slab reefing, conventional dual line and single line reefing, and in-mast and in-boom mainsail reefing.

Slab Reefing

Slab reefing systems require the sailing vessel's crew to leave the cockpit and perform the mainsail reef while standing at the mast. Using this system, the leading edge (luff) of the mainsail must be pulled down to the boom by hand and secured manually to a gooseneck fitting or similar S-hook attachment on the forward end of the boom. The trailing (leech) end of the mainsail must then be hauled down to the boom by pulling on a separate reefing line.

Perhaps the biggest drawback to slab reefing is that it requires at least one crewmember to leave the cockpit and go to the mast. This can be a potentially hazardous maneuver, especially if it is undertaken at night and/or in rough and slippery conditions, as is usually the case when the wind has increased to a point where a deep mainsail reef is warranted.

With a slab reefing system, the location of the reefing winch can also present problems for the crew. For example, if the reefing winch is located on the boom on the downwind, or "leeward" side of the vessel during a reefing operation, the crew will be forced to operate the winch from the downwind side of the vessel. This position can be awkward and dangerous, since the leeward side of a sailing vessel is typically heeled to a steep angle and is often awash with wave action during windy conditions.

Furthermore, slab reefing requires the crew to haul in a long length of reefing line to complete the reef. This is because the slab reefing line must be doubled through the reef cringle on the leech end of the sail in order to provide the leverage needed during the outhaul tensioning phase of the reefing procedure.

Clearly, there is a need for less potentially hazardous reefing procedures. Furthermore, there is a need for reefing systems that do not necessitate pulling in such a long length of line.

Dual Line and Single Line Reefing Systems

Unlike slab reefing systems, conventional dual line and single line reefing systems do not require the crew to leave the cockpit to deploy a mainsail reef. However, a dual line reefing system requires that two reefing lines be led to the cockpit for each reef. Moreover, both dual and single line reefing systems require the crew to pull in long lengths of line. For example, a so-called "Hoyt" single line reefing system, see U.S. Pat. No. 4,487,147 to Hoyt, would require the crew to haul in almost one hundred feet (100') of line in order to complete a triple reef on a mainsail with an overall surface area of approximately four hundred square feet. Furthermore, a Hoyt single line reefing system, since it consists of only one line, places the entire mechanical load generated by the reefing process and by the forces of the wind onto that single line. These potential loads are high enough so that a Hoyt single line reefing system is generally limited to use on sailing vessels under thirty-two feet in length.

Clearly, there is a need for reefing systems which do not require the crew to pull in such long lines. Furthermore, there is a need for single line systems which do not place such a large load on the line.

In-Mast and In-Boom Mainsail Reefing Systems

In-mast mainsail reefing systems are designed to roll the mainsail "venetian blind" style around a rotating rod inside the mast. These systems require that the mainsail be constructed without sail battens, so that the sail can be rolled up either directly behind or inside the mast itself. The elimination of battens constitutes a significant performance loss, since without battens the sail cannot hold an ideal aerodynamic shape in a variety of wind conditions.

Moreover, both in-mast and in-boom reefing systems—where the mainsail is rolled around a full-length rod inside the boom instead of inside the mast—require the elimination of mainsail roach, which significantly reduces the total available surface area of the mainsail and consequently reduces overall sail performance.

In-mast and in-boom mainsail reefing systems are expensive and complicated to install. This is largely because of the requirement for custom built masts, booms, and mainsails for the successful installation of these systems.

Furthermore, if an in-mast furling system should jam for any reason, the mainsail could become stuck in the raised position. In a gale at sea, this situation could be analogous to a stuck accelerator in a car, with no easy solutions at hand.

In conclusion, there is a need for reefing systems that provide safe, cost effective and efficient means for reefing a sail.

SUMMARY OF THE INVENTION

The invention is a system and method for reefing sails. In its simplest form the invention enables a single control line to pull two reefing lines down to the mainsail boom, thereby minimizing the amount of line and also the number of lines that must be hauled into the cockpit to deploy the reef. The total mechanical load generated by the reef is split between the two separate reefing lines on the mainsail and then brought together again at a drum assembly, thereby spreading out and minimizing the loads on the sail while still allowing the system to be operated by a single control line led from the drum assembly to the cockpit.

A system for reefing a mainsail is described herein. A mainsail reefing system comprises: a drum assembly including first and second coaxial drums for collecting luff-end and leech-end reefing lines, respectively; a drive mechanism for rotating the drum assembly; and a levelwind mechanism including a cam shaft configured to convert rotational motion to reciprocating motion, and first and second line guides mechanically coupled to the cam shaft, where the line guides are configured to move in a reciprocating motion across the width of the first and second drums, respectively, for guiding the reefing lines onto their respective drums. The levelwind mechanism is mechanically coupled to the reefing mechanism for coordination of movement of the line guides with rotation of the drum assembly. The drive mechanism may be a linedriver coupled to a cockpit winch by a continuous line. The drive mechanism may also be a motor mechanically coupled to the drum assembly by a clutch and a gear set. A preferred drive mechanism comprises a third drum attached coaxially to the first and second drums, and a larger diameter threaded disc coaxially attached to an end of the third drum. During the reefing process a cockpit line is pulled off the third drum and then transitions to the larger diameter threaded disc, providing extra leverage during the outhaul tensioning of the mainsail.

The preferred embodiment of the levelwind mechanism is comprised entirely of extrudable rod and tube profiles that fasten together with machine screws. This design reduces material wastage and machining costs to a minimum, while at the same time eliminating the need for welds that can lead to heat-related distortion of close-fitting components.

In embodiments of the invention utilizing a third drum, the levelwind mechanism is configured with a line guide for the cockpit line. In preferred embodiments, the line guides of the levelwind mechanism are configured to tension the reefing lines (and cockpit line, if applicable). Alternative structures for line tensioning include friction blocks. Note that the friction blocks disclosed herein may have a wide scope of uses beyond tensioning reefing lines.

A variety of housings can be fitted over the reefing mechanism to prevent loose line or sail material from interfering with moving components.

The reefing system may also include an outhaul fairlead car configured to hold the leech-end reefing line in proper alignment with the sheave on a boom-mounted fairlead block and to prevent loose sail material from hindering the movement of the leech-end reefing line A reefing mechanism for use in the mainsail reefing system is described herein. The reefing mechanism comprises a drum assembly including: a first drum for collecting a luff-end reefing line; a second drum for collecting a leech-end reefing line; a third drum for rotating the first and second drums, wherein the first, second and third drums are rigidly connected and share a common rotational axis; and a threaded disc coaxially attached to an end of the third drum, the threaded disc having a larger diameter than the third drum; wherein the threaded disc and the third drum are configured to enable a cockpit line to be fixed to the threaded disc and wound around the threaded disc and the third drum. Furthermore, an exit thread can be positioned between the threaded disc and the third drum, the exit thread being configured to smoothly transition the cockpit line from the third drum to the threaded disc during the reefing process.

In preferred embodiments the drum assembly is constructed by securing all drum components to a single tube. This design for the drum assembly allows for lower manufacturing costs than are typically incurred for fabricating a drum assembly from separate drums. The tube may be made of extruded aluminum. This preferred embodiment of the drum assembly includes: a tube; a center drum disc coaxially attached to the tube; two end discs fixed to the ends of the tube; and a threaded disc coaxially attached to the tube, the threaded disc having a larger diameter than the tube; wherein the section of tube between a first end disc and the threaded disc is a first drum for collecting a first reefing line, the section of tube between the second end disc and the center disc is a second drum for collecting a second reefing line, and the section of tube between the threaded disc and the center disc is a third drum, and wherein the threaded disc and the third drum are configured to enable a cockpit line to be fixed to the threaded disc and wound around the threaded disc and the third drum. The threaded disc may be attached to the tube by mechanical fasteners and keyways. Furthermore, leverage battens may be attached to the third drum to increase the diameter of the third drum, thus increasing the leverage available to the crew during the reefing process.

A method of reefing a mainsail is described herein. A method of reefing a mainsail comprises the following steps: (1) pulling a cockpit line off a first drum, the first drum being rigidly connected to a second drum and a third drum, wherein the first, second and third drums share a common rotational axis, wherein a luff-end reefing line is attached to the second drum and a leech-end reefing line is attached to the third drum, and wherein the reefing lines are reeled on to the second and third drums as the cockpit line is pulled off the first drum; and (2) pulling the cockpit line off a threaded disc, the threaded disc being coaxially attached to an end of the first drum, the threaded disc having a larger diameter than the first drum, the cockpit line being attached to the threaded disc and wound around the first drum, wherein outhaul tension is applied to the mainsail and the reef is completed as the cockpit line is pulled off the threaded disc.

BRIEF DESCRIPTION OF THE FIGURES

FIGS. 15A-B show aspects of a low profile configuration of the levelwind mechanism, according to the invention.

FIGS. 33A-B show a hinged housing for a reefing mechanism mounted on a boom, according to the invention.

DETAILED DESCRIPTION

The present invention will now be described in detail with reference to the drawings, which are provided as illustrative examples of the invention so as to enable those skilled in the art to practice the invention. Notably, the figures and examples below are not meant to limit the scope of the present invention to a single embodiment, but other embodiments are possible by way of interchange of some or all of the described or illustrated elements.

The mainsail reefing system of the invention is a mechanical system designed to allow sailboats of any size to reef the mainsail by pulling on a single line led to the vessel's cockpit. To "reef" a mainsail means to reduce the working surface area of the sail, so that the vessel does not heel excessively as wind strength increases. The mainsail reefing system of the invention maximizes mainsail reefing efficiency by greatly reducing the total amount of line the crew must haul in to complete the reef, relative to conventional mainsail reefing systems, while still supplying a significant leverage advantage to the crew for the proper application of outhaul tension. "Outhaul tension" means lateral tension applied to the mainsail along its base, so that the shape of the sail is flattened. It is desirable to create a flat mainsail shape as wind strength increases.

Figure 1:
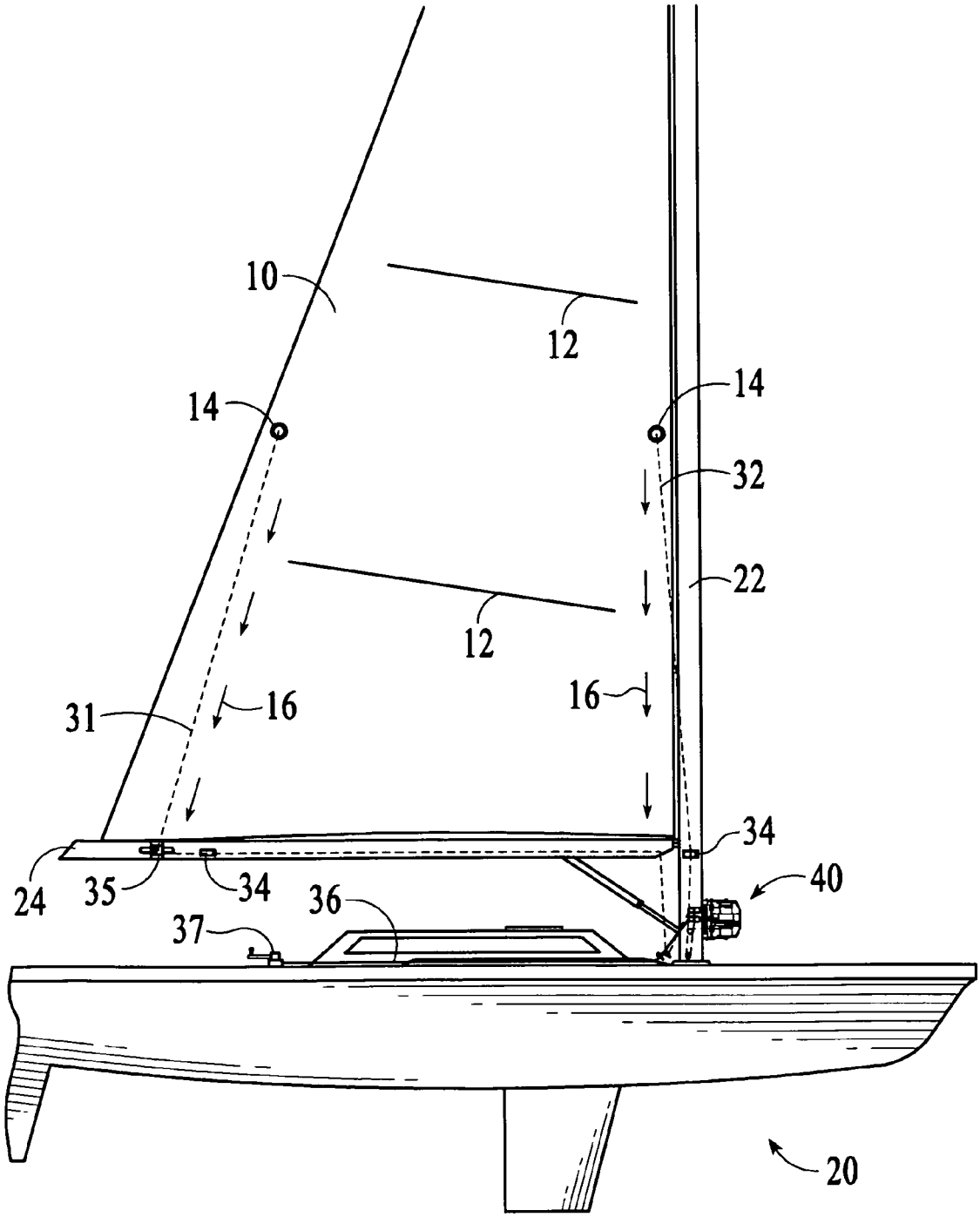
FIG. 1 shows a side view of a sailing vessel equipped with a reefing system, according to the invention.
Figure 2:
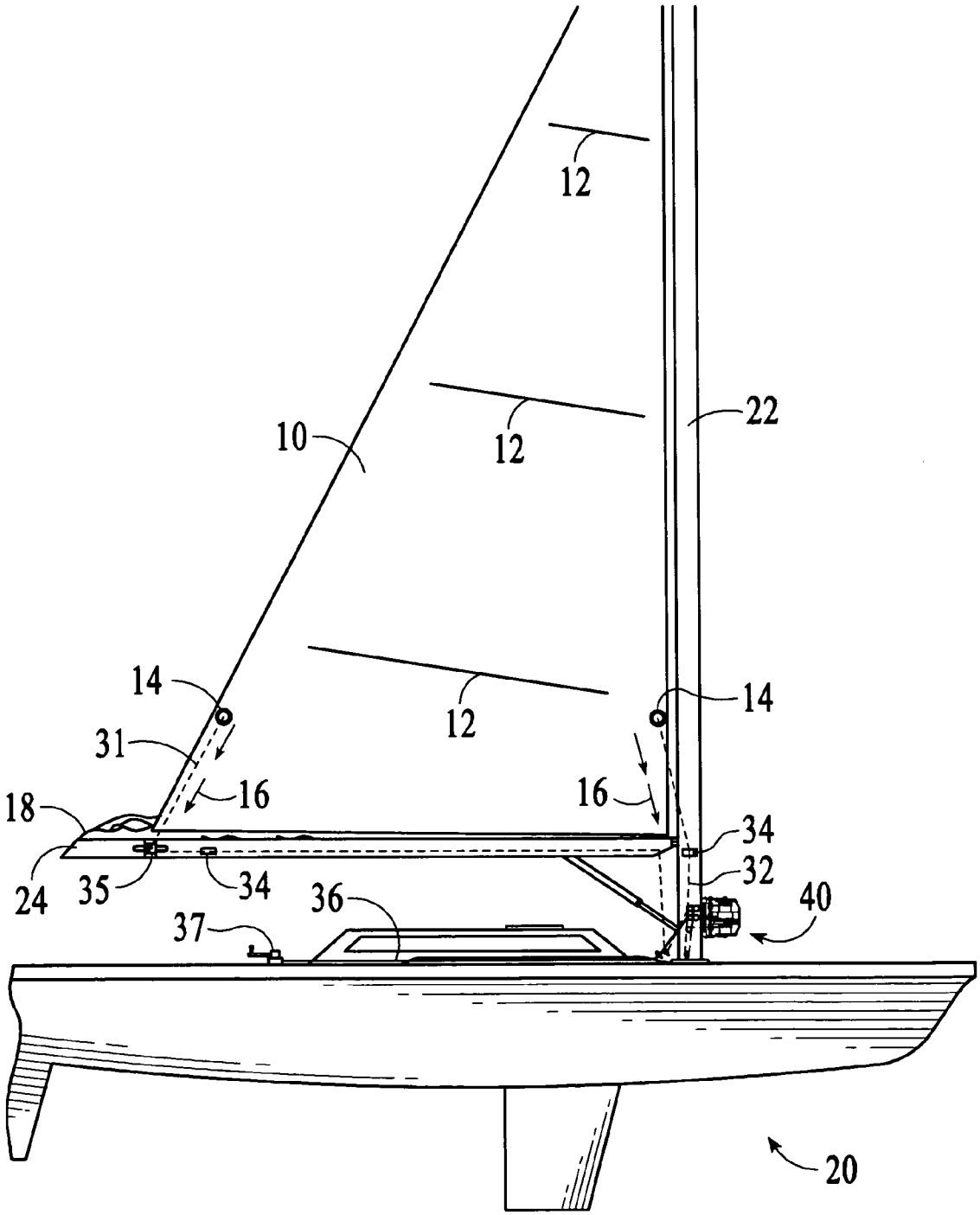
FIG. 2 shows the vessel of FIG. 1, with reefing in progress.
Figure 3:
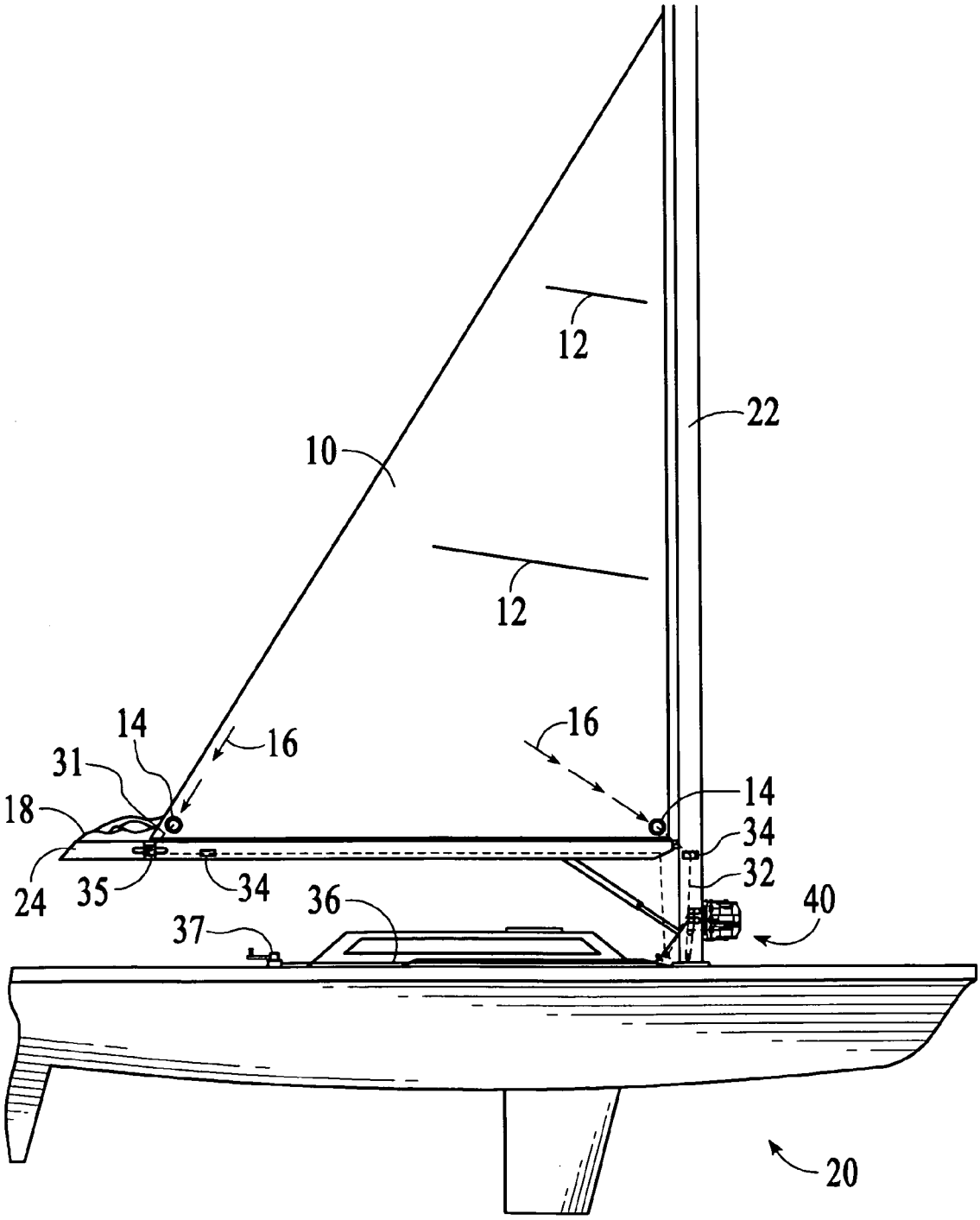
FIG. 3 shows the vessel of FIG. 1, with reefing complete.

FIGS. 1-3 illustrate the use of the reefing system of the invention to reef a mainsail 10 on a sailboat 20. The reefing system of the invention is compatible for use with mainsails 10 comprising mainsail battens 12. FIG. 1 shows the reefing system connected to a full mainsail 10. FIG. 2 shows reefing in progress by the reefing system of the invention. FIG. 3 shows a reefed mainsail 10 with proper outhaul tension applied by the reefing system of the invention. The reefing system shown in FIGS. 1-3 is a preferred embodiment of the invention, called the LeverDisc™ reefing system. However, other embodiments of the invention, described herein, may also be used in place of the LeverDisc™ reefing system.

Figure 4B:
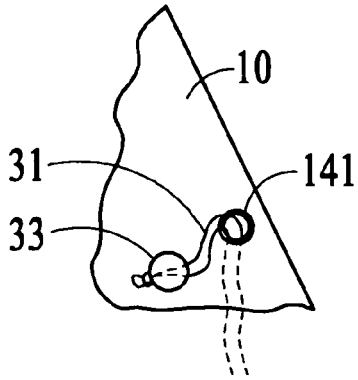
FIG. 4 shows a side view of a vessel equipped with a mast-mounted reefing system, according to the invention.

Referring to FIGS. 1-3, the LeverDisc™ reefing system includes two lines—the leech-end reefing line 31 and luff-end reefing line 32—attached to reinforced grommets 14 on the mainsail 10. These grommets 14 are referred to as reefing cringles and are sewn into the leading (luff) and trailing (leech) edges of the mainsail 10. Each reefing line is fastened to its respective cringle by means of a "figure eight" or "stopper" knot. Standard plastic linestoppers 33 can also be used to secure the reefing lines 31-32 to the cringles 14, as shown in FIG. 4B. Note that FIG. 4B shows a detail of the mainsail 10 around the leech-end cringle 141.

Once secured to the cringles 14, the reefing lines 31-32 are led downward through a series of fairlead blocks 34 and cars 35 to a reefing mechanism 40, as shown in FIGS. 1-3. The reefing mechanism 40 includes a levelwind mechanism 110 and a drum assembly 200, as shown in FIG. 6. From the fairlead blocks 34 located on the mast 22 and boom 24, each reefing line passes through a separate lineguide 112 on a levelwind mechanism 110, as shown in FIGS. 1-6.

Referring to FIG. 6, which shows the preferred embodiment of the reefing mechanism, each reefing line 31, 32 then passes from the levelwind mechanism 110 onto its own section of a four-part drum assembly 200. Note that the leech-end line 31 is shown at the top drum 210 and the luff-end line 32 at the bottom drum 220; however, the lines can just as easily be attached with the luff-end line 32 at the top drum 210 and the leech-end line 31 at the bottom drum 220. At the same time, a third line 36, referred to in this disclosure as the "cockpit line," is led from the opposite side (relative to the two reefing lines 31-32) of the four-part drum assembly 200 to the sailboat's cockpit, also via a series of fairlead blocks. Like the reefing lines 31-32, the cockpit line 36 also passes through a lineguide 112 on the levelwind mechanism 110 as it exits the center drums 230, 240. In FIGS. 1-3, the cockpit line 36 is shown attached to a cockpit winch 37 in the cockpit of the sailboat 20.

Referring to FIGS. 1-6, when an operator in the cockpit eases the mainsail halyard and pulls on the cockpit line 36, the four-part drum assembly 200 rotates in a direction that causes the two reefing lines 31, 32 to wind onto their drum sections 210, 220 at the same time that the cockpit line 36 winds off of its drum sections 230, 240. (The mainsail halyard is a line that controls the raising and lowering of the mainsail 10; the mainsail halyard must be eased prior to reefing.)

Referring again to FIG. 6, the levelwind mechanism 110 is mechanically connected to the drum assembly 200 by means of a chain and sprocket assembly 310. As the four-part drum assembly 200 rotates, the chain and sprocket assembly 310 causes the levelwind mechanism 110 to move up and down behind the drum assembly 200 in a precise reciprocating fashion, ensuring that all three lines—the leech-end reefing line 31, the luff-end reefing line 32 and the cockpit line 36—wind smoothly on and off their respective drum sections 210, 220 and 230 at the same rate. The direction of movement is indicated by arrows 113. This action pulls the luff and leech ends of the mainsail 10 down together until the reefing cringles 14 reach their terminal points at the boom 24, thereby reducing the surface area of the mainsail 10. The area of the mainsail no longer used, referred to as "doused sail" 18, accumulates behind the boom 24.

However, merely pulling a section of mainsail 10 down to the boom 24 does not in itself constitute a reef. A proper mainsail reef requires that the sail 10 not only be reduced in size but also that it be stretched tight along its base (foot) to flatten its shape and help it perform optimally in strong wind. This flattening is called applying outhaul tension. It is achieved by positioning the reefing line fairlead blocks 34 and cars 35 on the boom 24 and mast 22 in such a way that the reefing lines 31 and 32 pull both downward and outward on the mainsail 10 during the last portion of the reefing process. FIGS. 1-3 illustrate the process of applying outhaul tension to the mainsail 10 during reefing. Note how the outhaul tension increases as the reefing process progresses from FIG. 1 through FIG. 3. Arrows 16 show the direction of tension applied to the mainsail 10. Note the outhaul tension is due to the fore and aft (forward and backward) tension being applied to the base (foot) of the mainsail by the two reefing lines 31 and 32 as the reef is completed.

The application of outhaul tension requires that a significant amount of mechanical force be applied to the reefing lines during the final moments of the reefing process. It is therefore desirable to create a leverage advantage for the crew during this critical outhaul phase of the reefing operation. The LeverDisc™ mainsail reefing system provides a leverage advantage for outhaul tensioning by means of a component called a LeverDisc™ 240, as shown in FIG. 6.

The LeverDisc™ 240 is mechanically fastened to the center drum section 230, as shown from a side perspective in FIG. 6. The LeverDisc™ 240 is comprised of a wide, short metal cylinder with precisely machined threads 241 positioned around its outer circumference. The threads 241 are designed to hold the last few revolutions of cockpit line 36 coming off the center drum section 230. The cockpit line 36 is guided on and off the LeverDisc™ 240 by means of threads 241, in conjunction with the levelwind system 110 and a helically curved exit thread 243 on the LeverDisc™ 240. The exit thread 243 is shown in more detail in FIGS. 23 and 24. As outhaul tension brings increasing mechanical loads onto the reefing lines 31, 32 near the end of the reefing operation, the cockpit line 36 automatically switches from the center drum 230 to the much wider diameter LeverDisc™ 240 by traveling out along the helical exit thread 243 and onto the LeverDisc™ threads 241.

The mechanical advantage that the LeverDisc™ 240 provides is determined by the ratio between the LeverDisc™ radius and the radii of the drum sections rolling up the two reefing lines 31 and 32. The greater the ratio, the greater the leverage at the LeverDisc™ 240. Since the LeverDisc™ 240 is removable from the rest of the drum assembly 200, LeverDiscs™ of differing diameters can be interchanged to vary the mechanical advantage delivered to the crew during the outhaul tensioning phase of the reefing process.

With reference to FIGS. 1-3 and 6, the procedure is described for commissioning the LeverDisc™ reefing system. First, to ensure that the cockpit line 36 transitions to the LeverDisc™ 240 at the proper moment—as outhaul tension is being applied to the sail 10 near the end of the reefing process—the timing on the reefing mechanism 40 must first be "set" prior to reefing the mainsail 10 for the first time. The timing is set by measuring the distance along the leading edge (luff) of the mainsail 10 from the top edge of the boom 24 to the reef cringle 14 to which the luff-end reefing line 32 will be attached. This distance must then be converted into the number of revolutions required to roll an equivalent length of reefing line onto the luff portion of the four-part drum 200 (lower drum 220 in FIG. 6). This represents the number of drum 200 revolutions required to complete the reef. The calculation is made using the formula of (Circumference=$\pi\times$ Diameter), where Diameter is the outside diameter of the luff portion of the four-part drum 200.

Once the number of drum revolutions required to complete the reef has been determined, the drum assembly 200 is rotated by hand until the levelwind system 110 reaches the absolute top of its cam stroke. At this point, the lineguide 112 for the cockpit drum section 230 should be aligned with the thru-hole 242 in the side of the LeverDisc™ 240, at the place where the threads 241 traversing the LeverDisc™ circumference begin. The bitter end of the cockpit line 36 is then led through the cockpit line guides 112 on the levelwind system 110 and attached to the LeverDisc™ 240, by pressing the bitter end of the line through the hole 242 in the LeverDisc™ wall and securing it with a stopper knot from the inside of the LeverDisc™ 240. The position of the thru-hole 242 in the LeverDisc™ wall is depicted in FIG. 6.

The entire drum assembly 200 is then turned again by hand, so that the cockpit line 36 winds onto the LeverDisc™ threads 241 and from there onto the smaller diameter cockpit drum 230 as the levelwind system 110 commences its downward stroke. The drum 200 is turned the same number of revolutions as required to complete the reef, as determined above.

The reefing mechanism 40 is considered to be at maximum line-carrying capacity at the point where the cockpit line 36 is positioned just below the bottom of the exit thread 243 on the LeverDisc™ 240, during the first return stroke of the levelwind cam. Beyond this point, an attempt to add more cockpit line 36 to the center portion of the drum 230 would cause the cockpit line 36 to come into contact with the bottom edge of the LeverDisc™ exit thread 243 and to bend around it as the cockpit lineguide 36 continues upward on its stroke.

Once the required amount of cockpit line 36 has been rolled onto the LeverDisc threads 241 and the cockpit section of the drum 230, the mainsail 10 is raised and the leech and luff end reefing lines 31, 32 are attached to their respective sections of the four-part drum 200 and adjusted as necessary to achieve the desired amount of slack against the mainsail 10. The reefing system is now "charged" and ready to reef the mainsail 10. Note that the configuration of line depicted on the drum assembly 200 in FIG. 6 is consistent with a point in time part way through the reefing process, where the cockpit line 36 is being pulled off the center drum 230 and the reefing lines 31, 32 are being wound onto top and bottom drums 210 and 220, respectively, while the lineguides 112 on the levelwind mechanism 110 move upwards; the line on drums 210 and 220 is forming a second layer.

Figure 4A:
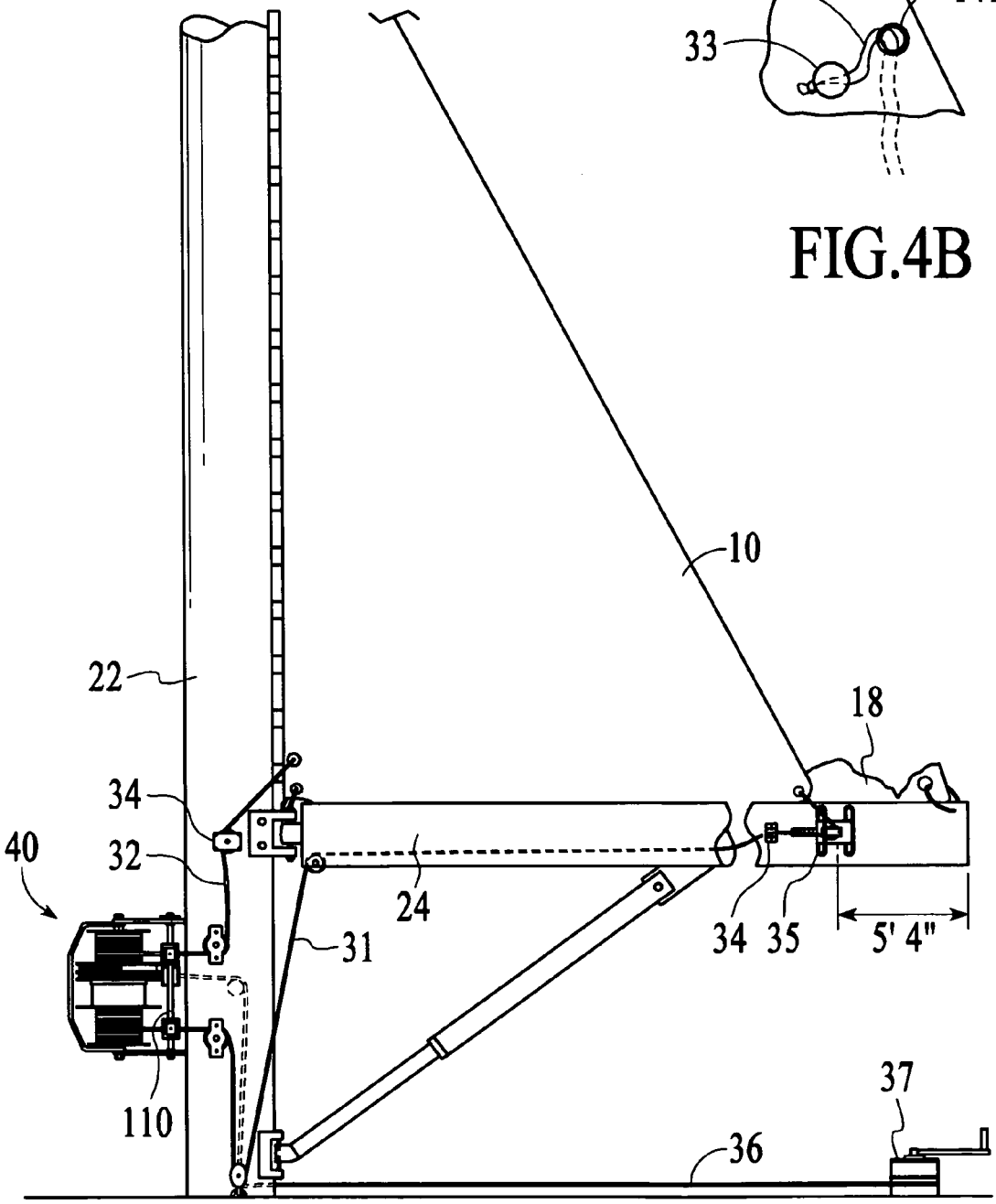

The reefing mechanism 40 can be installed in a variety of locations on board the typical sailing vessel. These locations include the leading edge of the mast 22, as shown in FIG. 4A, under the boom 24, as shown in FIGS. 5 and 7, or on the deck, as shown in FIGS. 8A-D.

Figure 5:
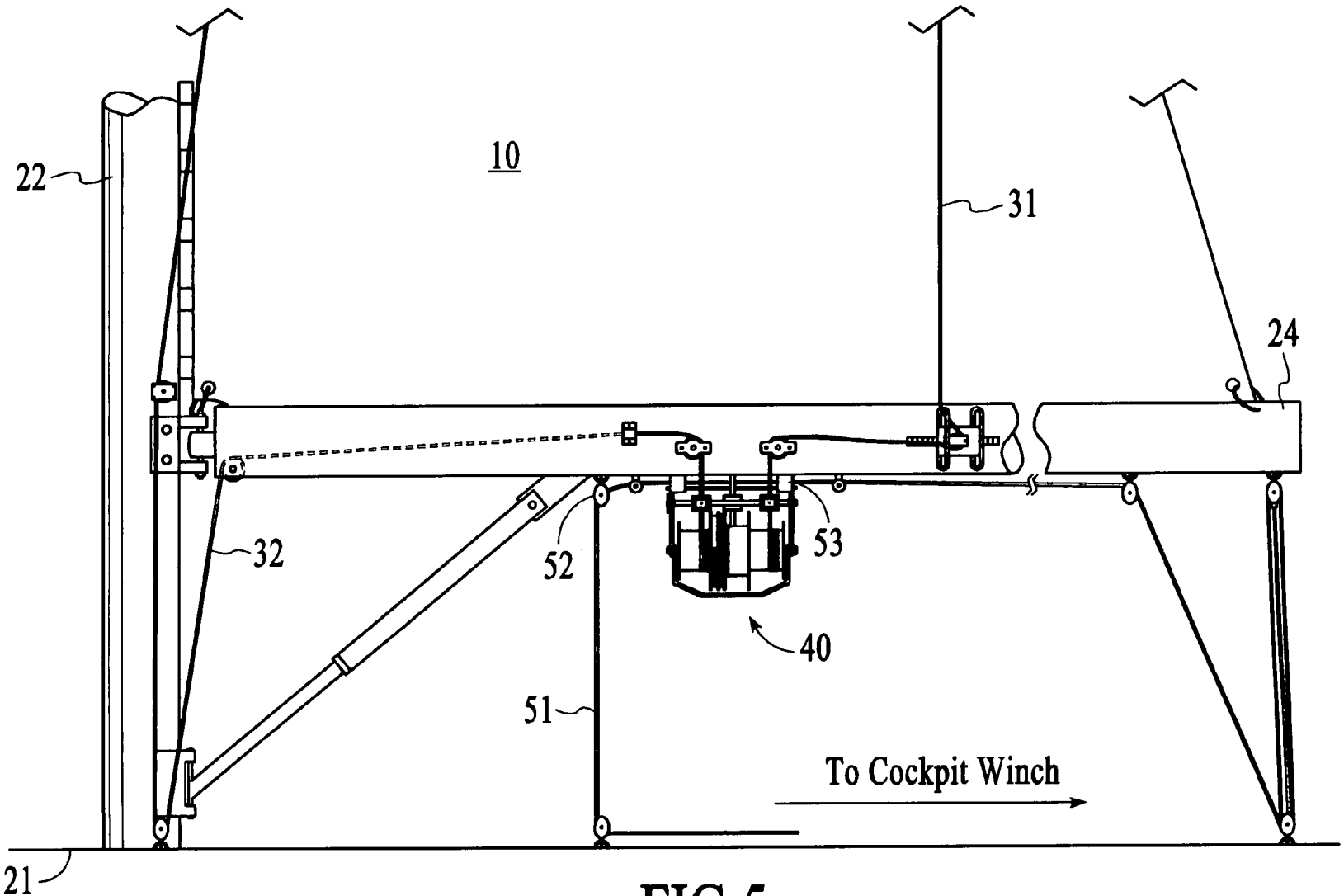
FIG. 5 shows a side view of a vessel equipped with a boom-mounted reefing system, according to the invention.
Figure 6:
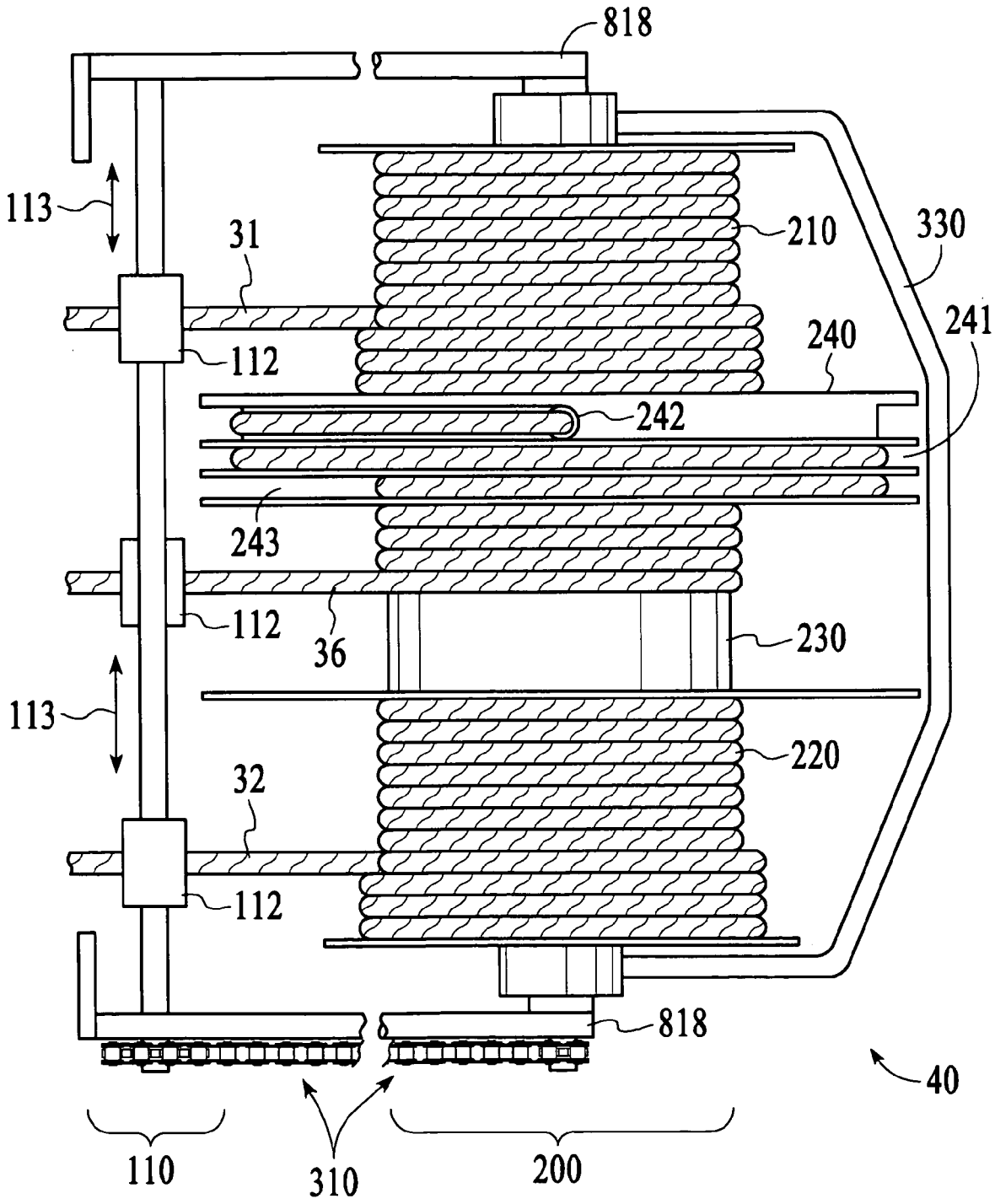
FIG. 6 shows a side view of a reefing mechanism with a LeverDisc™, according to the invention.

FIG. 5 shows a mounting arrangement where the vessel's mainsheet 51, which controls the lateral movement of the mainsail boom 24, is routed behind the reefing mechanism 40 through a series of fairleads 52 and standoff blocks 53. The standoff blocks 53 may be made from ultra-high molecular weight polyethylene (UHMW). This arrangement allows the reefing mechanism 40 and the mainsheet 51 to occupy the same space on the boom 24 without interference. Note that the mainsheet 51 is further routed from a cockpit winch (not shown), along the deck 21 and then up to the mainsail boom 24, as described above.

Figure 7:
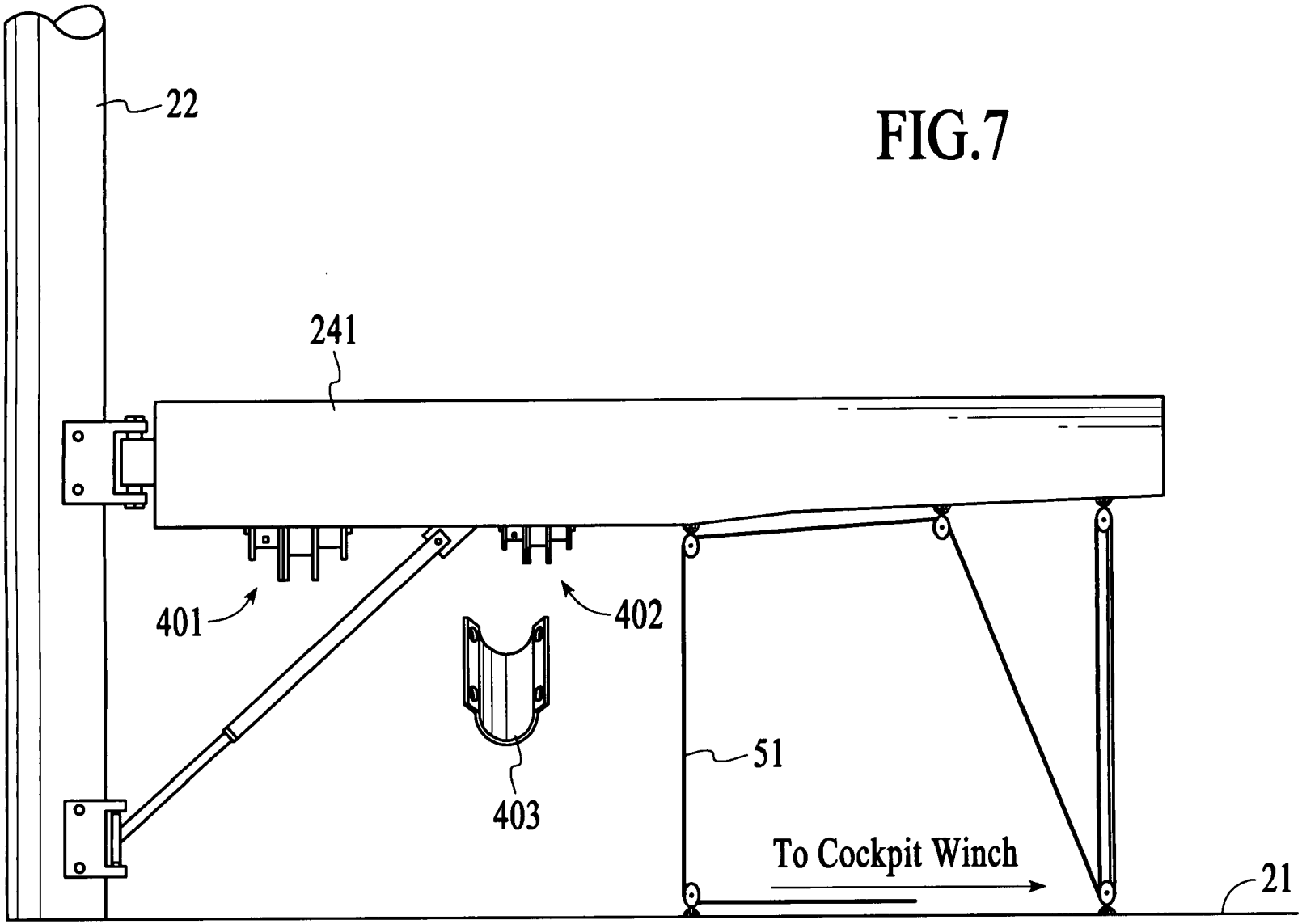
FIG. 7 shows a side view of V-boom-mounted reefing mechanisms, according to the invention.

A low profile installation option is shown in FIG. 7, with one or more reefing mechanisms 401, 402 integrated into the bottom section of a custom designed V-boom 241. A V-boom is a V-shaped spar that stows the lowered mainsail 10 inside itself and also includes integrated reefing lines and blocks. Due to their V shape, V-booms are wide enough to accommodate a range of reefing mechanisms 401-402 inside purpose-built recesses. Properly sized recesses are fabricated into the bottom of a V-boom 241 during the boom's initial layup and construction. Although not shown in FIG. 7, wider boom sections may be fabricated to better accommodate reefing mechanisms in such recesses. The reefing and cockpit lines could then be led inside the V-boom 241 to a reefing mechanism 401, 402, to maintain an uncluttered appearance along the boom's exterior. FIG. 7 illustrates two different sizes of reefing mechanisms 401, 402 suitable for a 44 foot LOA vessel with a mast "I" measurement of 56 feet. Reefing mechanism 401 is suitable for a triple reef and is approximately 15 inches long and 9.5 inches wide. Reefing mechanism 402 is suitable for a double reef and is approximately 10 inches long and 6.5 inches wide. A cover 403 is also shown, which slides over a reefing mechanism 401, 402 and fastens to the boom 241. The cover 403 may be made from metal or plastic.

The mounting struts shown in FIGS. 8-12 provide a mechanical attachment point for the drum shafts, cam shaft, guide rods and associated bearings for the reefing mechanism 40.

Figures 8A, 8B, 8C, 8D:
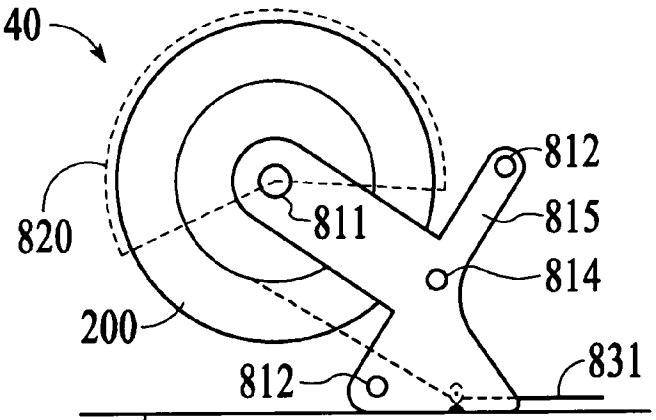
FIGS. 8A-D show end views of deck-mounted reefing mechanisms, according to the invention.

The reefing mechanism 40 can also be installed directly on deck 21 using a variety of mounting strut configurations, as shown in end-view in FIGS. 8A-D. FIG. 8A shows reefing mechanism 40 attached to the deck 21 by a mounting strut 810 with a low profile base. A reefing line 831 is shown feeding onto one of the smaller diameter drums of the drum assembly 200. (The larger diameter drum in the drum assembly 200 is the LeverDisc™.) The mounting strut 810 includes three mounting holes for a levelwind mechanism—guide rod holes 812 and cam shaft hole 814—and a drum shaft mounting hole 811. An optional cover 820, suitable for preventing fouling of the reefing mechanism, is also shown.

FIGS. 8B-D show reefing mechanism 40 attached to the deck by alternative designs of mounting strut 815-817, respectively. Mounting strut 817 includes lightening holes 813 to reduce the weight of the strut. All mounting struts 810, 815-817 can be bolted to the deck using mounting flanges.

Figure 9:
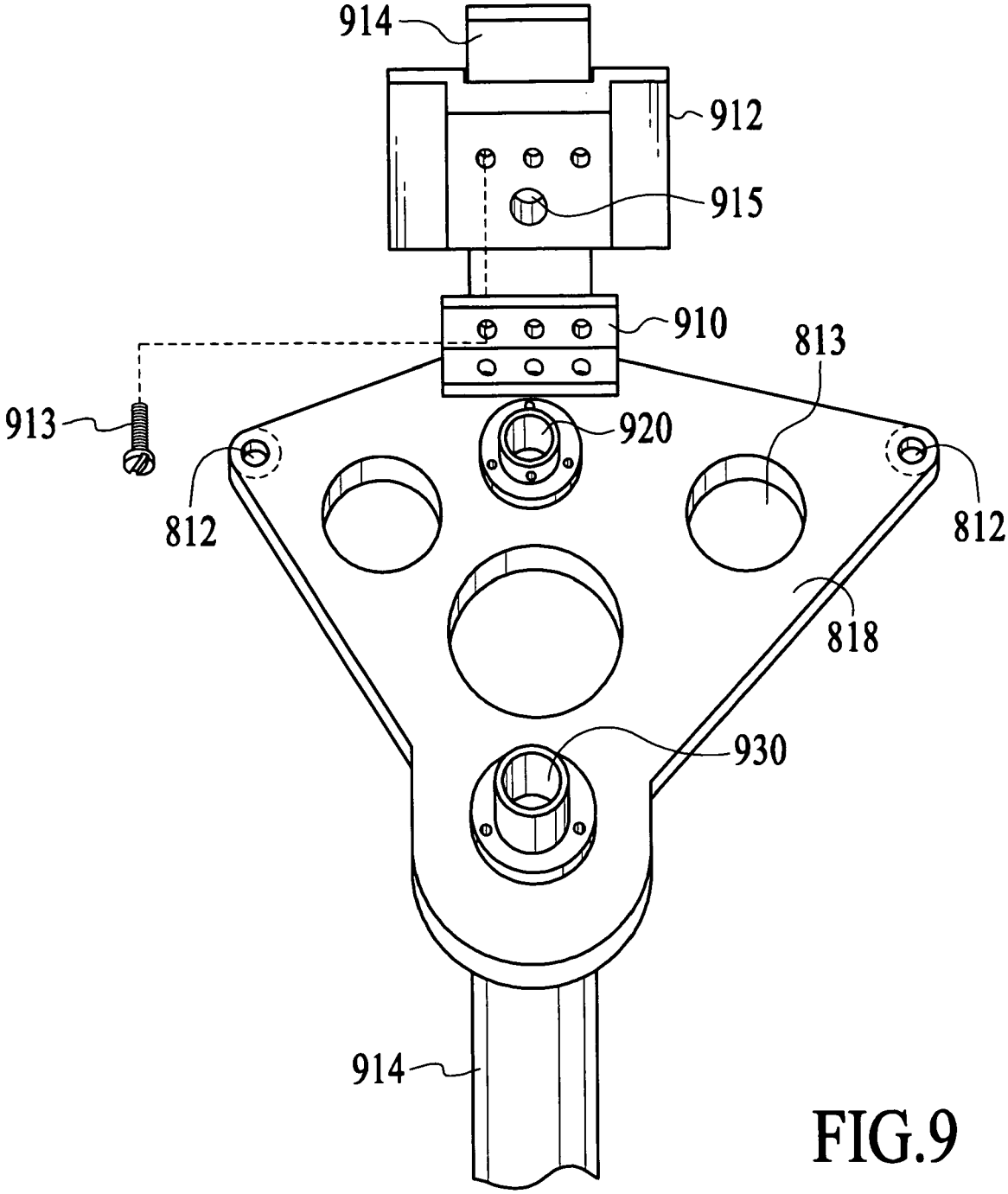
FIG. 9 is an illustration of a T-track mount for a mounting strut, according to the invention.

An option for attaching a mounting strut 818 to the vessel's deck, boom or mast is shown in FIG. 9. The mounting strut 818 attaches to a strut mounting plate 910. (The strut mounting plate 910 is basically a right angle plate—enabling attachment of two objects to be held at right angles to each other.) The strut mounting plate 910 is then attached to a mount 912 which slides onto and fastens independently to a length of standard T-Track 914. (The strut mounting plate 910 is bolted to the mount 912 using bolts 913 as indicated in FIG. 9. The mount 912 attaches to the T-Track 914 through countersunk hole 915.) In this way, the reefing system can be secured to any length of T-Track 914 on a sailing vessel's boom, mast, or deck, without the need for drilling additional mounting holes. Note that bearing cups 920 and 930 are for receiving the levelwind cam shaft and drum assembly shafts, respectively. The mounting plate 910 and cam and drum shaft bearing cups 920 and 930 attach separately to the mounting strut 818 with machine screws.

Figure 10A:
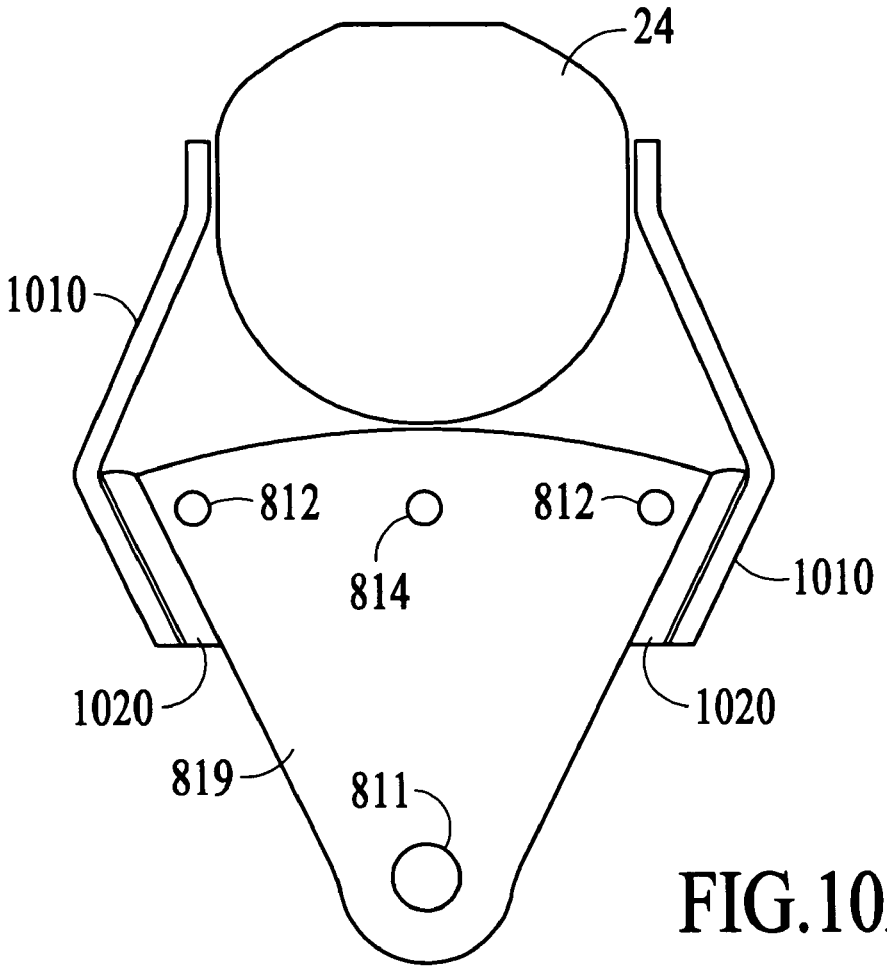
FIGS. 10A-B illustrate a boom side-mount for a mounting strut, according to the invention.
Figure 10B:
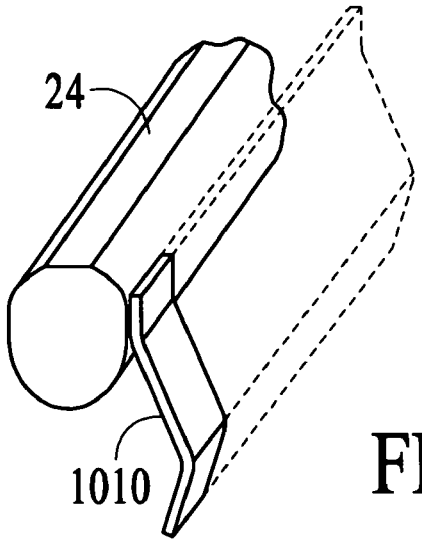

A further option for attaching a mounting strut 819 to the vessel's boom 24 is shown in FIGS. 10A and 10B. The mounting strut 819 attaches to lower parts of side mounting plates 1010, with mounting pads 1020 sandwiched between. Upper parts of the side mounting plates 1010 are attached to the boom 24 as shown. As indicated in FIG. 10B, the side mounting plates 1010 may be for mounting a single mounting strut 819 or the side mounting plates may extend the full length of a reefing mechanism, attaching to the mounting struts at both ends of the reefing mechanism.

Figure 11:
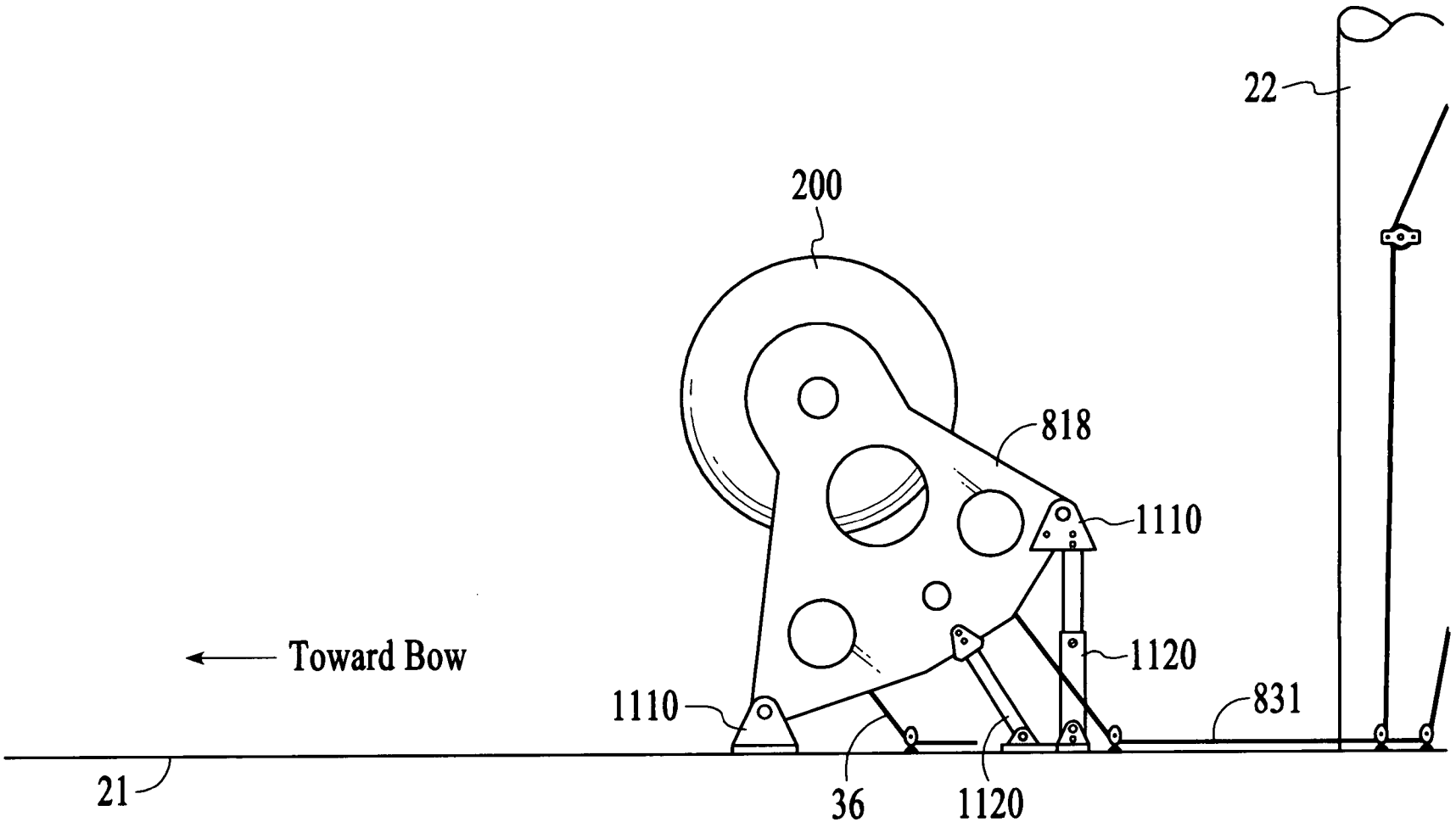
FIG. 11 shows an end view of a deck-mounted reefing mechanism, according to the invention.

Yet another option for attaching a mounting strut 818 to the vessel's deck 21 is shown in FIG. 11. The mounting strut 818 is mounted to the deck 21 with brackets 1110 and adjustable length tubes 1120.

Figure 12:
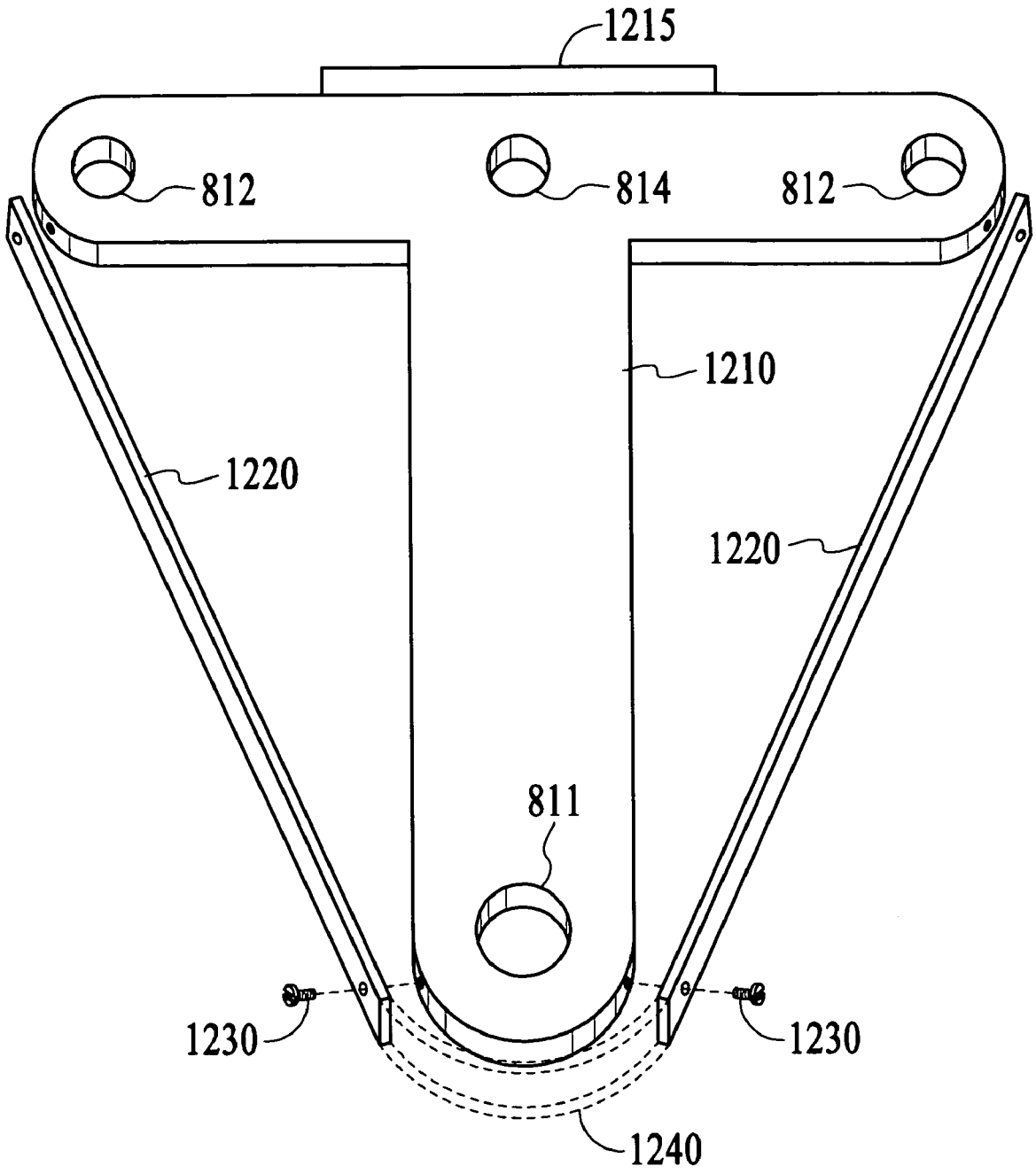
FIG. 12 shows an alternative mounting strut, according to the invention.

An alternate embodiment of the mounting strut is shown in FIG. 12. A mounting strut 1210 is shaped like a T to minimize the amount of material used and to minimize the weight of the strut. The mounting strut 1210 is secured to the sailboat by a mounting plate 1215. A "line deflector" 1220, comprising a thin length of metal, may be secured to each side of strut 1210 with fasteners 1230, or by welding. The line deflector 1220 may consist of two separate pieces of metal, fastened or welded to each side of the strut. The line deflector may also consist of a single piece of metal 1240 that is bent around the leading edge of the mounting strut and then either fastened or welded in place. Furthermore, the line deflectors and mounting strut may be made of a single piece of metal. (Not shown.) The purpose of the line deflectors 1220, 1240 is to keep loose line from becoming tangled or fouled around the right angled inner corners of the strut 1210.

Note that the position of the guide rod holes 812 on any of the mounting strut embodiments may be swept forward, relative to the cam shaft hole 814, in order to reduce the overall size of the mounting strut. Mounting struts 818 and 819 in FIGS. 9, 10A and 11 illustrate this configuration. See also FIGS. 15A and 15B.

The main body of the mounting struts can be cut from stock sheets of aluminum or stainless steel using a water jet or laser cutting process, in a cookie cutter fashion. This is a highly cost-effective manufacturing process, since labor costs and material wastage are minimized. In addition, the strut mounting plate represents an extrudable profile and can be produced from a die at low cost.

The flat shape of the mounting struts keeps the overall profile of the LeverDisc™ mainsail reefing system as small as possible. The radiused edges of the mounting struts are designed to minimize the potential for line fouls, allowing loose line to slide off the relatively shallow angles along the sides of the mounting struts instead of catching on a right angled corner. To allow the back faces of the strut mounting plates to conform to the radiused section of a mast or boom for system installation, a pair of radiused strut mounting pads can be placed behind them.

Figure 13:
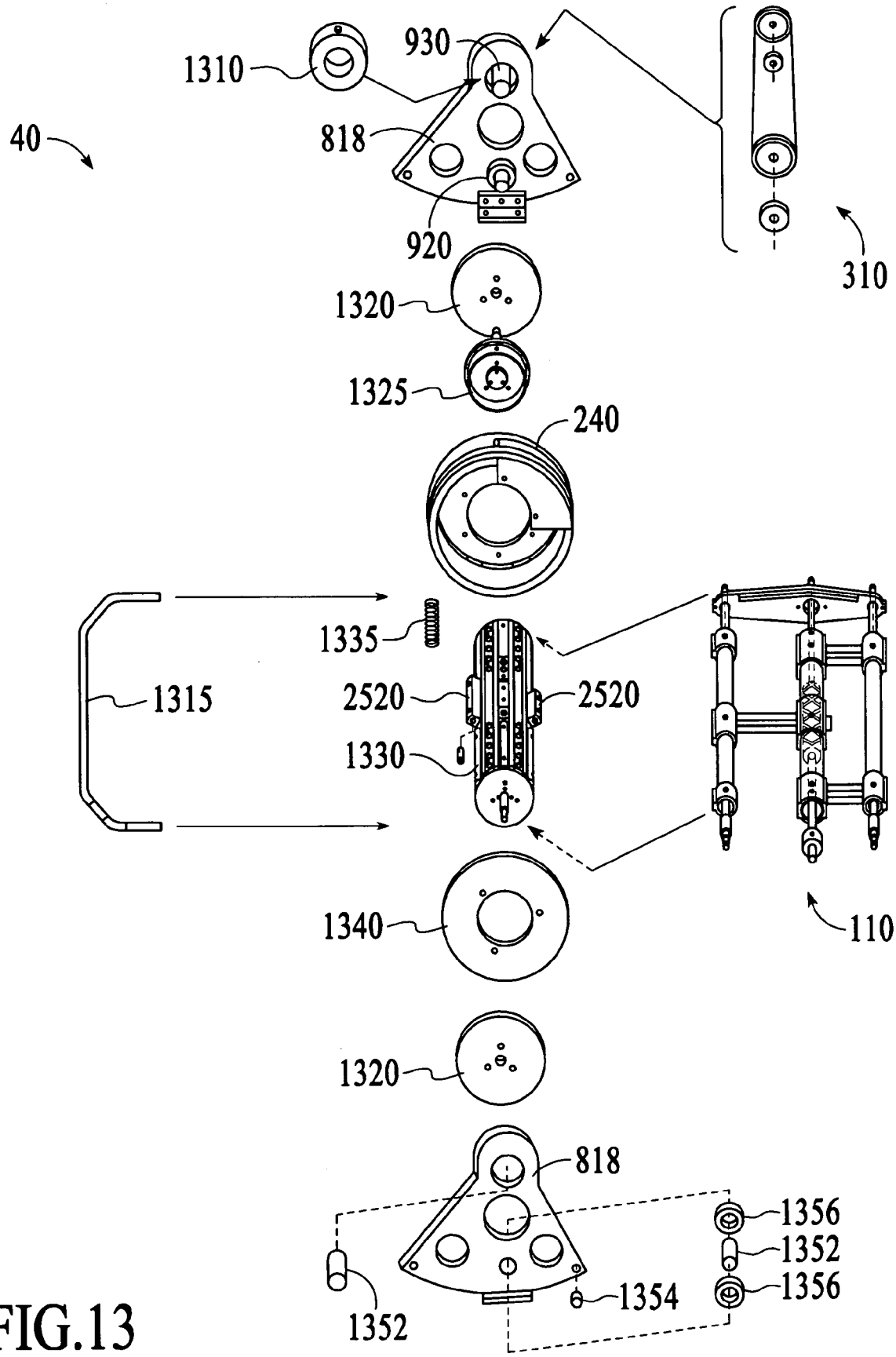
FIG. 13 shows an exploded view of a preferred embodiment of the reefing mechanism, according to the invention.

A preferred embodiment of the reefing mechanism 40 includes a drum assembly based on a single tube, as shown in exploded view in FIG. 13. Drum components are secured to the tube using mechanical fasteners and/or keyways. The tube may be an extruded aluminum tube. This design for the drum assembly allows for lower manufacturing costs than are typically incurred for fabricating a drum assembly from separate drums.

Referring to FIG. 13, the reefing mechanism 40 is comprised of the following components and subassemblies: housing tube mount 1310; mounting struts 818; chain and sprocket assembly 310; drum end disc 1320; drum end plate 1325; LeverDisc™ 240; housing tube 1315; tube 1330; adjustment brackets 1335; levelwind mechanism 110; and center drum disc 1340. Typically three housing tubes 1315 are used, spaced equal apart to prevent fouling of the rotating drums and line leads. See also FIG. 36. A sleeve bearing 1352 and washers 1356 are used to receive the spindle on the end of the tube 1330 in the lower mounting strut 818; a cup bearing 930 is used to receive the spindle on the end of the drum end plate 1325 in the upper mounting plate 818. A sleeve bearing 1352 is used to receive the cam shaft of the levelwind mechanism 110 in the lower mounting strut 818; a cup bearing 920 is used to receive the cam shaft of the levelwind mechanism 110 in the upper mounting plate 818. Acorn nuts 1354 are used to secure the guide rods of the levelwind mechanism 110 in the upper and lower mounting struts 818. A pair of arrows indicate that the levelwind subassembly 110 is to be positioned directly behind the tube 1330. The components and subassemblies of the reefing mechanism 40 are discussed in more detail below.

It is instructive to compare FIGS. 13 and 6, highlighting the equivalent structures. For example: the part of the tube 1330 between a first end disc 1320 and the LeverDisc™ 240 is equivalent to the top drum 210 in FIG. 6; the part of the tube 1330 between the second end disc 1320 and the center disc 1340 is equivalent to the bottom drum 220 in FIG. 6; and the part of the tube 1330 between the LeverDisc™ 240 and the center disc 1340 is equivalent to the center drum 230 in FIG. 6. Note that the leverage battens 2520 shown in FIG. 13 allow for the radius of the "center disc" to be increased, providing greater leverage to the crew during reefing. (See also FIG. 25, for more details of the leverage battens 2520.)

Figure 14:
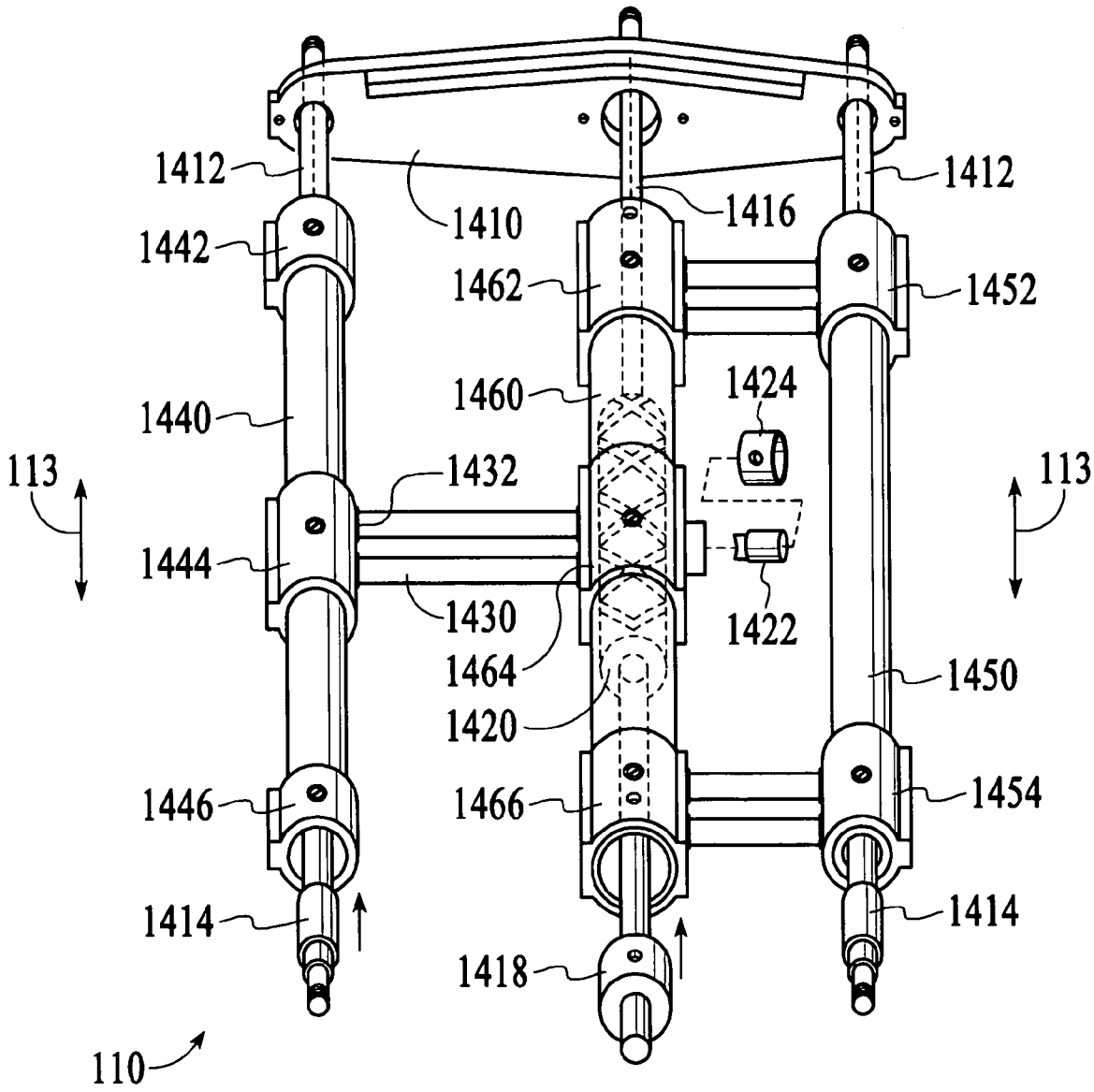
FIG. 14 shows a levelwind mechanism, according to the invention.

The levelwind mechanism 110 is depicted in more detail as a completed subassembly in FIG. 14. The levelwind mechanism 110 has a cam 1420 rotating on a cam shaft 1416 which engages with a cam follower 1422 to translate the rotary motion of the tube 1330 (drum assembly 200 in FIG. 6) into reciprocating motion 113 at a levelwind mechanism for three lines at the same time. These line leads can be seen from a side view in FIG. 6.

The spaces between the line guide rods 1430 are sized slightly smaller than the diameters of the reefing lines passing through them, so that a constant line tension is maintained. This tension ensures that the lines wind smoothly on and off their drum sections. The amount of line tension can be adjusted by sliding plastic or metal bushings of varying thickness over the line guide rods, to vary the width of the space between them.

In the preferred embodiment, the framework for the levelwind mechanism is essentially comprised of a series of closely fitted 6061-T6 aluminum tubes and rods of differing lengths and thicknesses. One of the primary advantages of this construction approach is low cost, since each tubular profile in the levelwind system can be easily extruded through a die and can therefore be produced in large quantities with a minimum of labor or material wastage.

There are three long tubes in the levelwind assembly, which are guirde rod tubes 1440 and 1450, and cam tube 1460. A total of eight short tubular profiles, or "barrels," 1442, 1444, 1446, 1452, 1454, 1462, 1464 and 1466 are fastened to the long tubes with countersunk machine screws. The solid line guide rods 1430, through which the reefing lines and cockpit line pass on their way on and off the drum assembly, are fitted into holes in the sides of the barrels, along with press-fit plastic sleeve bearings 1432. The bearings 1432 allow the line guide rods 1430 to roll as the lines pass between them, resulting in reduced line friction during operation of the reefing mechanism 40. The tubes 1440 and 1450 are coupled to the guide rods 1412 by bearings 1414, which allow for the reciprocating motion 113. The cam tube 1460 is coupled to the cam shaft 1416 by cam tube bearing 1418, which allow for both reciprocating motion 113 and rotation of the cam shaft 1416. A collar 1410 holds all three sections of the levelwind mechanism in proper alignment.

The cam 1420 is fitted to the cam shaft 1416 and inserted into the cam tube 1460. However, the cam 1420 itself does not come into direct contact with the inside wall of the cam tube 1460. Mechanical contact between the cam tube 1460 and the cam shaft 1416 occurs only through the cam follower 1422 as it rides back and forth in the cam grooves. This arrangement reduces both friction and the likelihood of galvanic interaction between the dissimilar metals of the cam 1420 and cam tube 1460. However, it should be noted that a cam 1420 made from acetal plastic would also eliminate the potential for galvanic interaction between the cam 1420 and cam tube 1460, regardless of whether these two components come into physical contact with each other.

The cam tube 1460 serves a double purpose as a housing for the cam 1420 and cam follower 1422, minimizing contact between the cam 1420 and cam follower 1422 and the corrosive elements of rain, salt spray, and sun encountered in the marine environment. (The cam follower 1422 also has a cap 1424 to hold the cam follower in place and to provide further protection from corrosive elements.)

The chain-and-sprocket assembly 310—see FIGS. 6 and 13—creates a mechanical linkage between the drum assembly 200 and the levelwind mechanism 110 positioned behind it. The chain and sprocket assembly 310 is positioned on top of one of the two mounting struts 818 in the reefing mechanism 40. The sprockets are attached to the top ends of the cam shaft 1416 and the shaft of the drum assembly 200, each sprocket being secured to its shaft by means of keys and/or roll pins and setscrews. When the drum shaft turns, the chain and sprocket assembly 310 imparts rotary motion to the camshaft 1416, where it is transformed into reciprocating motion 113 by the levelwind cam 1420 and follower 1422. See FIG. 14.

Referring to FIGS. 6 and 14, the stroke of the cam 1420 is designed to equal the length of each drum section on the drum assembly 200. The cam stroke therefore allows each pair of line guide rods 1430 on the levelwind mechanism 110 to traverse the full length of its respective drum section before starting back the other way on a second cam stroke. At the same time, the cam lead is designed so that each set of guide rods 1430 traverses a distance equal to the diameter of the reefing lines for every complete revolution of the drum assembly 200. This lead arrangement causes the wraps of line in the reefing mechanism 40 to lay precisely alongside each other every time the drum assembly 200 completes a revolution, thereby maximizing the usable drum space.

It is a straightforward matter to create the proper stroke in a levelwind cam 1420, since the stroke is simply a function of cam length. However, designing the proper lead into a levelwind cam 1420 can be more problematic. This is because the length of the lead determines the angle at which the grooves machined into the cam's surface cross over each other. If the crossover angle is too shallow, then the cam follower 1422 can either jam or travel backward in the cam grooves, which would obviously constitute a serious malfunction of the levelwind mechanism 110.

In the preferred embodiment of the LeverDisc™ mainsail reefing system, the 0.43" diameter of the reefing lines constitutes a distance that is too small to translate into a proper crossover of the cam threads. The solution to this problem is therefore to specify a 2:1 ratio between the drum sprocket and cam shaft sprocket diameters in the sprocket/chain assembly 310, so that one complete revolution of the drum shaft causes the cam shaft 1416 to rotate only one-half of a complete revolution. Using this arrangement, the cam lead can be doubled to 0.875", creating an acceptable crossover angle at the cam threads while still allowing the 0.43" diameter wraps of reefing line to lay alongside themselves every time the drum assembly 200 completes a single revolution.

As an additional benefit, a 2:1 drum shaft sprocket to cam shaft sprocket ratio imparts a constant leverage advantage from the drum assembly 200 to the levelwind mechanism 110 behind it. Since the drum shaft always constitutes the "driving" or activating shaft in the system, and the cam shaft 1416 always constitutes the "driven" or passive shaft, chain sprocket ratios of 2:1, 3:1, or even greater would always impart a helpful leverage advantage to the crew in the cockpit, both during reef deployment and also when the reef is released and the mainsail is raised up again on its halyard.

If necessary, a separate idler sprocket (not shown) could be fitted between the drum and cam shaft sprockets in the sprocket/chain assembly 310, to facilitate adjustment of chain tension on the sprockets. To control chain tension, the idler sprocket could be keyed or pinned to a shaft positioned inside a slot machined in the mounting strut 818. The slot could be at right angles to the axis of the chain, so that the idler sprocket could be moved back and forth along it to increase or decrease chain tension as required.

FIGS. 15A-B shows aspects of a "low profile" configuration of a levelwind mechanism 110. FIG. 15A shows an exploded view of the guide rods 1412, camshaft 1416 and line guide rods 1430 of a levelwind mechanism 110. FIG. 15B shows a bottom view of a mounting strut 818. In this embodiment of the levelwind mechanism 110, the guide rods 1412 are swept forward relative to the cam shaft 1416, as indicated by the arrows, so that the overall diameter of the levelwind mechanism 110 is reduced. Note that the guide rod holes 812 in the mounting struts 818 are also swept forward.

Figure 16:
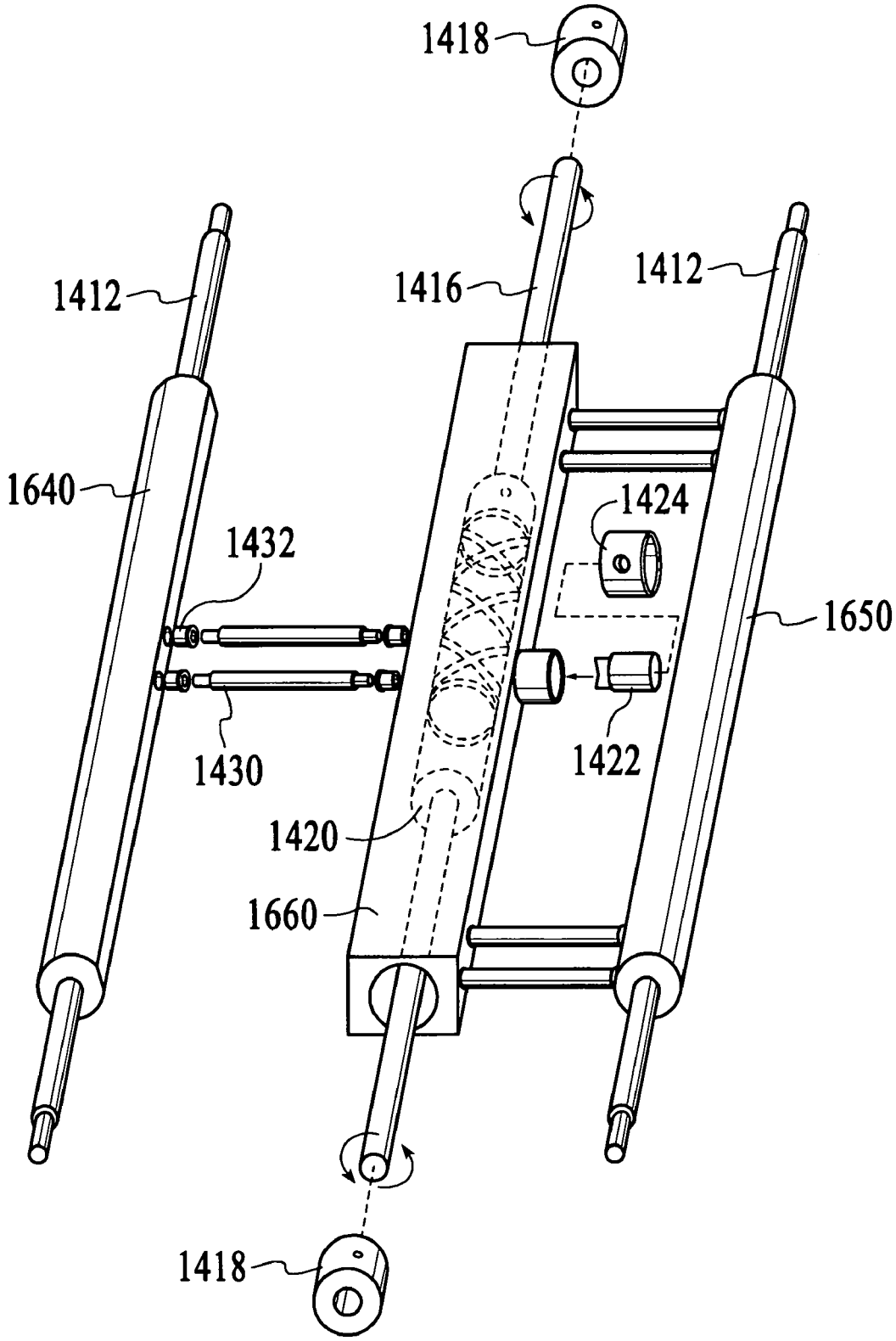
FIG. 16 shows an exploded view of a first alternative embodiment of the levelwind mechanism, according to the invention.

FIG. 16 shows an exploded view of a first alternative embodiment of the levelwind system 110, fabricated from three full-length tubes 1640, 1650 and 1660. This alternative embodiment eliminates the short barrels that are fastened to full-length tubes of reduced wall thickness in the preferred embodiment. In this alternative embodiment, the cam tube is a single-piece rectangular block, with a full-length hole for the levelwind cam 1420 and cam shaft 1416 machined along its length.

Figure 17:
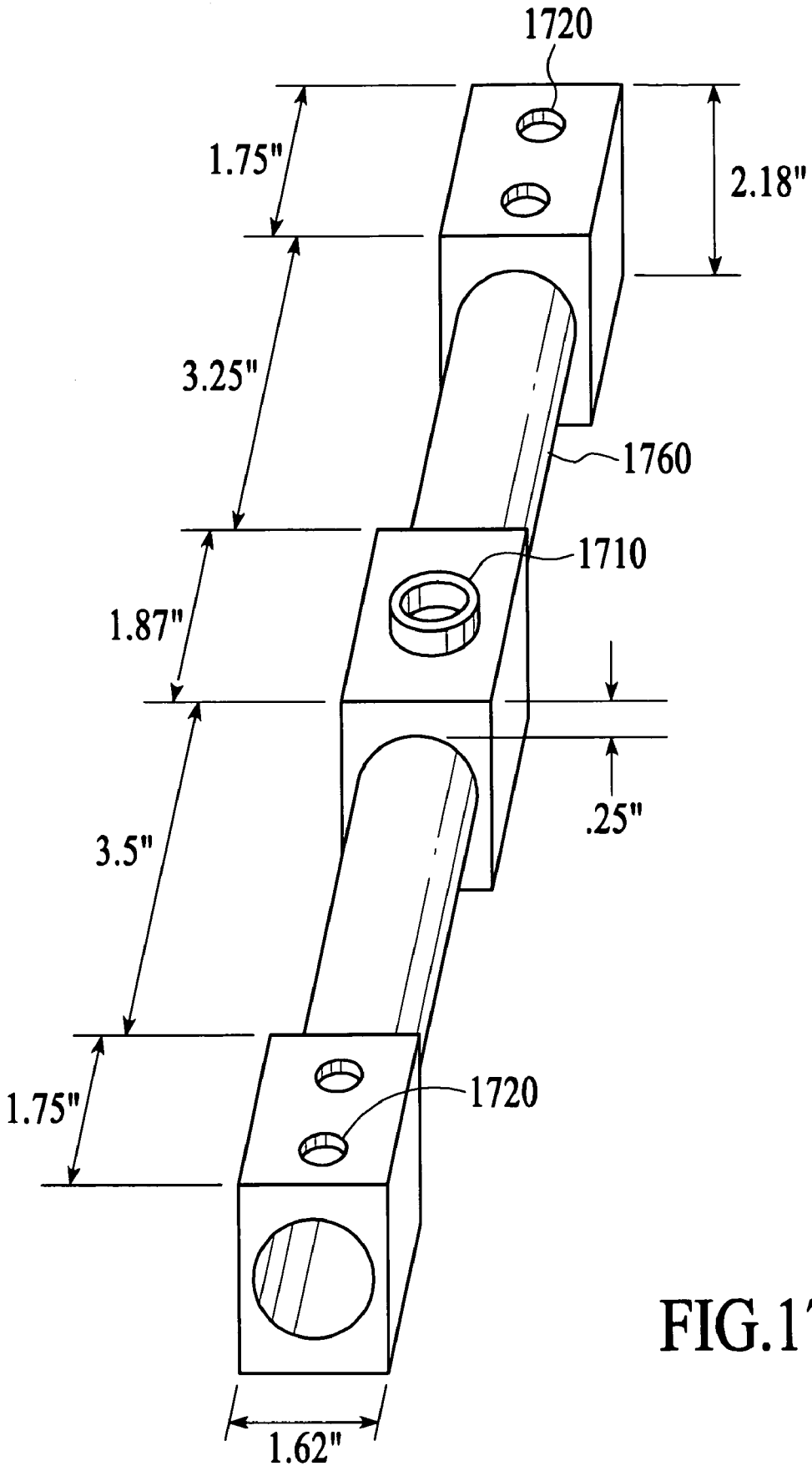
FIG. 17 shows a variation on the cam tube in the levelwind mechanism of FIG. 16.

FIG. 17 shows a variation on the single-piece cam tube 1660 of FIG. 16. The cam tube 1760 is machined to provide a reduced wall thickness between the three line guide sections of the tube. The purpose of this embodiment is to retain a single-piece cam tube while at the same time reducing some of the unnecessary weight in the tube 1660. FIG. 17 clearly shows the holes 1720 drilled for fitting line guide rods and the collar and aperture 1710 for fitting the cam follower. The measurements shown in FIG. 17 are provided to give an idea of the general size of the levelwind mechanism, but will vary depending on the size of the mainsail and the type of reef.

Figure 18:
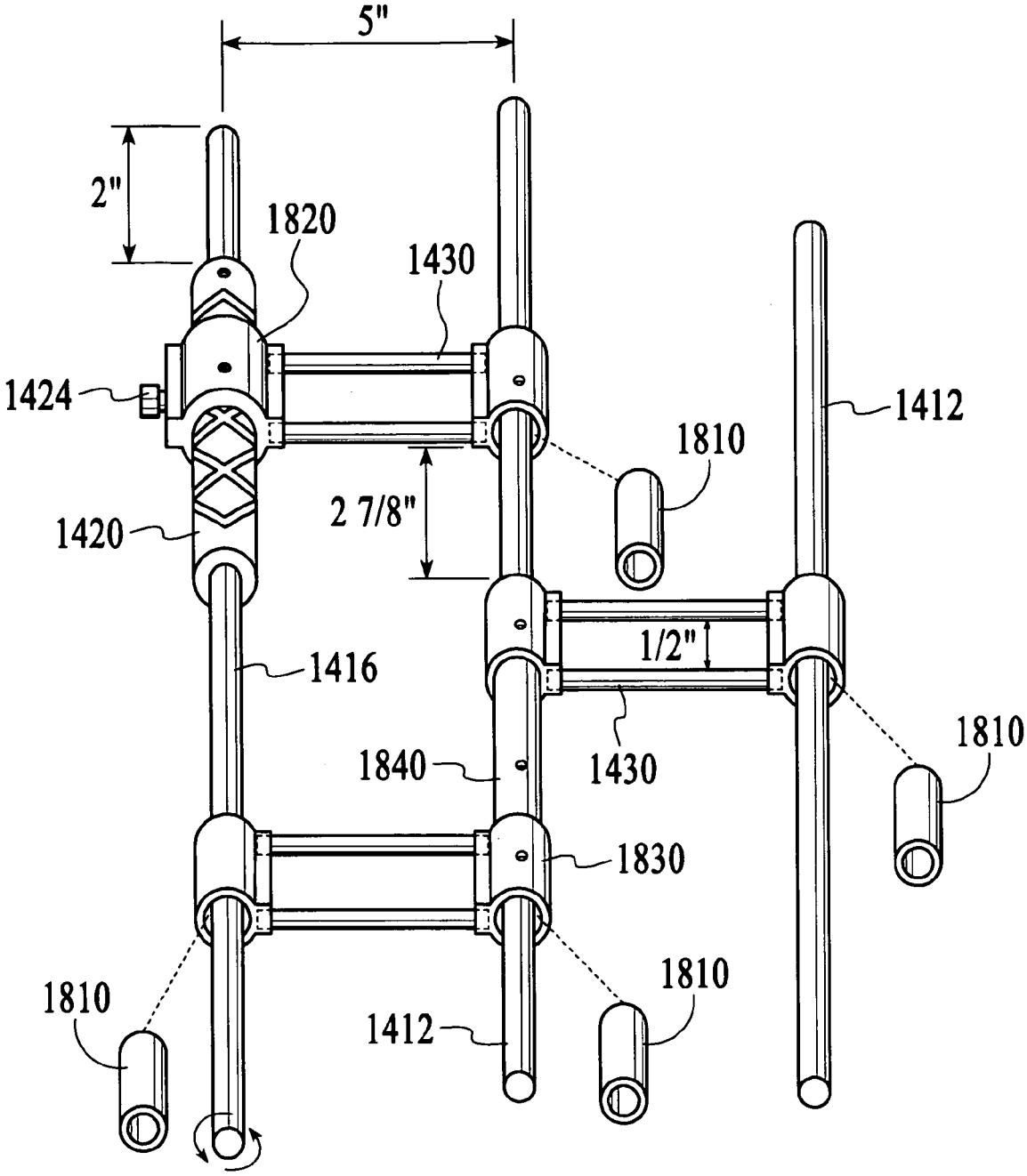
FIG. 18 shows an exploded view of a second alternative embodiment of the levelwind mechanism, according to the invention.

FIG. 18 shows an exploded view of a second alternative embodiment of the levelwind mechanism 110, wherein the levelwind cam 1420 and cam shaft 1416 are positioned off-center (on the left, as depicted in the drawing) in the levelwind mechanism 110, as compared to the centered arrangement of cam 1420 and cam shaft 1416 in the preferred embodiment shown in FIG. 14. In this alternative embodiment, there is only one full-length tube 1840 in the levelwind mechanism. The tube 1840 is positioned at the center of the mechanism and there are three short barrels 1830 fastened to it with setscrews or machine screws. These short barrels 1830 could also be welded to the full length tube 1840 in this alternative embodiment of the levelwind mechanism. The three short barrels 1830 and the single long tube 1840 could also comprise a single machined piece, similar to the alternate embodiment shown in FIG. 17.

The cam traverse sleeve 1820 in this alternate embodiment also consists of a short barrel, as opposed to the full-length cam tube described in the preferred embodiment of the invention. (Compare FIG. 18 with FIG. 14.) Teflon sleeve bearings 1810 could be used in this embodiment, as shown in FIG. 18. The measurements shown in FIG. 18 are provided to give an idea of the general size of the levelwind mechanism, but will vary depending on the size of the mainsail and the type of reef.

Although not shown in FIG. 18, two separate levelwind collars (for example, see FIG. 14 collar 1410) could be attached to this embodiment of the levelwind mechanism to provide additional mechanical stiffness. The first collar could be fastened between the cam barrel 1820 and top center barrel at the top end of the assembly, while the second collar could be attached in the middle of the levelwind mechanism, between the center guide rod barrel and the guide rod barrel positioned by itself on the stationary guide rod 1412, shown on the right side of the figure.

Figure 19:
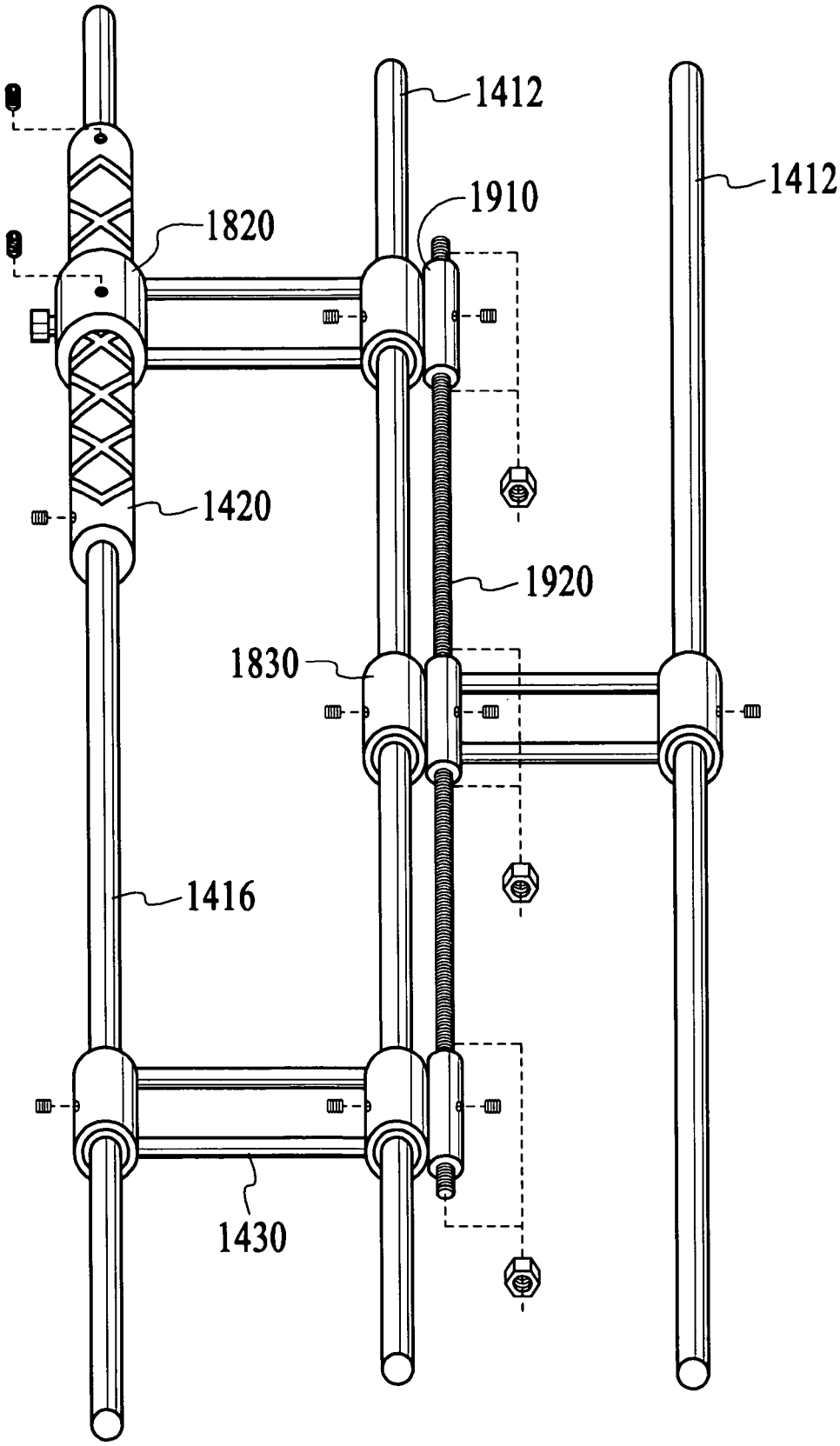
FIG. 19 shows a third alternative embodiment of the levelwind mechanism, according to the invention.

FIG. 19 shows a third alternative embodiment of the levelwind mechanism 110, wherein a threaded adjustment rod 1920 forms the mechanical link between the three line guide sections of the levelwind mechanism. The cylinders 1910 on the rod 1920 are rigidly coupled to the barrels 1830 on the center guide rod 1412. The cylinders 1910 can be adjusted to any positions on the rod 1920 and thus the movable barrels 1830 can be positioned where desired. An advantage of this embodiment is that the three line guide sections can be adjusted to any position behind the drum assembly 200. See FIG. 6. To mitigate mechanical loads, levelwind collars could be placed between one or more of the barrels shown in this embodiment, as described above in reference to FIG. 18.

Figure 20A:
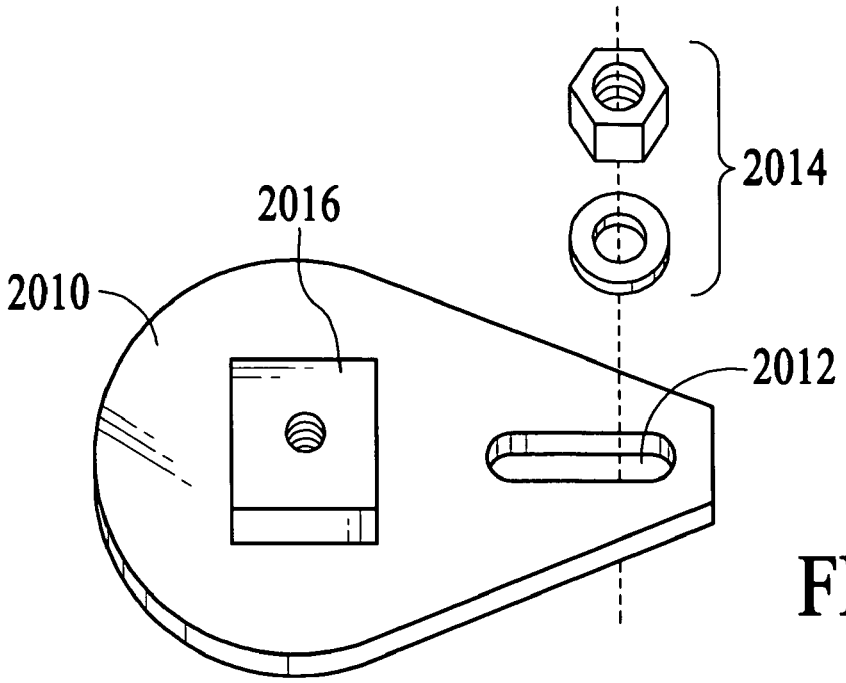
FIGS. 20A-B show a friction block, according to the invention.
Figure 20B:
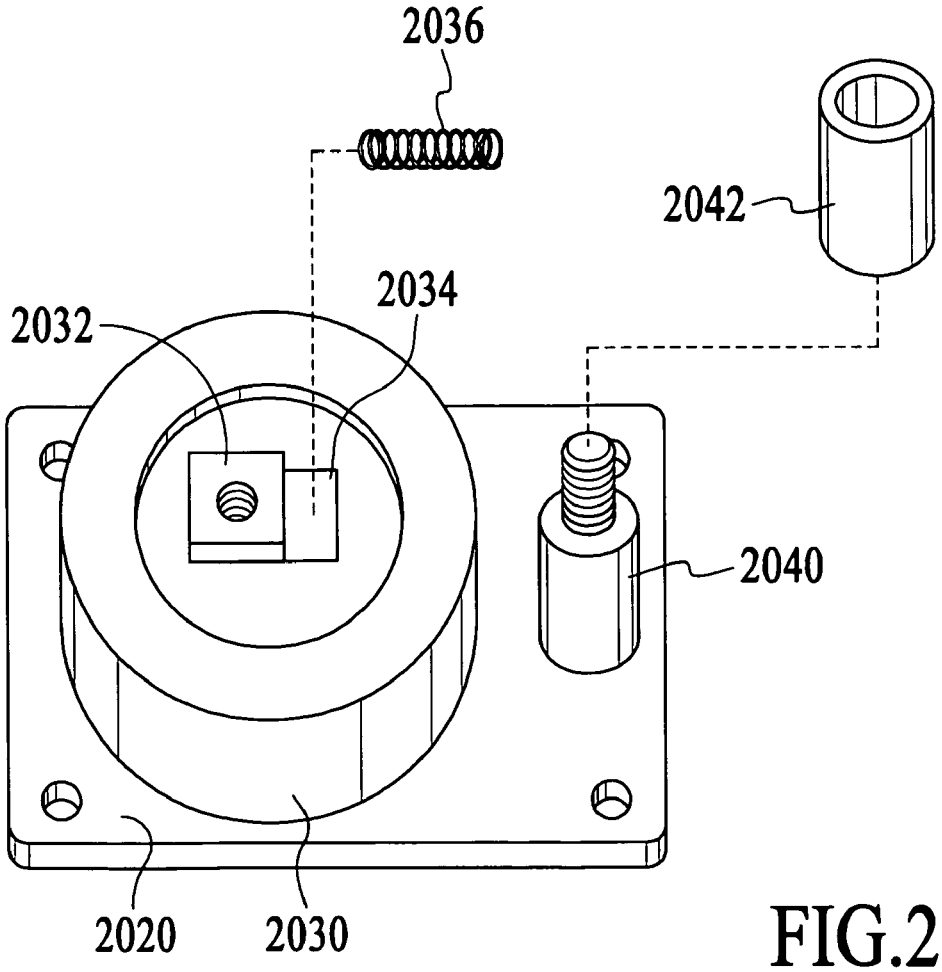

FIGS. 20A-B show views of a friction block that could be used in place of the line tensioning arrangement described in the preferred embodiment of this invention, described above in reference to FIG. 14. FIG. 20A shows the top part of the friction block which comprises a block shell 2010, a friction post adjustment slot 2012, friction post nut and washer 2014, and threaded shaft recess 2016. FIG. 20B shows the bottom part of the friction block which comprises a mounting plate 2020, a line sheave 2030, a shaft 2032, a shaft recess 2034, a spring 2036, a friction post 2040 and a friction post sleeve 2042. The line sheave and friction post sleeve may be made of Delrin®, all other parts may be made of stainless steel. The recess 2016 in the block shell 2010 fits over the shaft 2032 and the threaded part of the friction post 2040 fits through the friction post adjustment slot 2012 and is secured in place by nut and washer 2014.

Line tension is applied to the reefing and cockpit lines as they pass around a set of friction blocks prior to entering the levelwind mechanism. An advantage of the friction block embodiment of FIGS. 20A-B is that the line sheave 2030 moves away from the friction post 2040 as line tension increases, thereby allowing the line to move unimpeded around the sheave 2030 once the line becomes taut. In this arrangement, friction is only applied to the line when the line is slack and tension is needed.

The friction blocks are conveniently placed close to the levelwind mechanism. For example, referring to FIG. 4A, the friction blocks could be placed on the side of the mast 22, directly behind the levelwind mechanism 110.

A friction block similar to that of FIGS. 20A-B could potentially find a variety of applications on a sailboat, wherever intermittent line friction is required.

Figure 21:
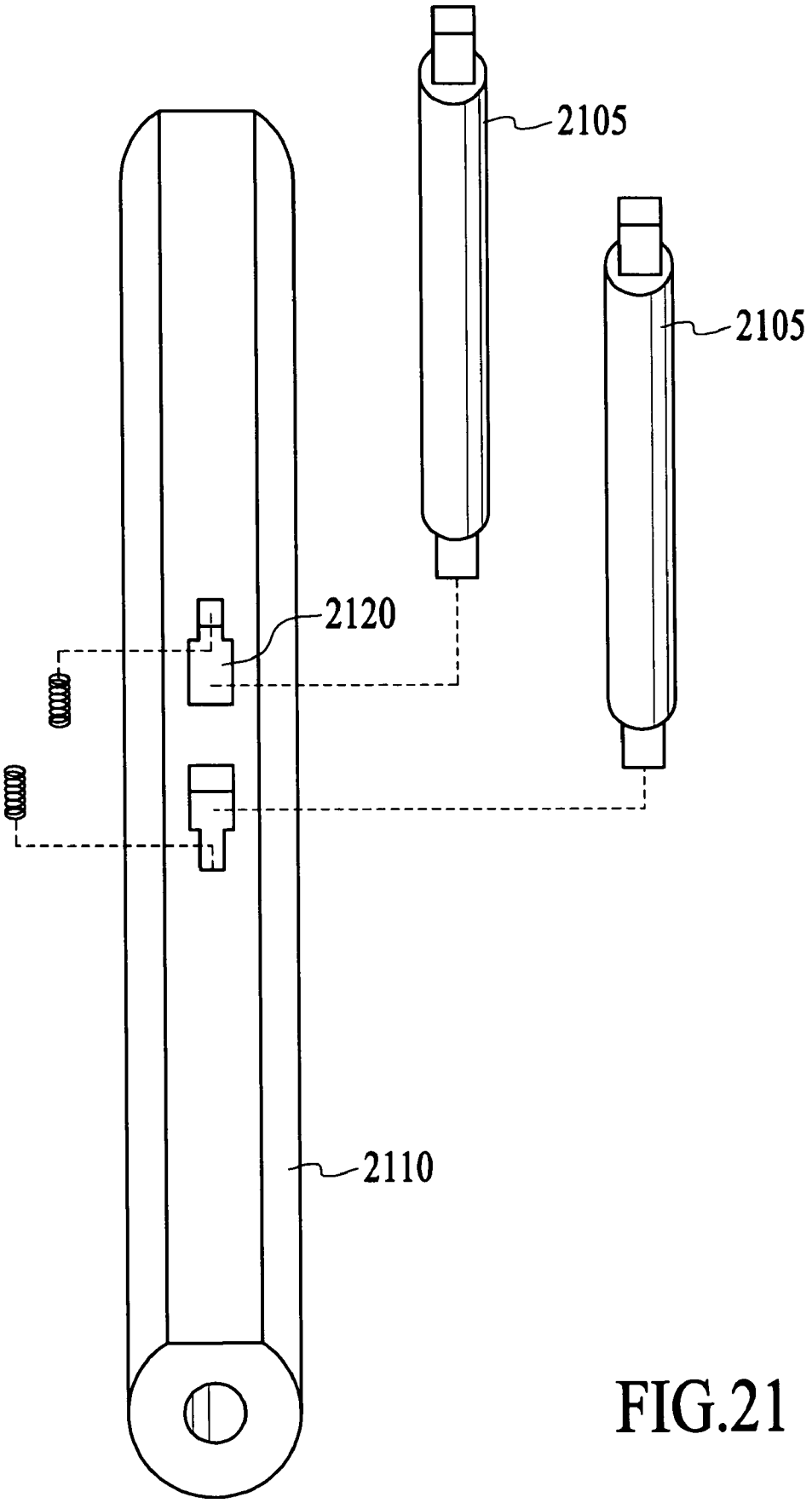
FIG. 21 shows spring tensioned line guide rods, according to the invention.

FIG. 21 depicts another alternative embodiment of a line-tensioning mechanism for the reefing and cockpit lines in the LeverDisc™ mainsail reefing system. In this alternative embodiment, a pair of line guide rods 2105 with squared ends is inserted into a pair of corresponding spring-loaded slots 2120 in a line guide tube 2110. (Compare with the line guide rods 1430 of FIG. 14, which are free to rotate.) The line guide tube 2110 could either be full length, or it could be shortened considerably, in a similar fashion to the barrel components in the preferred embodiment. See barrels 1442, 1462, 1464, 1466, 1452 and 1454 in FIG. 14. The spring-loaded guide rods 2105 in FIG. 21 move back against spring tension as the reefing and cockpit lines pass between them, thereby imparting a constant tension upon the lines.

A pair of thin metal or plastic bushings could also be slipped over the line guide rods 2105 in this alternative embodiment, to create a bearing surface that would turn as the reefing lines passed over them.

Figure 22A:
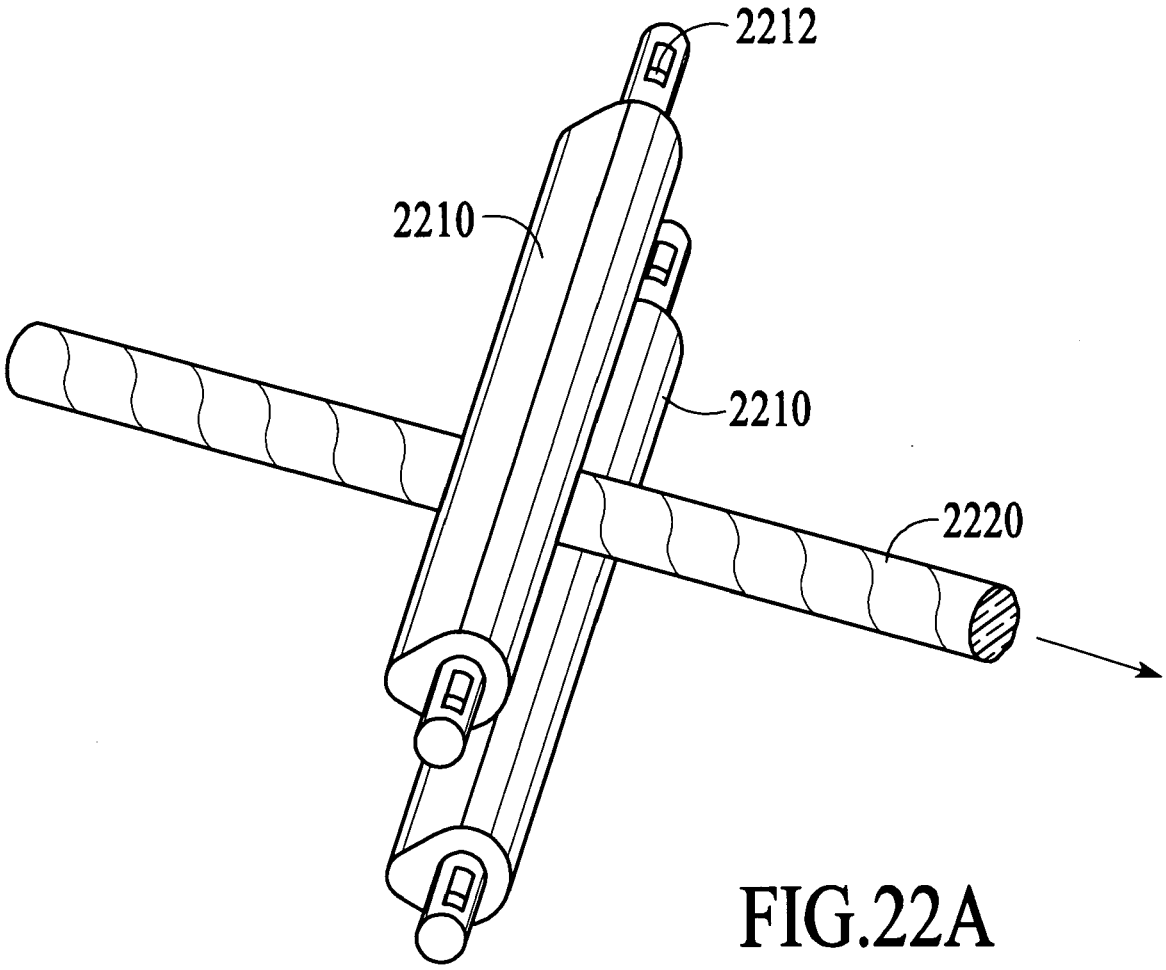
FIGS. 22A-B show line tensioning cams, according to the invention.
Figure 22B:
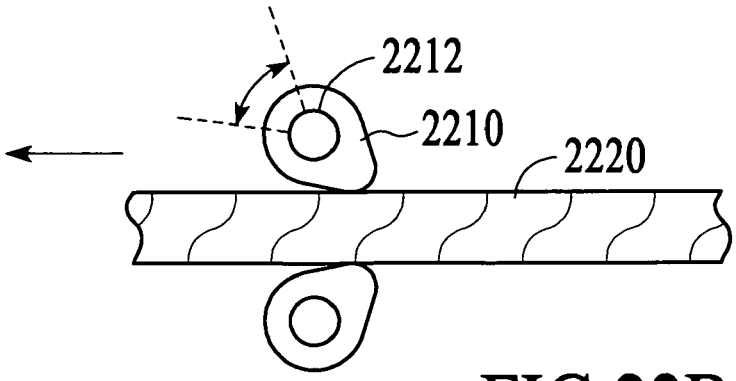

FIGS. 22A-B show another alternative embodiment of the levelwind line guide rods, wherein the rods are shaped like cams. In this embodiment, line friction is applied by the cams 2210 when the line is traveling in one direction and released when the line travels in the other direction. (The cross-sectional representation of FIG. 22B shows friction being applied to the line 2220 moving to the left by the cam shaped guide rods 2210.) The round shafts on each end of these cam-shaped guide rods 2210 could be spring-loaded if necessary, so that the line guides would return to a pre-set position whenever line tension was removed. Keys 2212 positioned on the ends of the guide rod shafts 2210 could also travel between a pair of corresponding notches in shaft bearing cups, thereby limiting the rotational movement of the cams, as indicated in FIG. 22B, and thus limiting the amount of friction that can be applied to the reefing lines 2220.

Referring to FIG. 13, drum end discs 1320 are fastened to each end of the tube 1330. Discs 1320 contain the reefing lines on their respective drum sections as they wind on and off during operation. To reduce overall weight, the discs 1320 can be specified with lightening holes to be machined in them.

There is also a center drum disc 1340 that fastens underneath the LeverDisc™ 240 to create a center drum for the cockpit line. See FIGS. 13 and 6.

A drum end plate 1325 is inserted into each end of the tube 1330 and mechanically fastened in place with machine screws. The primary function of the end plates 1325 is to hold the drum shafts in place, thereby creating an axis around which the drum assembly rotates. The drum shafts are expected to encounter considerable side loads during the reefing process, especially when outhaul tension is applied to the mainsail. The drum shafts and drum end plates 1325, to which they attach, are therefore designed to absorb and spread these loads over a maximum surface area. Load spreading is accomplished by means of the large diameter base plates 2540 on the drum shafts themselves, which are most clearly seen in FIG. 25, and also by means of the long flanges 2550 extending down from the end plates 1325 into each end of the tube 1330. When side loading occurs, these flanges 2550 effectively transmit a portion of the load from the drum shafts to the walls of the tube 1330. The base portions of the drum shafts are also sized up relative to the tops of the shafts, in order to better withstand the leveraging effect of side loads. (This can be clearly seen in FIG. 25.) It should also be noted that the drum shafts constitute separate assemblies that insert into the drum end plates 1325 and fasten in place with machine screws. This arrangement greatly minimizes material wastage during the machining process.

Figure 23:
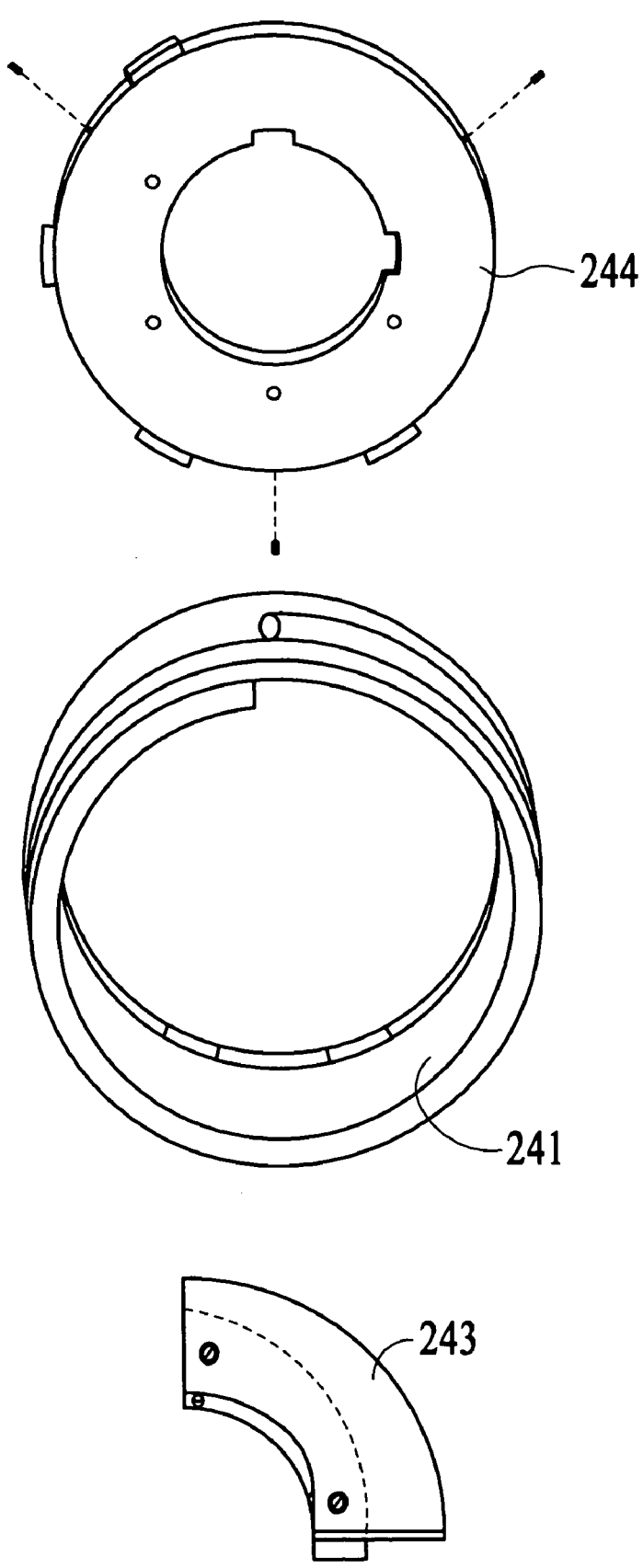
FIG. 23 shows an exploded view of a LeverDisc™, according to the invention.

The preferred embodiment of the LeverDisc™ 240 consists of three separate parts fastened together with machine screws, as shown in FIG. 23. One of the primary benefits of this embodiment is low production cost. The LeverDisc™ lid 244 can be cut from stock aluminum plate using a waterjet or laser cutting process, with a minimum of labor and material wastage, while the LeverDisc™ thread 241 can be machined from a stock aluminum tube of sufficient diameter and wall thickness. Finally, the exit thread 243 is fabricated in two parts—the wedge can be produced from a plastic mold at very low cost, while the thread itself can be cut from a stock sheet of Ultra-High Molecular Weight Polyethylene (UHMW) or similar material and then fastened to the wedge using machine screws. Alternatively, the wedge could also be cut from a solid sheet of UHMW or similar material.

Note that the exit thread 243 in FIG. 23 is depicted with a constant outside diameter, so that the thread depth increases significantly from the wide to the narrow portion of the plastic helical wedge. As an alternative preferred embodiment, the outside edge of the exit thread could also be specified as following the curve of the helical arc on the wedge, so that the thread depth remains constant throughout the length of the wedge.

The LeverDisc™ is assembled as follows: the sprockets on the outer edge of the LeverDisc™ lid 244 fit into corresponding notches machined into the LeverDisc™ thread 241. The lid then fastens into place with three setscrews, as shown. The purpose of this sprocket-to-notch arrangement is to provide mechanical strength to withstand the expected torsional loads on the LeverDisc™ 240.

There are two additional notches machined into the center hole of the LeverDisc™ lid 244, as shown in FIG. 23. These notches are keyways, designed to slide over a corresponding pair of aluminum or stainless steel keys attached to the tube 1330. (See keys 2510 in FIG. 25.) This key-to-keyway arrangement is also designed to absorb expected torsional loads on the LeverDisc™ 240.

The exit thread 243 does not attach directly to the LeverDisc™ thread 241, but instead fastens with machine screws to the wall of the tube 1330 at the narrow end of the wedge. The wide end of the exit wedge mates with the end of the bottom thread on the LeverDisc™ thread 241 when the combined LeverDisc™ lid 244 and thread 241 is fastened onto the tube 1330.

Alternatively, the LeverDisc™ 240 could consist of a single piece of aluminum or other suitable metal or plastic, machined to the specifications of the preferred embodiment LeverDisc™ 240. A combination of metal casting, molding, and machining could be used to produce this single-piece LeverDisc 240.

Furthermore, the exit thread of the preferred embodiment of the LeverDisc™ could be eliminated. In this embodiment, the cockpit line winds off the bottom LeverDisc™ thread and drops straight onto the center section 230 of the drum assembly 200. See FIGS. 6 and 23.

Figure 24:
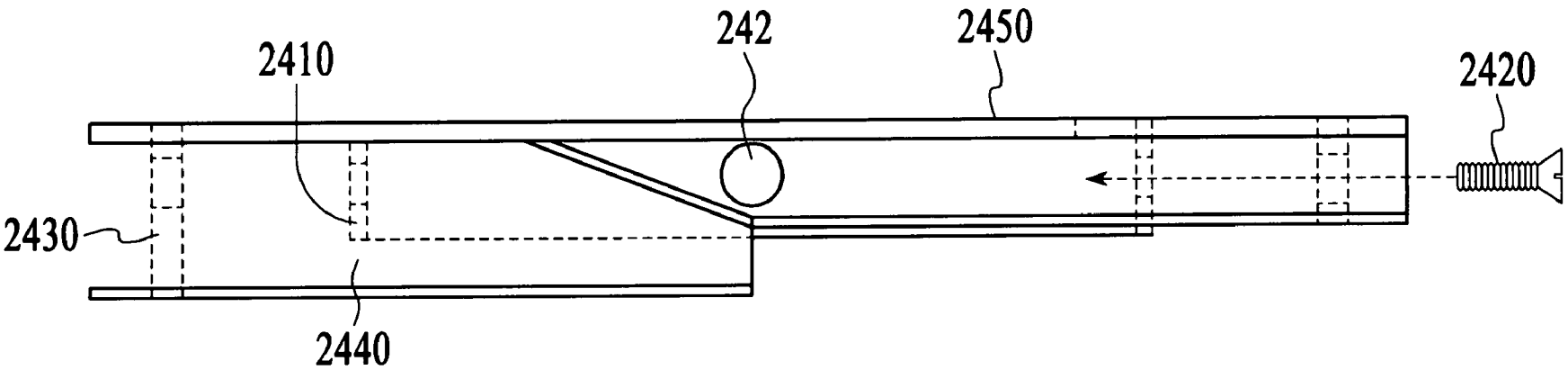
FIG. 24 shows a side view of an alternative embodiment of the LeverDisc™, according to the invention.

The alternative LeverDisc™ embodiment shown in FIG. 24 has a modified thread arrangement relative to the preferred embodiment. In this alternative embodiment, the number of threads on the LeverDisc™ thread 2430 is kept to a minimum by eliminating thread pitch and placing the threads along the bottom edges only of the LeverDisc. An exit thread 2440 could either be included or omitted from this alternative embodiment. A flange 2410 on the LeverDisc™ lid 2450 fits over the cockpit section of the tube 1330 and fastens to the drum wall with machine screws 2420 inserted at right angles to the drum axis. To access the fasteners 2420, a hole is drilled through the outer wall of the LeverDisc™ thread 2430 in front of each hole in the flange 2410, to allow a screwdriver blade to pass through the wall of the LeverDisc™ thread 2430 to the fastener heads. These holes are shown in FIG. 24.

Figure 25:
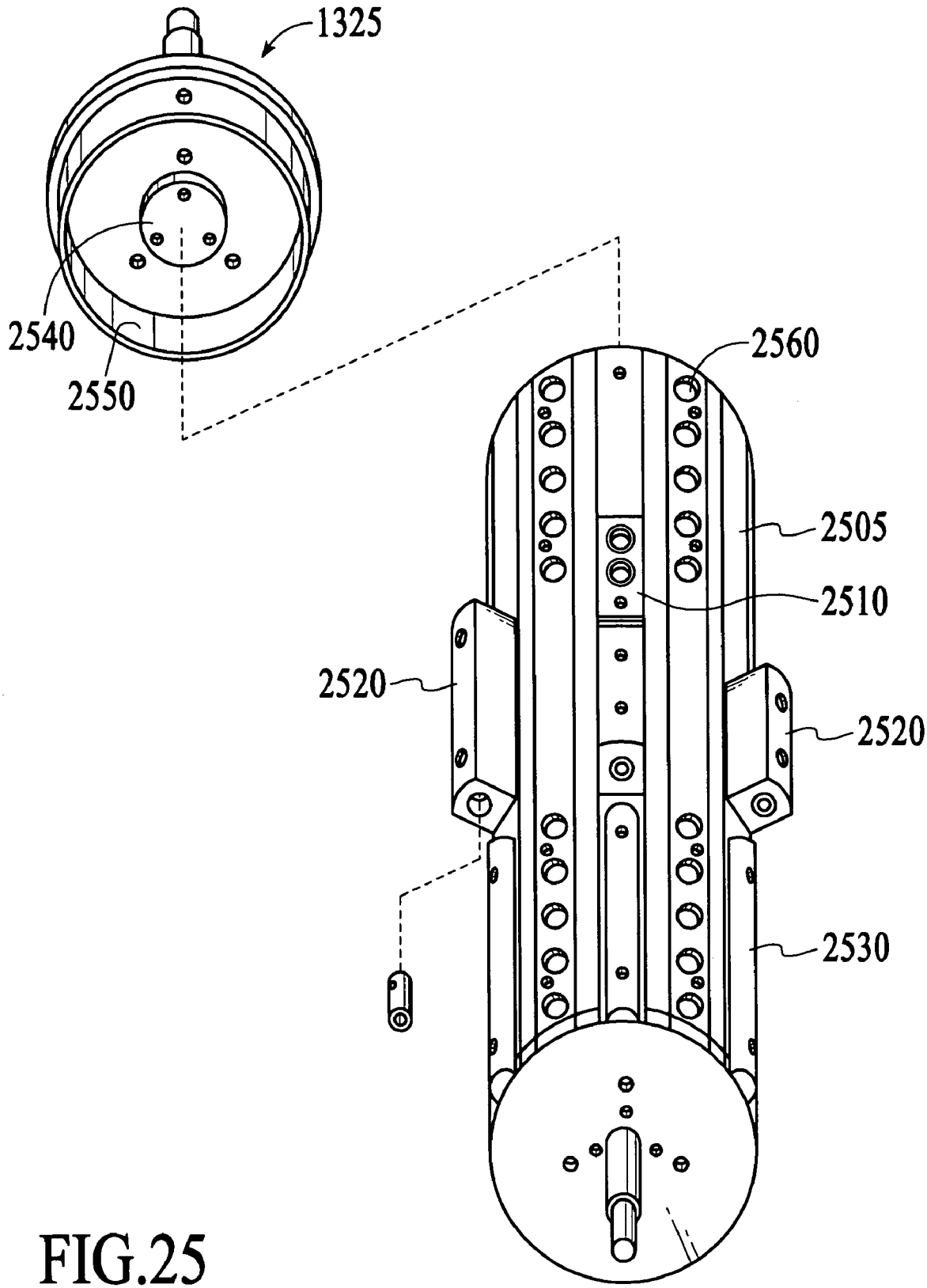
FIG. 25 shows a more detailed exploded view of the drum assembly of the reefing mechanism of FIG. 13.

The drum assembly shown in FIG. 25 constitutes the foundation of the reefing mechanism, in the sense that nearly all other components are fastened to it in some way to complete the preferred embodiment of the invention. The preferred embodiment of the drum assembly consists of a hollow, one-piece drum 2505 with flats positioned at regular increments around its outer circumference. Drum 2505 comprises an extrudable profile. As an extrusion, the drum 2505 can be produced with a minimum of labor cost and material wastage. Line adjustment holes 2560 are drilled through the drum's flat sections at specified intervals, as shown in FIG. 25. The purpose of the line adjustment holes 2560 is to allow the starting positions of the luff and leech end reefing lines to be closely matched to the starting position of the cockpit line on the cockpit drum, during first-time installation of the LeverDisc™ mainsail reefing system on a boat, as described above. Attachment holes for other components are also drilled and tapped into the drum 2505 where necessary.

The half-rod timing battens 2530 shown in FIG. 25 are designed to allow varying diameters to be established along the luff and leech line sections of the drum 2505. This in turn allows the rate of pull of either the luff end or leech end reefing line to be altered simply by adding or removing a set of half-rod timing battens 2530 to the luff or leech section of the drum 2505, since a wider drum diameter will pull in a longer length of reefing line per drum revolution.

This "timing" ability can be crucial to the operation of the LeverDisc™ mainsail reefing system, since in many installations the length of the luff and leech end reefing lines can be slightly different from each other, due primarily to differences in the line lead and block placements along the boom and mast. If either the luff or leech end reefing line is longer than its counterpart in a given installation, a set of half-rod timing battens 2530 can be installed at the appropriate position on the drum 2505, to even out the rate of pull at each end of the mainsail.

To add additional height to a half-rod timing batten 2530, a flat plastic shim 2952 can be positioned underneath it. See FIG. 29 The half-rod timing battens 2530 can either be extruded through a die or made in a machine shop, by cutting a plastic rod in half along its length. The half-rod timing battens 2530 can be made from UHMW or similar plastic material.

The extruded leverage battens 2520 shown in FIG. 25 are mechanically fastened to the cockpit line section of the drum 2505. The fasteners pass through threaded, stainless steel barrels press-fitted into each end of each leverage batten 2520, as shown in FIG. 25, thereby holding the barrels firmly in position at each end of the battens. The same fasteners then screw into threaded holes in the drum 2505, so that the leverage battens 2520 are tightly secured to the machined flats on the drum 2505. As their names imply, the extruded leverage battens 2520 can be economically extruded through a plastic die. The hole running through the center of each batten 2520 comprises part of this extrusion profile.

The extruded leverage battens 2520 serve two important purposes in the LeverDisc™ mainsail reefing system. First, they present convenient attachment points for both the LeverDisc™ 240 and center drum disc 1340. (See FIG. 13.) These components attach to each end of the leverage battens 2520 by means of mechanical fasteners that pass through the LeverDisc™ 240 and center drum 230 parts, then screw into the threaded centers of the metal barrels held in place at each end of the leverage battens 2520. Second, the extruded leverage battens 2520 allow the diameter of the center section of the drum 2505 to be increased relative to the top and bottom sections of the drum. Since the center section of the drum assembly handles the cockpit line, increasing its diameter increases the leverage imparted to the crew throughout the reefing process, even before the cockpit line moves out to the LeverDisc™ threads 241 for the application of outhaul tension. See FIGS. 6 and 25.

Furthermore, by placing flat plastic shims of varying thicknesses underneath the extruded leverage battens 2520 to alter their height, the exact amount of leverage delivered to the cockpit line during a reef can be adjusted to the specific preference of the crew.

The downside of the extruded leverage battens is that they increase the total amount of line necessary to deploy the reef, by increasing the overall circumference of the center portion of the drum 2505. This disadvantage must be weighed against the advantage of providing increased leverage for the crew throughout the entire reefing process.

Both the timing battens 2530 and leverage battens 2520 could be controlled by means of thumbscrews or other suitable arrangements built into the drum 2505, in a fashion similar to the chuck mechanism on a power drill. In this embodiment, the timing and/or leverage battens would be positioned inside slots machined in the wall of the drum 2505. By turning a thumbscrew or set of thumbscrews, a gear mechanism or set of mechanisms located inside the drum 2505 would engage the timing and/or leverage battens, causing them to either extend outward from or retract further into the drum 2505. In this way, the leverage and/or timing delivered to any of the drum sections could be precisely controlled, without the need for adding or removing battens.

The keys 2510 shown in FIG. 25 are designed to hold the LeverDisc™ 240 in position against the torsional loads expected during the outhaul phase of the reefing process. (See also FIG. 13.) The keys 2510 fit snugly into a pair of keyways machined into the center hole of the LeverDisc™ lid 244. (See also FIG. 23.) The keys are mechanically fastened to the walls of the LeverDisc™ 240. The keys can be fabricated from stainless steel or aluminum.

Figure 26A:
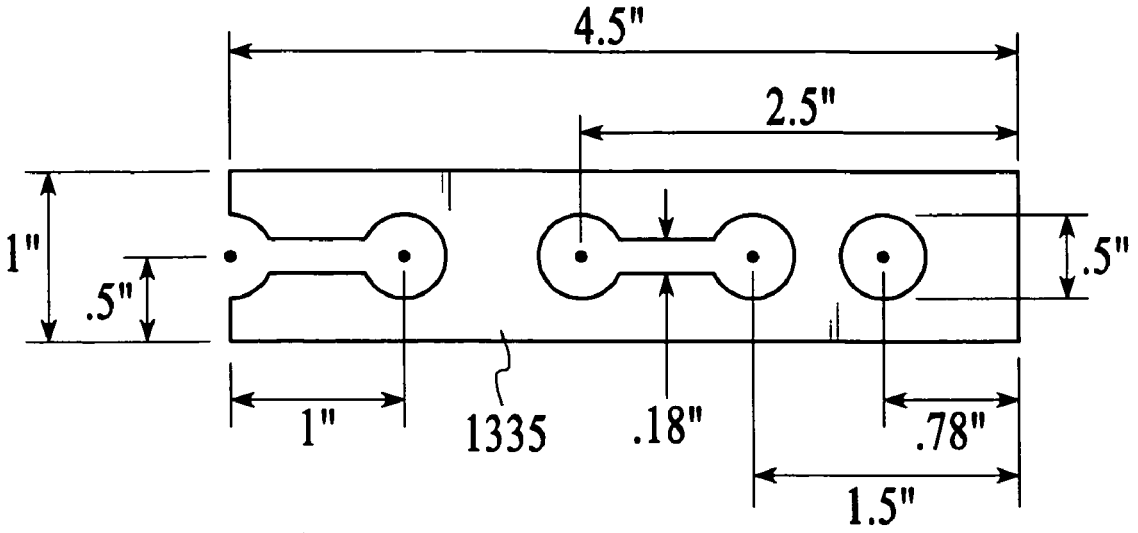
FIGS. 26A-B show an adjustment bracket for use with the drum assembly of FIG. 25, according to the invention.
Figure 26B:
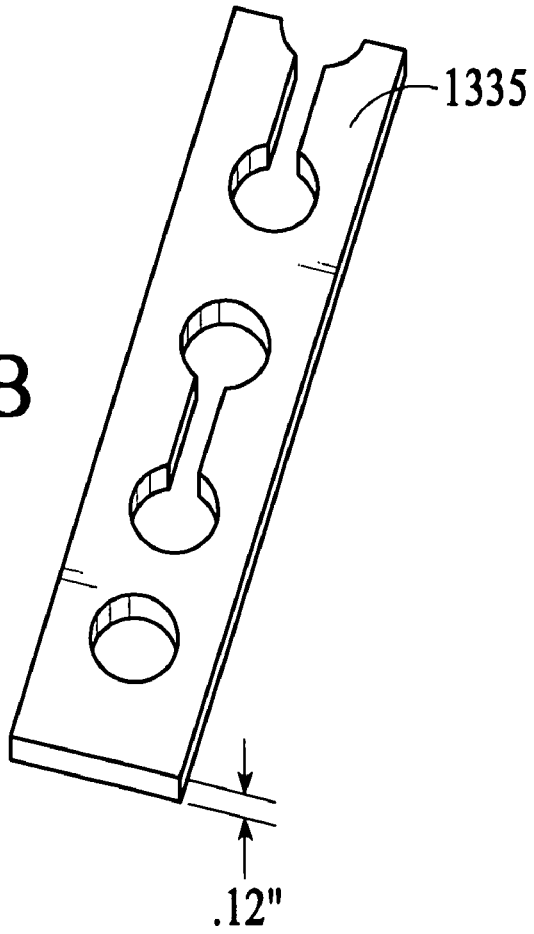

The adjustment brackets 1335 depicted in FIGS. 26A-B are designed to secure the luff and leech end reefing lines to their respective drum sections, at points along the drum that match the reefing lines to the starting position of the cockpit line. This ensures that all three lines begin the reefing process at approximately the same positions on their respective drum sections. See discussion of commissioning of the LeverDisc™ mainsail reefing system above.

The adjustment brackets 1335 are placed over the tops of the line adjustment holes 2560 drilled through the luff end and leech end sections of the drum 2505. (See FIGS. 13, 25 and 26.) The ends of the luff and leech-end reefing lines are then passed through the adjustment brackets 1335 and into the corresponding adjustment holes 2560 in the drum 2505. The adjustment brackets 1335 are then pushed either upward or downward to pinch the reefing line between the two sets of holes (in the bracket and the drum). The adjustment brackets 1335 are then secured to the drum 2505 with a pair of machine screws passed through the slots in the brackets 1335 and into corresponding holes in the drum 2505. The measurements shown in FIGS. 26A-B are provided to give an idea of the general size of the adjustment brackets, but will vary depending on the line diameter and the size of the drum 2505.

A variation on the adjustment bracket of FIGS. 26A-B is to have a bracket with semi-circular openings—similar to the bracket of FIGS. 26A-B cut in half lengthways.

Figure 27:
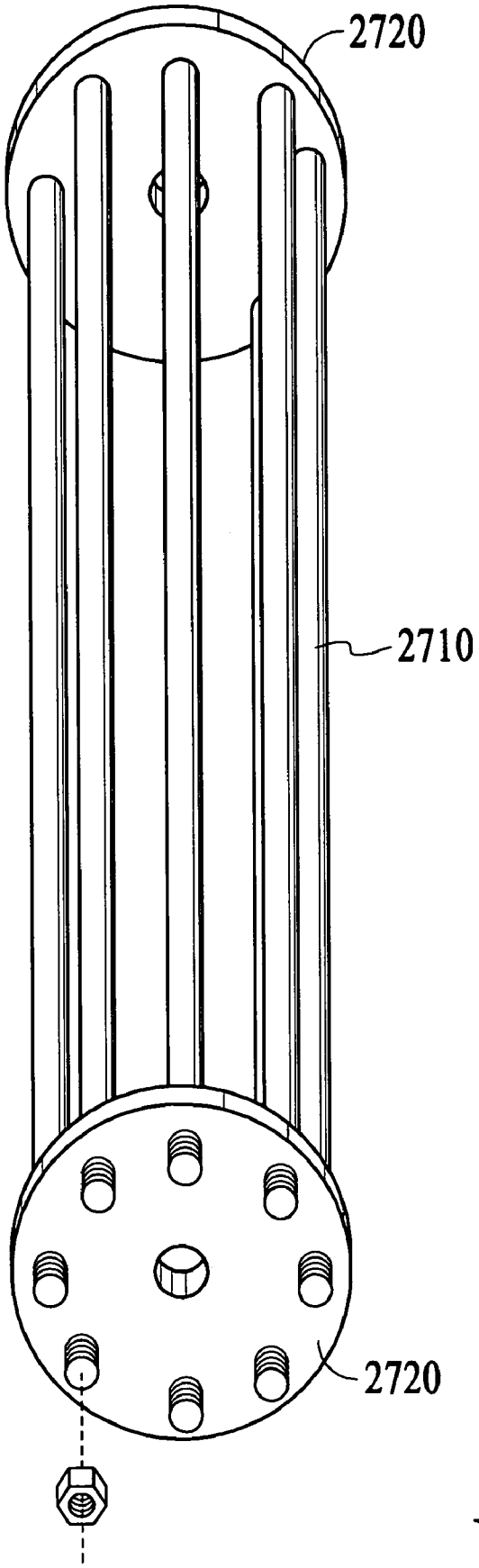
FIG. 27 shows a first alternative embodiment of the drum assembly, according to the invention.

FIG. 27 shows an alternative embodiment of the drum assembly that is comprised of metal rods 2710, or hollow metal tubing, affixed to a pair of disc-shaped end plates 2720 at each end. The rods or tubes 2710 can be either mechanically fastened or welded to these end plates to create a single drum.

Furthermore, the rods 2710 can be threaded to allow nuts to travel up and down along them. (Not shown.) The nuts could fasten tightly against the LeverDisc 240 and center drum disc 1340 to hold them in position on the drum. This approach can be extended to include "timing rods" to increase a center drum diameter for improved leverage throughout the reefing process. (Not shown.)

A further modification, instead of using nuts on the rods 2710, is to use a set of spacing tubes placed on either side of the LeverDisc™ 240 and center disc 1340, to hold these parts in position on the drum. In this variation, the end plates 2720 can be welded or mechanically fastened in place between the spacing tubes.

A yet further modification to the drum of FIG. 27 is to have the rods or tubes 2710 inserted into welded or mechanically fastened sleeves on the end plates 2720 of the drum. (Not shown.) A drum shaft can also be welded or fastened to the centers of the end plates 2720.

Figure 28A:
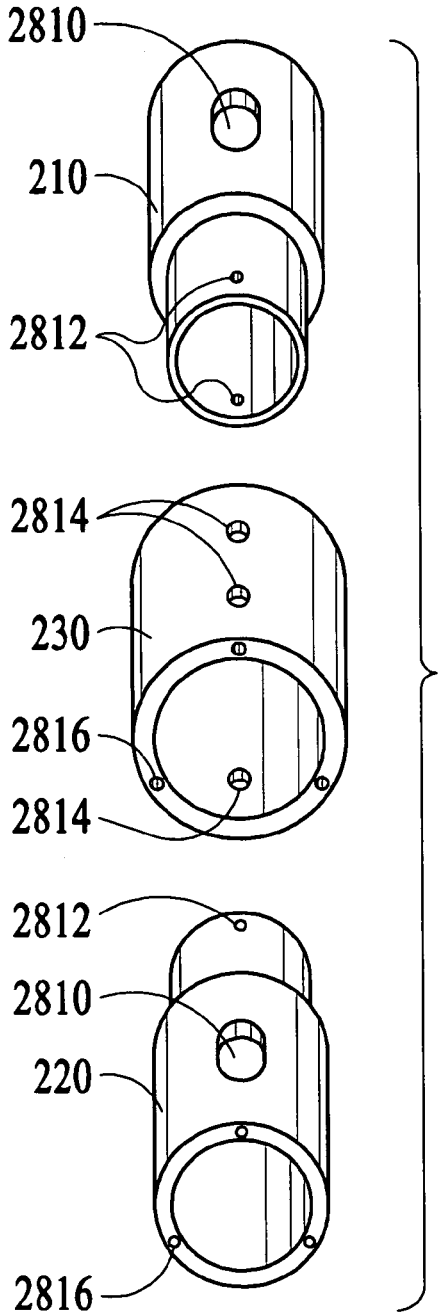
FIG. 28A shows an exploded view of a second alternative embodiment of the drum assembly, according to the invention.
Figure 28B:
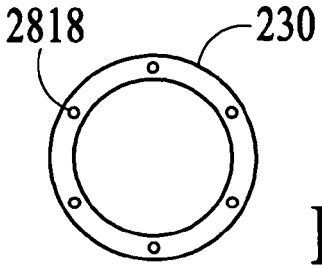
FIG. 28B shows the top face of the center drum of the drum assembly of FIG. 28A, according to the invention.

FIGS. 28A-B shows an alternative embodiment of the drum assembly comprising three separate drum parts 210, 220 and 230 that press fit together to form a single drum assembly. FIG. 28B shows the top face of the center drum 230. Threaded holes 2812 and corresponding countersink holes 2814 allow the drum parts to be attached by setscrews. Threaded holes 2818 and 2816 allow attachment of a LeverDisc™ 240 and center drum disc 1340, respectively. Large, approximately 1.5" diameter, line access holes 2810 are shown in the upper and lower drums 210 and 220. The access holes 2810 are designed to be wide enough to allow a stopper knot to be passed through and then pulled tight to on the other side of the drum. The access holes 2810 are opposed by a single row of line adjustment holes (not shown), running parallel to the rotational axis of the drum assembly.

The drums of FIG. 28A can be cored out from the inside with a lathe, so that wall thicknesses are reduced to the minimum necessary to support the load requirements of the reefing system. Line adjustments holes (not shown) can be added in either a single row, or a more closely packed configuration, thereby allowing a more precise positioning of the reefing lines on their drum sections.

Figure 29:
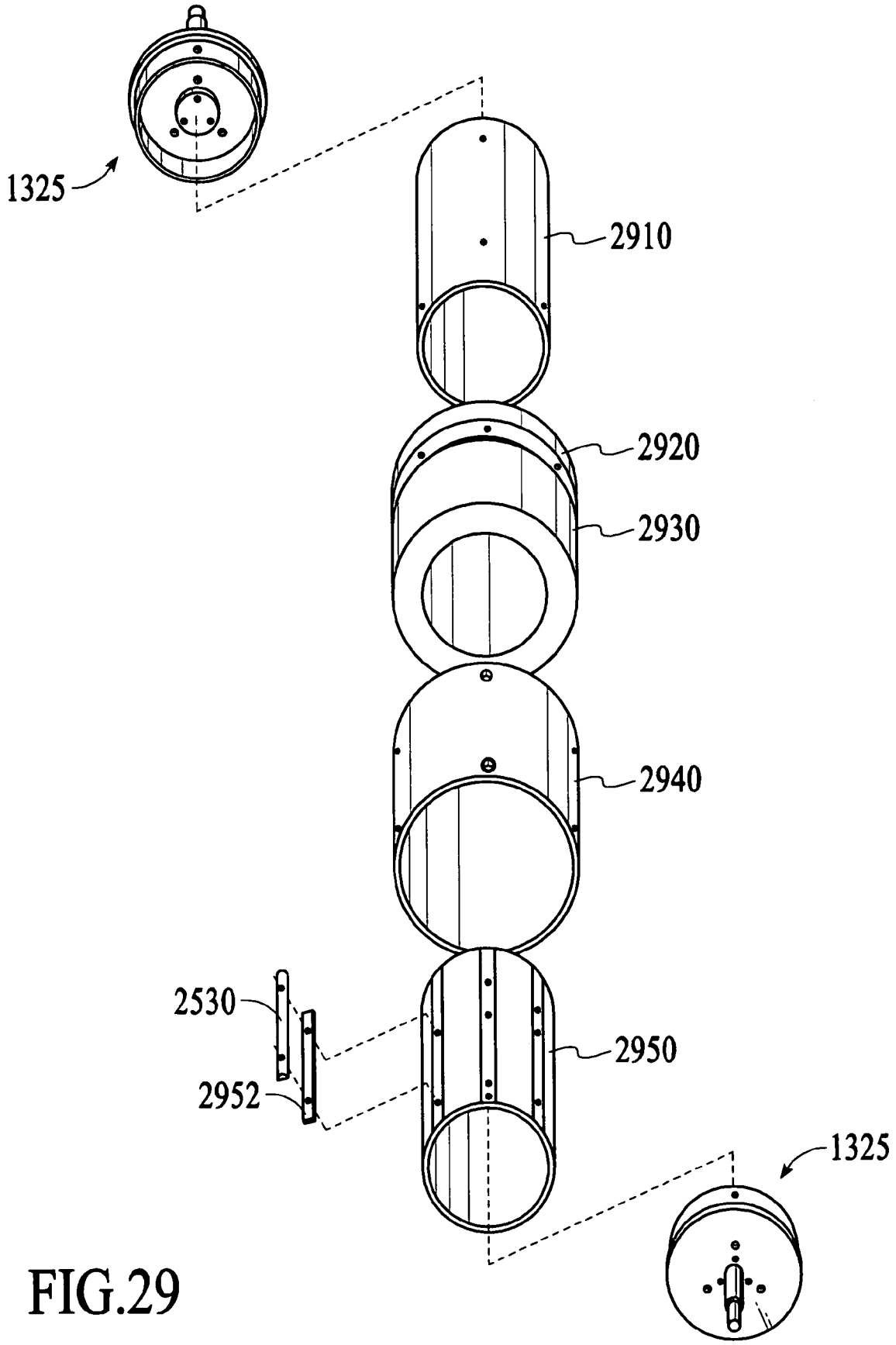
FIG. 29 shows an exploded view of a third alternative embodiment of the drum assembly, according to the invention.

FIG. 29 shows an exploded view of another three-part drum embodiment, wherein two smaller diameter drums 2910 and 2950 are joined to a central drum 2940 of larger diameter by means of a series of plastic or metal spacing rings 2920 and 2930. The spacer rings may be made of aluminum and/or UHMW and are press fit into the larger center drum 2940.

Figure 30:
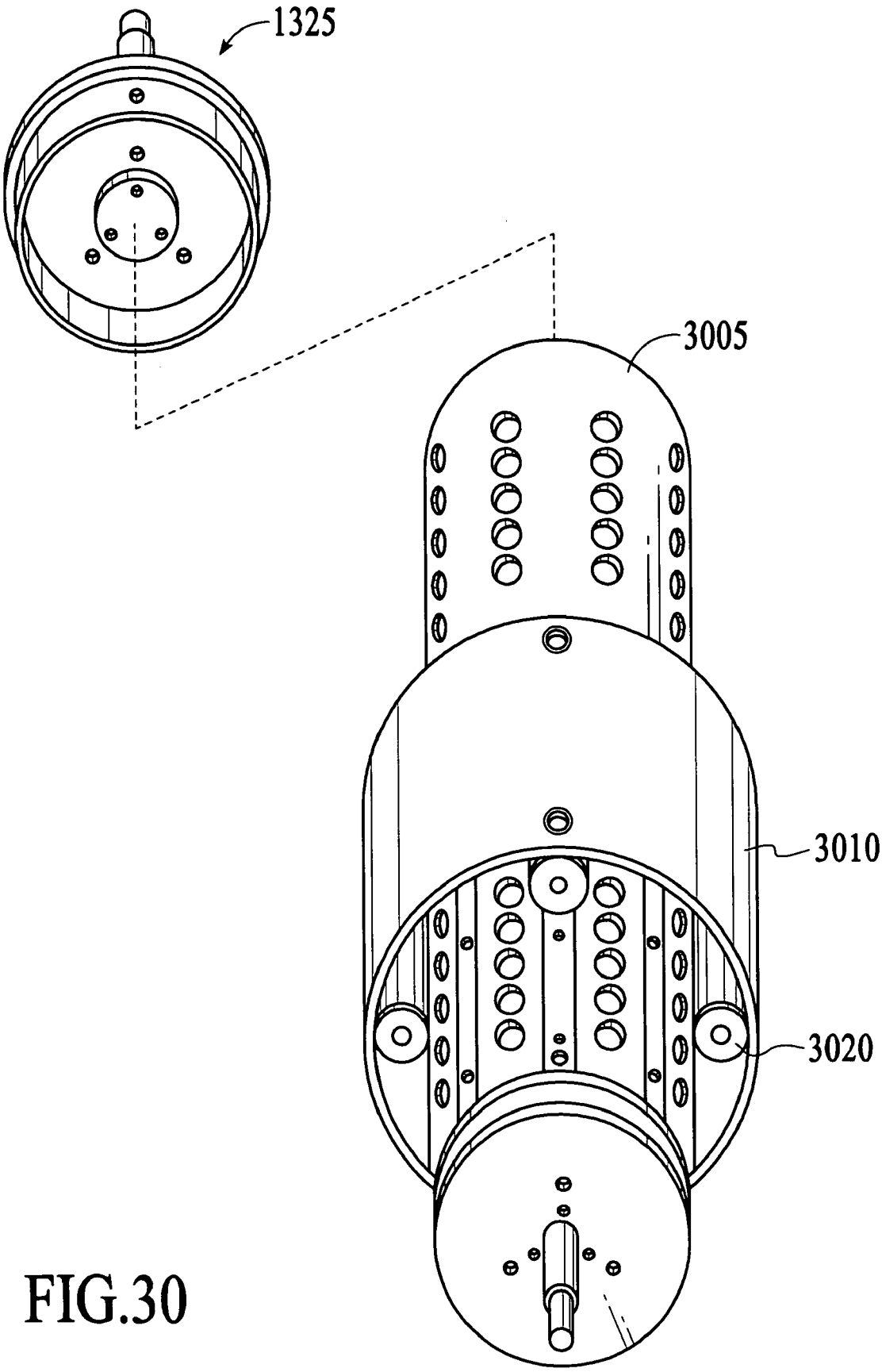
FIG. 30 shows an exploded view of a fourth alternative embodiment of the drum assembly, according to the invention.

FIG. 30 shows a further alternative embodiment of the drum assembly, wherein a single, smaller diameter drum 3005 is place inside a larger diameter drum 3010 and held in position by a series of plastic or metal tubes 3020. The LeverDisc™ 240 and center drum disc 1340 fasten to the threaded ends of the plastic or metal spacing tubes 3020.

A variation on the configuration of FIG. 30 is to remove the larger diameter drum 3010.

In addition to the alternative drum embodiments described above, it is also noted that the location of the cockpit drum 230, located at the drum's center in the preferred embodiment, could also be located at either end of the drum assembly. The LeverDisc™ 240 could also be positioned at either end of the drum assembly. See FIG. 6.

Figure 31:
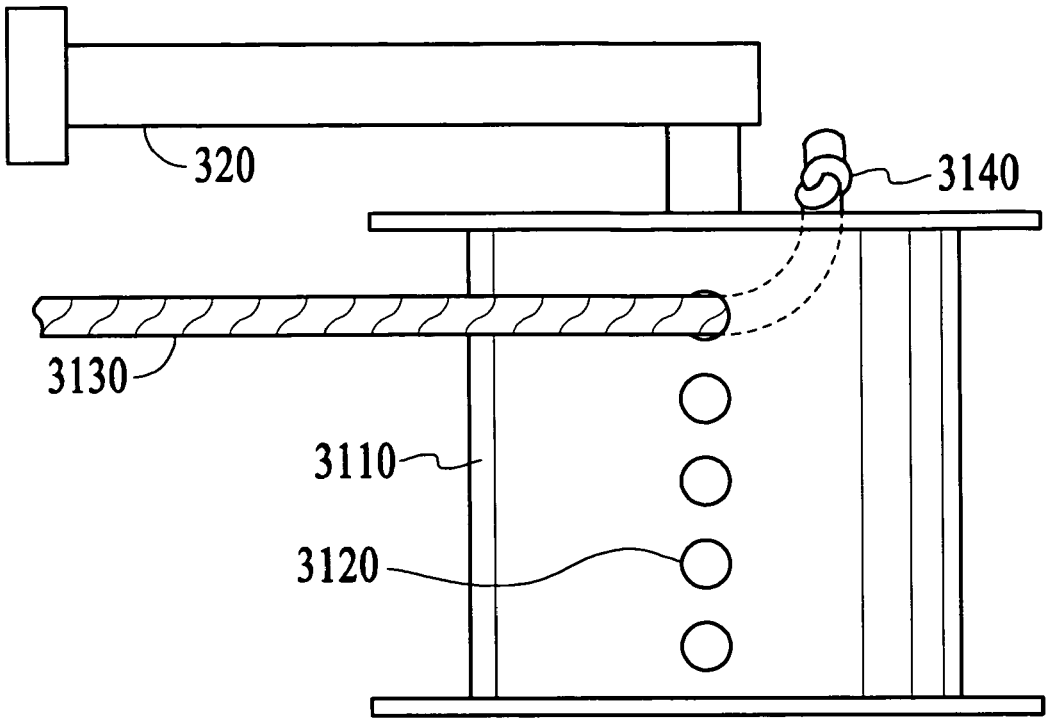
FIG. 31 shows a side view of a first reefing line attachment and adjustment mechanism for the drum assembly, according to the invention.
Figure 32:
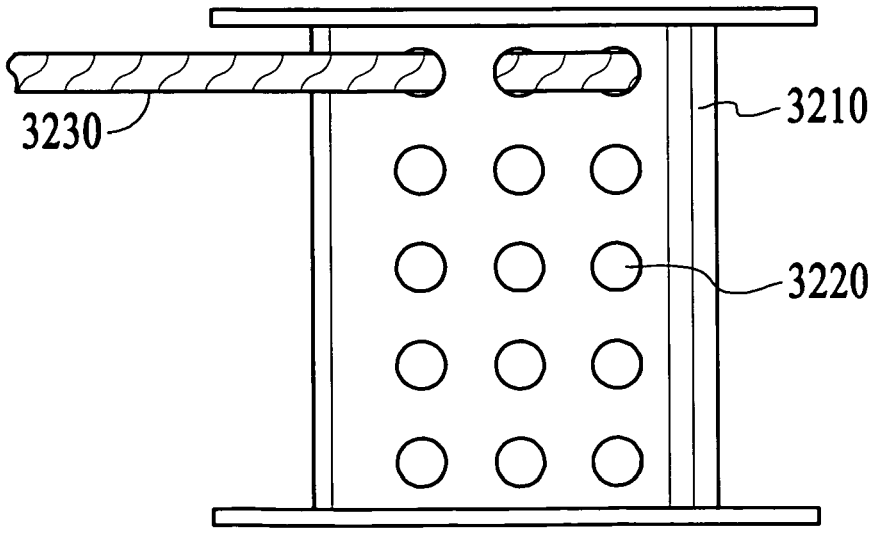
FIG. 32 shows a side view of a second reefing line attachment and adjustment mechanism for the drum assembly, according to the invention.

FIGS. 31 and 32 show two different ways of attaching the reefing lines to their respective drum sections on the LeverDisc™ mainsail reefing system. FIG. 31 shows a reefing line 3130 passing through a line adjustment hole 3120 in the side of the drum 3110, then up and through a hole in the drum disc or end plate. The line is then secured into position with a stopper knot 3140. In FIG. 32, the reefing line 3230 is weaved through a series of holes 3220 drilled through the wall of the drum 3210.

There are several preferred housing embodiments for the reefing mechanism 40, each suited to a particular mounting arrangement. For V-boom installations, a metal or plastic housing cover 403 could be slipped over the exposed portion of the drums and fastened to the boom walls, as shown in FIG. 7. This simple housing could also be used to cover a reefing mechanism mounted underneath a conventional boom. For deck-mounted reefing mechanisms, a number of different metal or plastic covers 820 could be placed over the top half of the drums and fastened to the mounting struts, as shown in FIGS. 8A-D.

A two-part, hinged housing system could be used to cover reefing systems 40 mounted under a boom 24, as shown in FIGS. 33A-B. The two halves of the hinged housing system could be attached to the boom 24 by hinges 3330. The hinged housings are able to swing in and out as shown in FIG. 33A to provide easy access to the reefing mechanism. The hinged housings 3320 could be made from plastic, metal, or mesh stretched over a suitable framework of metal tubing. The two halves of the hinged housing 3320 could attach to each other on their free ends or, alternatively, each half could snap fit to a housing tube 330 on the sides of the reefing mechanism with a snap-fit assembly 3310. A close-up view of the snap-fit assembly 3310 is shown in FIG. 33B. Alternatives to the snap-fit assembly 3310 include mechanical fasteners, Velcro and straps. The housing 3320 could also attach to suitable points on the mounting struts, using mechanical fasteners. A hinged housing 3320 could also be used to cover the exposed sections of a reefing mechanism in a V-boom installation.

A set of metal tubes 330 could also be used as a housing for the reefing system 40, particularly when the mounting location is along the forward edge of the mast, or in any position where loose line and sail material are not expected to interfere with moving levelwind and drum components. In this arrangement, three or more housing tubes 330 are positioned around the outside edges of the reefing mechanism 40. A side view of a housing tube installation is depicted in FIG. 6. As shown in FIG. 6, the ends of the housing tubes 330 are inserted into corresponding holes in a plastic housing tube mount. The housing tubes 330 and housing tube mount 1310 are depicted in more detail in FIG. 13.

When assembled around the reefing mechanism, the housing tubes 330 ensure that both reefing lines and the cockpit line are contained upon their respective drum sections, even if excessive slack should develop along any of the lines. The inside edges of the housing tubes 330 also enclose the LeverDisc™ threads 241, thereby preventing the cockpit line 36 from falling off the LeverDisc™ 240 and becoming entangled.

The ends of the housing tubes 330 are secured with machine screws to their respective holes in the housing tube mounts 1310. When these screws are loosened, the housing tubes can be adjusted in or out allowing adjustment of the clearance between the housing tubes 330 and the drum assembly 200.

Figure 34:
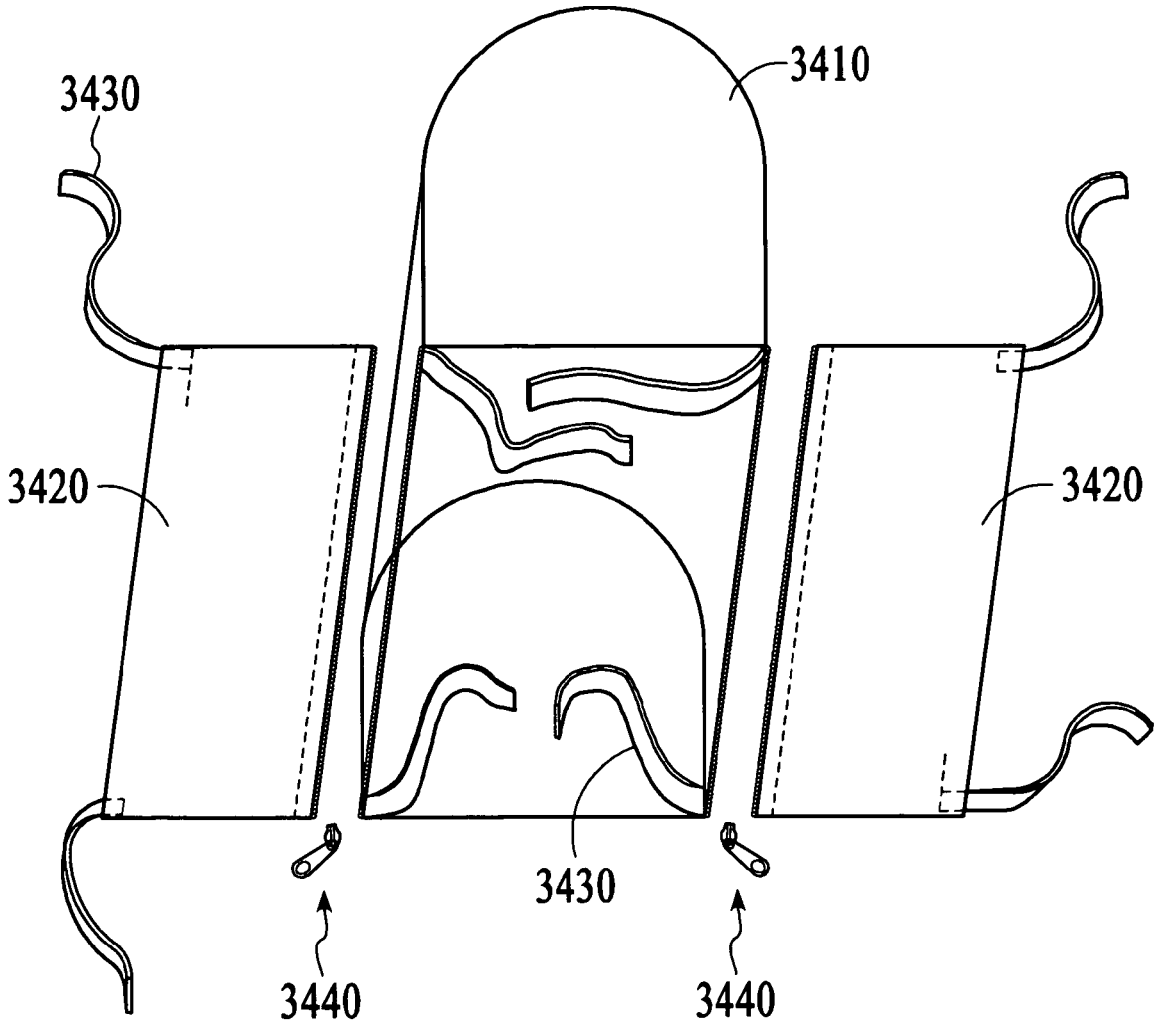
FIG. 34 shows a mesh housing for a reefing mechanism, according to the invention.

In addition to keeping the reefing lines and cockpit line contained upon their respective drum and LeverDisc™, the housing tubes also provide a framework around which a mesh housing can be secured. One embodiment of the mesh housing is shown in FIG. 34, where the mesh housing 3410 is viewed from the side with an opening, thus showing the interior of the housing. When a form-fitted mesh housing 3410 is stretched tightly around the housing tubes and secured to suitable attachment points on the boom or mast, a complete covering is created for the entire reefing mechanism. As shown in FIG. 34, side flaps 3420 can be zipped, with zippers 3440, onto the sides of the mesh housing 3410 for under the boom mounting arrangements, preventing any possibility of loose sail material or line from becoming entangled in the reefing mechanism. The mesh housing 3410 and side flaps 3420 can be secured to the boom, mast, or deck by means of the nylon webbing straps 3430. These straps can be run through suitable eyestraps or footmans' loops and then through standard webbing adjusters located on the mast or boom. The webbing straps 3430 are tensioned by means of the webbing adjusters to secure the mesh housing tightly around the reefing mechanism.

To ensure that the mesh housing 3410 does not interfere with the reciprocating motion 113 of the levelwind mechanism 110, a pair of metal brackets (not shown) can be slipped around the outsides of the guide rods on each side of the levelwind. When secured, the brackets prevent the mesh housing from coming into contact with the moving components of the levelwind mechanism 110.

Figure 35A:
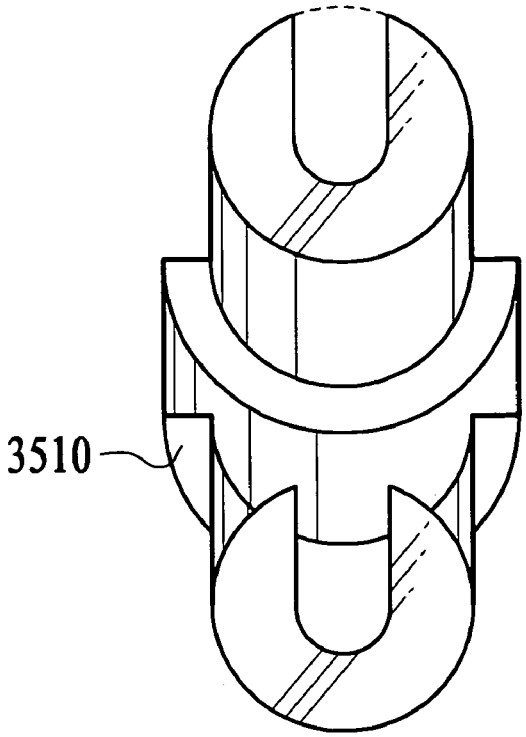
FIGS. 35A-B show a rigid housing for a reefing mechanism, according to the invention.
Figure 35B:
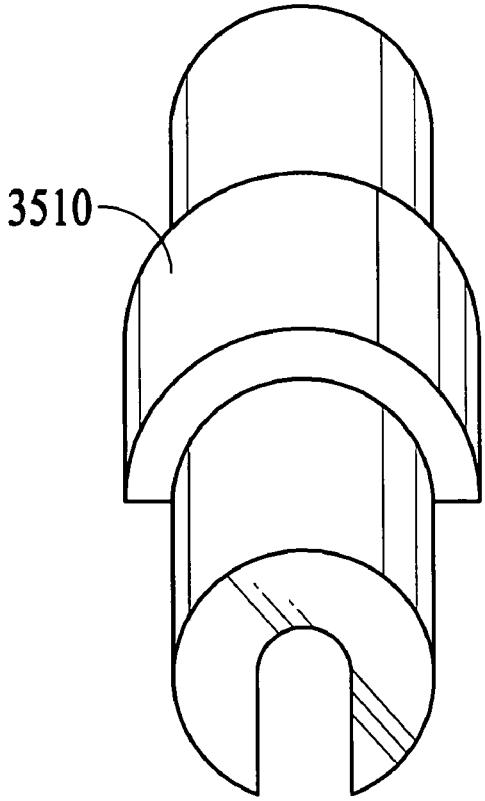

FIGS. 35A-B show another alternative embodiment for the housing system, wherein the housing consists of a single piece of thin metal or plastic 3510 that is shaped to fit closely around the outside of the entire reefing mechanism 40. Note that this housing embodiment would minimize the outside profile of the reefing mechanism by conforming closely to the contours of the LeverDisc™ and drum sections. FIG. 35A shows the interior of the housing 3510 and FIG. 35B shows the exterior. This embodiment could fasten to the outside surfaces of the mounting struts.

Figure 36:
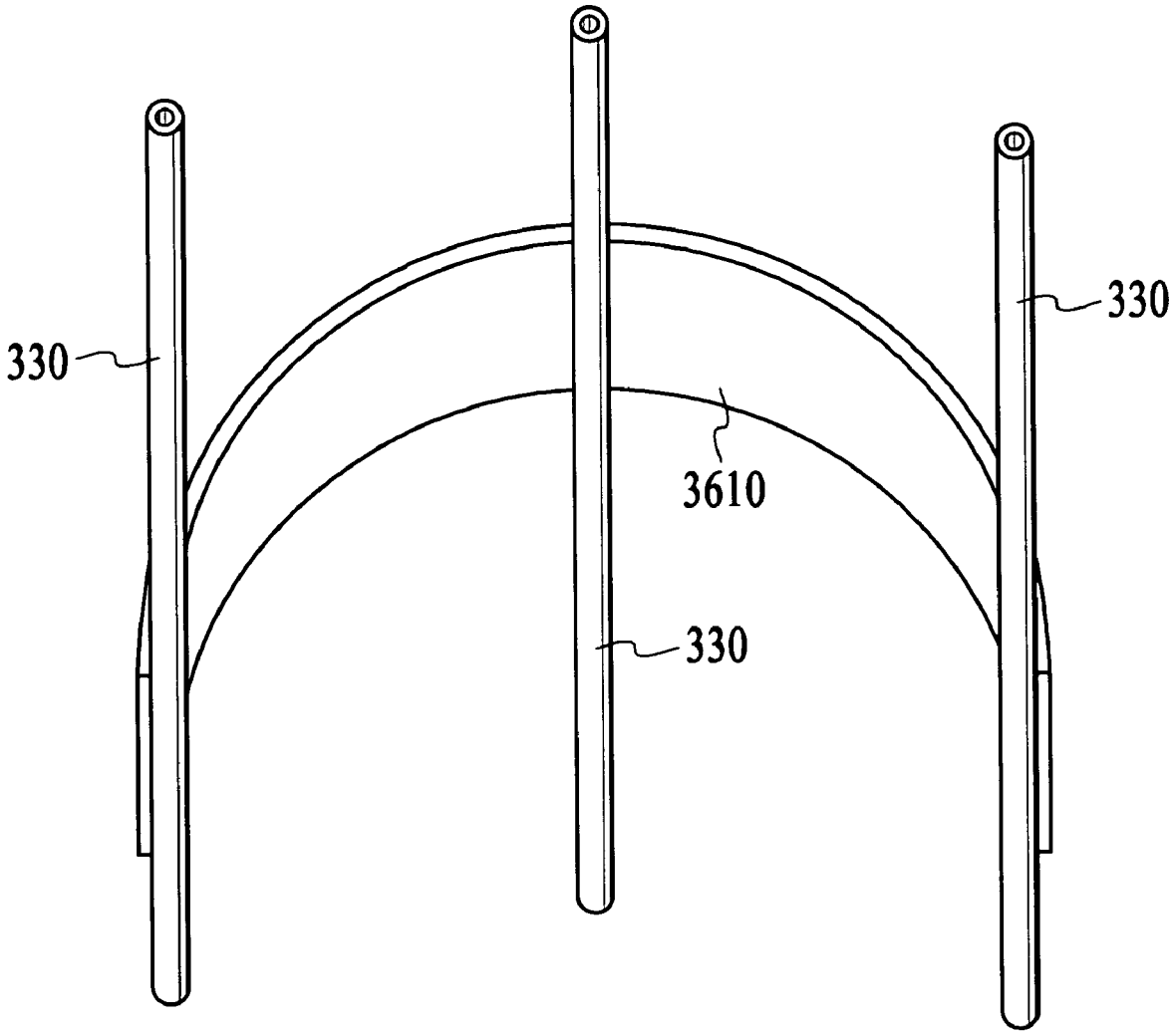
FIG. 36 shows an alternative housing for a reefing mechanism, according to the invention.

FIG. 36 shows a shortened housing 3610 comprising a strip of bent sheet metal or molded or bent plastic fastened to a set of housing tubes 330 so that the housing 3610 wraps closely around the outside of the LeverDisc™ threads 241. The housing 3610 could be fastened or welded to the inside or outside of the housing tubes 330. The housing tubes 330 would then be secured to housing tube mounts or brackets on the underside of each mounting strut. This arrangement would ensure that the cockpit line could not "jump the threads" of the LeverDisc™ 240 or become jammed underneath the housing tubes 330 or brackets during the reefing process. Note that this housing could also be lengthened to cover the entire reefing mechanism.

Figure 37:
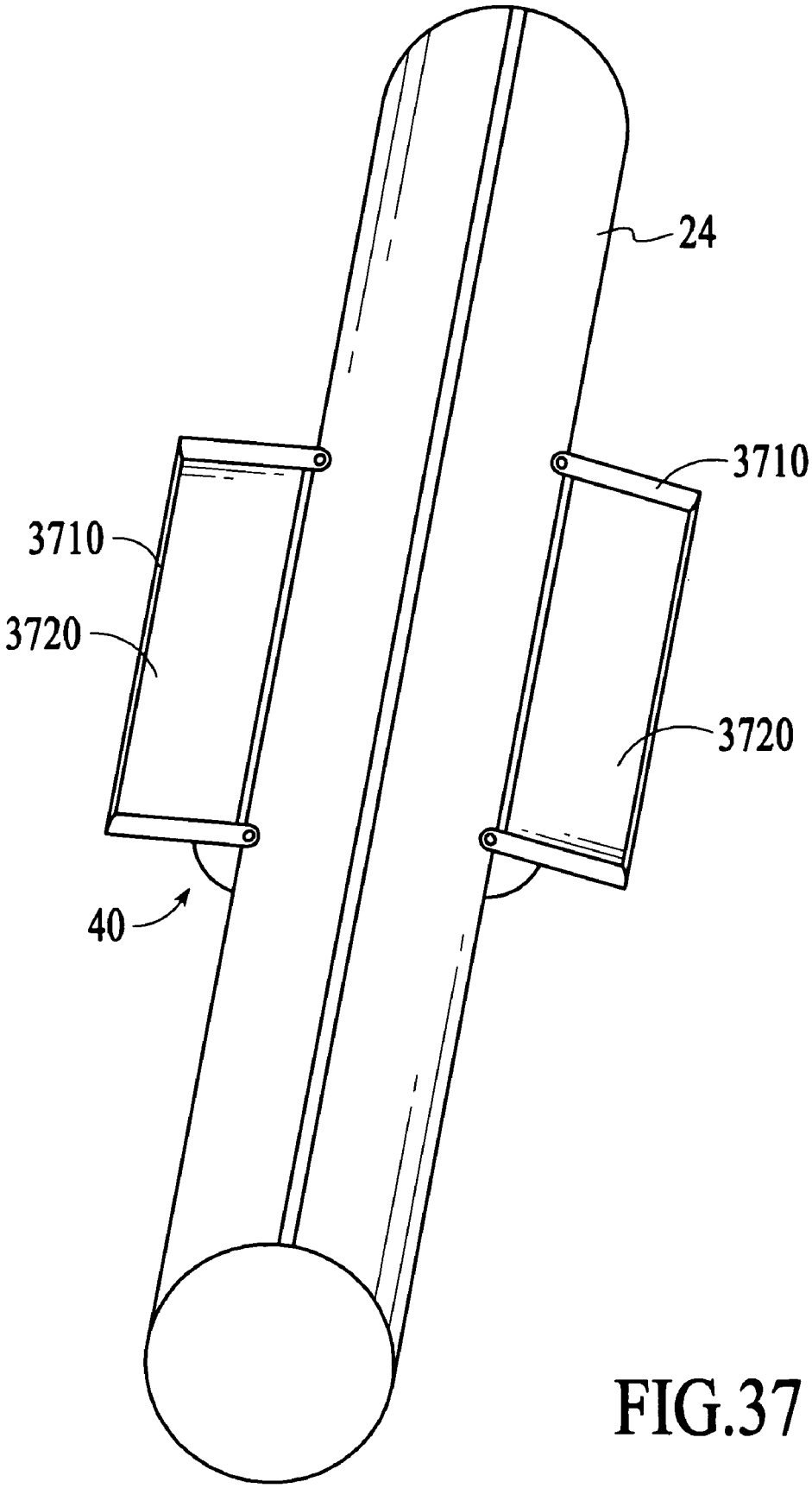
FIG. 37 shows an alternative housing for a reefing mechanism mounted on a boom, according to the invention.

FIG. 37 shows a reefing mechanism 40 mounted underneath a mainsail boom 24 and protected by a housing comprising tubes 3710 and fabric 3720. This embodiment consists of a framework of metal tubing or rod 3710 with a canvas or mesh covering 3720 sewn tightly around it. The ends of the metal tubes 3710 could be press-fitted into metal or plastic sockets and secured in place on the boom 24 with machine screws or setscrews. The housing is secured in place on both sides of the boom 24, directly over the location of the reefing system mounted on the underside of the boom. This housing embodiment presents a conceptually simple means of preventing loose line or sail material from falling into the reefing mechanism and becoming entangled with its moving parts. It should be noted that this housing embodiment could also be made from sheet metal or plastic instead of tubing and fabric. This housing embodiment could also be bent into any number of profiles or shapes. For example, the flat profile of the housing in FIG. 37 could be radiused to conform more closely to the curvature of the reefing mechanism, in a fashion similar to the hinged housing 3320 shown in FIG. 33A.

Figure 38:
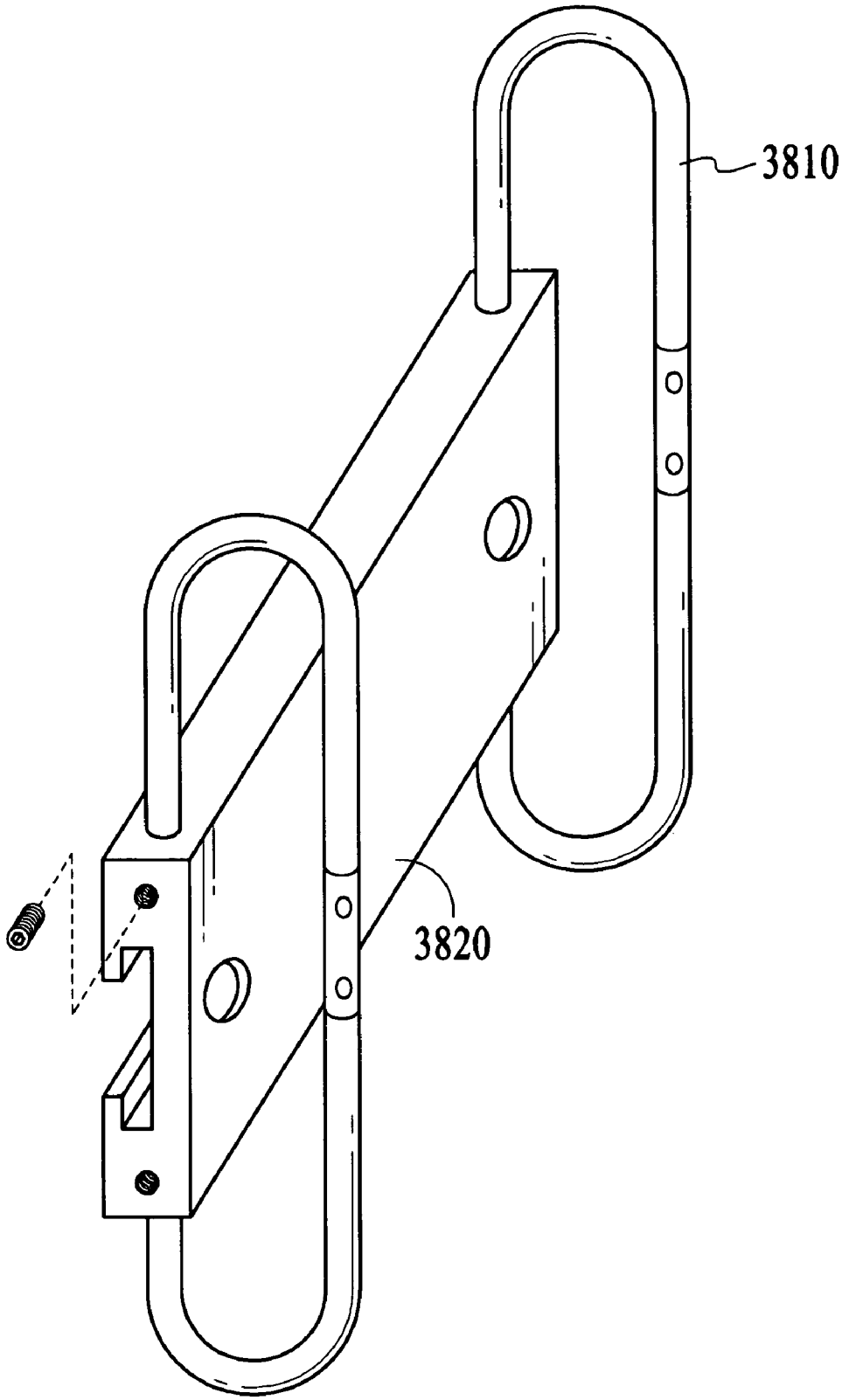
FIG. 38 shows an outhaul fairlead car, according to the invention.

It should be noted that the housing tubes 330 shown in FIG. 13 could each be fabricated as two separate pieces that press fit together to form a single tube by means of a compression sleeve or setscrew assembly, in a fashion similar to the fairlead rods on the preferred embodiment of the outhaul fairlead car depicted in FIG. 38.

The outhaul fairlead car shown in FIG. 38 is mechanically fastened to the side of the mainsail boom, underneath and slightly aft of (behind) the leech-end reef cringle on the mainsail, as shown in FIG. 4A. Alternatively, a version of the outhaul fairlead car could be positioned along the inside wall of a V-boom. In a V-boom mount, it might be possible to eliminate the metal car altogether and mold the fairlead rods directly into the boom wall, with a stationary cheek block positioned on a mounting pad between the rods.

The fairlead car serves two important purposes. First, it ensures that the leech-end reefing line stays properly oriented on the sheave of the cheek block mounted on the fairlead car. (The cheek block is attached to the surface 3820.) This alignment function is achieved by passing the leech end reefing line underneath the fairlead rod 3810 on the front end of the fairlead car before passing the line around the sheave on the cheek block positioned at the center of the car. This traps the leech end reefing line inside the slot formed by the fairlead rod, thereby forcing the line to remain in position over the sheave on the cheek block. This line lead is shown in drawing FIG. 4A.

The second function of the fairlead car is to prevent loose mainsail fabric from stacking up on top of the leech end reefing line as it passes around the sheave on the fairlead car. This is also accomplished by means of the fairlead rods 3810, which together hold the sail material up and away from the leech end reefing line during the reefing operation. This is also an important function, since mainsail material can be quite heavy and its accumulation on top of the leech end reefing line could induce considerable amounts of friction as the line passes around the cheek block sheave on its way to the reefing mechanism 40.

As described above, the outhaul fairlead car is designed to hold the leech end reefing line in position over the sheave on the fairlead car during the reefing process. However, the fairlead rods 3810 are not intended to hold the considerable mechanical load that comes onto the leech-end reefing line during the outhaul tensioning phase of the reef. The fairlead rods 3810 have therefore been designed to come out of contact with the leech-end reefing line as outhaul tensioning begins. This is accomplished in the following way: as outhaul tension comes onto the leech-end reefing line, the angle between the cheek block on the fairlead car and the reefing cringle on the leech of the sail begins to decrease dramatically, as the cringle is drawn down toward the top edge of the boom. As the angle between cheek block and reefing cringle decreases, the reefing line is forced down and away from the top end of the fairlead rod 3810, thereby separating the reefing line from the fairlead rod 3810.

As shown in FIG. 38, each of the fairlead rods 3810 on the fairlead car is comprised of two bent sections of rod fastened together by means of a short metal barrel with threaded holes, through which a pair of setscrews is inserted and tightened against the ends of the rods to form a complete unit. The ends of the fairlead rods 3810 are contained inside holes drilled into the side of the fairlead car.

The fairlead car itself can be mounted to a short length of standard T-track. This mounting arrangement allows the fairlead car to be moved back and forth on the track, thereby allowing adjustment of the outhaul angle.

The fairlead rods 3810 can be made from stainless steel or aluminum. The body 3820 of the fairlead car can be made from aluminum extruded through a die.

In addition to the fairlead rods 3810 shown in FIG. 38, a variety of alternative line fairlead mechanisms can be specified for the outhaul fairlead car. For example, the reefing line could be passed through steel rings or tubes welded into the shape of a square, positioned along the outside edge of the fairlead car itself.

It is noted that the fairlead car could be eliminated from the LeverDisc™ mainsail reefing system altogether, provided that the boom is fitted with purpose-built reefing line sheaves on its aft end, to hold the reefing line(s) in alignment during the reefing process.

Figure 39:
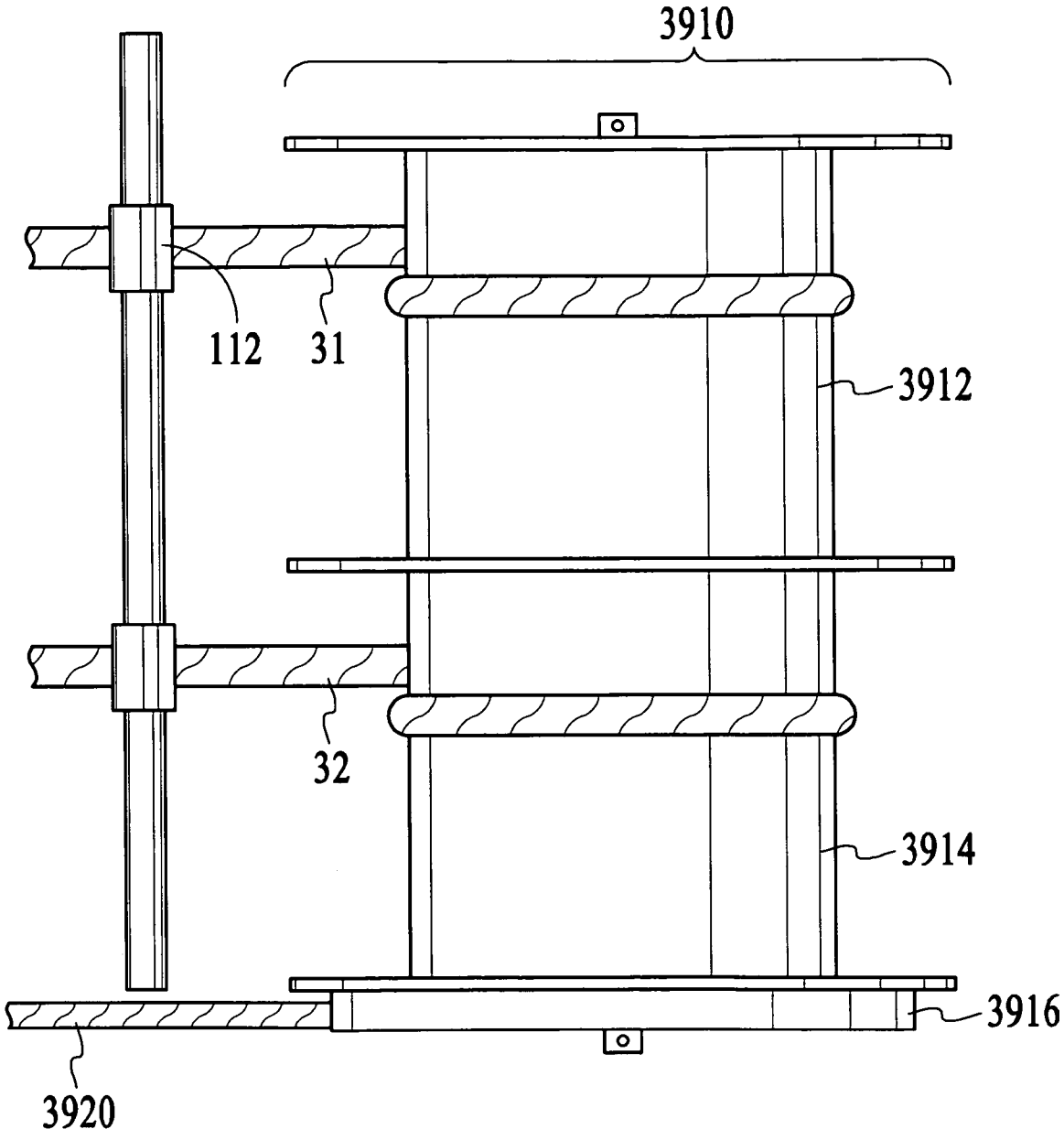
FIG. 39 shows a side view of a first alternative embodiment of a reefing mechanism, according to the invention.
Figure 40:
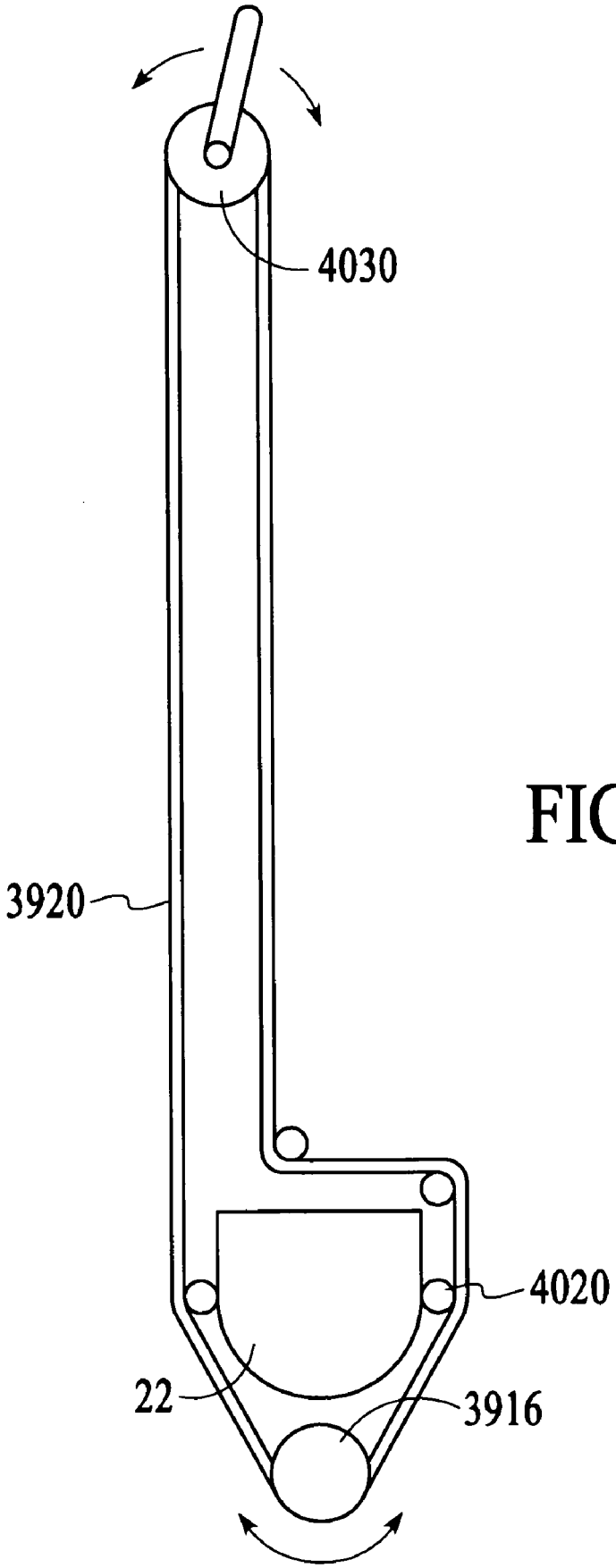
FIG. 40 shows a top view of a continuous line lead suitable for use with the reefing mechanism of FIG. 39, according to the invention.
Figure 41:
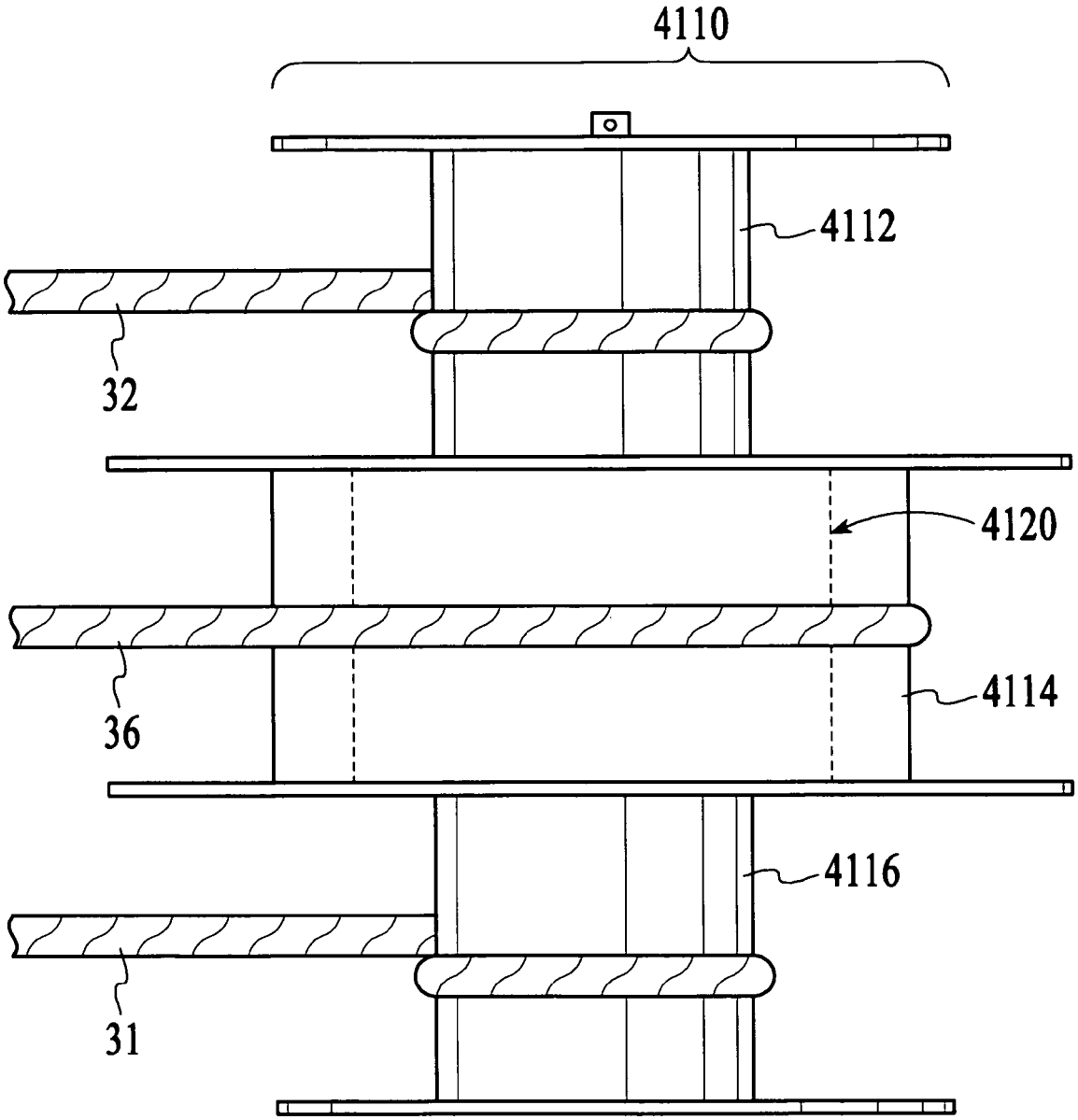
FIG. 41 shows a side view of a second alternative embodiment of a reefing mechanism, according to the invention.

Some examples of alternative embodiments of the reefing mechanism are shown in FIGS. 39-41. FIG. 39 depicts a two-drum version of the invention, wherein both the LeverDisc™ drum and the center drum of the drum assembly of FIG. 6 have been eliminated. The drum assembly 3910 comprises a top drum 3912 and a bottom drum 3914 for the leech and luff-end reefing lines, 31 and 32, respectively. The reefing lines are guided onto the drums by a levelwind mechanism configured for guiding two lines, comprising two lineguides 112. The configuration and operation of the levelwind mechanism for the embodiment of the reefing mechanism of FIG. 39 is analogous to the levelwind mechanism described in detail above with reference to FIGS. 14-22. When using the reefing mechanism of FIG. 39, both the leech and luff-end reefing lines 31 and 32 are doubled through their respective sail cringles to supply a constant 2:1 leverage advantage throughout the reefing process, thereby eliminating the need for a LeverDisc™ drum. The two-part drum assembly 3910 is rotated by a linedriver 3916 keyed to the shaft of the drum assembly 3910. The linedriver 3916 is driven by a continuous line 3920.

FIG. 40 shows a top down view of a continuous line 3920 lead from a linedriver winch 4030 in the cockpit of the sailboat to a linedriver 3916 coupled to a reefing drum 3910. In the example shown in FIG. 40, the line 3920 is lead with the aid of fairlead blocks 4020 from the cockpit of the sailboat, where the winch 4030 is located, around the mast 22 to reach the linedriver 3916. Those skilled in the art will know how to adapt the design of FIG. 40 to accommodate various other positions of the reefing mechanism. The winch is provided with a clutch in preferred embodiments.

Referring to FIGS. 39 and 40, both the linedriver 3916 and the linedriver winch 4030 are designed to tightly grip the continuous line 3920. When the linedriver winch 4030 is activated, either by manually cranking it with a winch handle or activating it with an electric or hydraulic motor, its rotation causes the continuous line 3920 to rotate and turn the linedriver 3916 on the drum assembly 3910. Since the linedriver 3916 is keyed to the drum assembly 3910, the drums 3912 and 3914 turn with the linedriver 3916 and the reefing lines 31 and 32 begin to wrap onto their respective drum sections, 3912 and 3914. The lines 31 and 32 are guided onto the drums 3912 and 3914 by lineguides 112. In preferred embodiments the lineguides 112 also act as line tensioners.

In preferred embodiments the linedriver winch 4030 is fitted with a clutch mechanism. When the clutch is released, the two-part reefing drum assembly 3910 is free to rotate while the continuous line 3920 freewheels around the shaft of the linedriver winch 4030. Thus, when it is time to release the reef, the mainsail halyard is used to raise the sail and pull the two reefing lines 31 and 32 off the drum sections 3912 and 3914 without interference from the linedriver winch 4030.

To maximize reefing efficiency, the linedriver winch 4030 in the cockpit could be fitted with multiple continuous lines, connected to different linedrivers, and clutch mechanisms, so that two or even three separate reefs could be controlled by the rotation of a single linedriver winch 4030. Alternatively, each reef could utilize a separate linedriver winch.

Note that the diameter of the linedriver 3916 coupled to the two-part reefing drum assembly 3910 in FIG. 39 can be sized to supply different amounts of leverage, as required for specific reefing processes. For example, the diameter of the linedriver 3916 could be made larger than the diameter of the drums 3912 and 3914. Furthermore, gear sets between the linedriver 3916 and the shaft of the reefing drum assembly 3910 can be used to provide mechanical advantage. (The later is not shown, but will be clear to those skilled in the art from the description and with reference to FIGS. 39 and 40.)

For example, instead of doubling the reefing lines through the cringles on the sail to achieve a leverage advantage, gearing at the linedriver 3916 where it couples to the shaft of the drum assembly 3910 could be used to achieve a 2:1 leverage. When the continuous line 3920 is activated by cranking the linedriver winch 4030 in the cockpit, the driving gear engages the driven gear and the reefing drum assembly 3910 turns, at half the speed and twice the torque of the drive shaft. If desired, the reefing lines could be doubled through the reef cringles in this embodiment, resulting in a 4:1 leverage advantage to the linedriver winch 4030 in the cockpit throughout the reefing process. In addition, any reasonable gear ratio could be established between the driving gear and driven gear in this embodiment.

Furthermore, a two-speed gear set could be utilized. For example, when the linedriver winch 4030 in the cockpit is cranked in one direction, the continuous line 3920 causes the drive shaft and its gears to engage the reefing drum gears with a 1:1 gear ratio. When the linedriver winch 4030 is cranked in the opposite direction, a different set of gears on the drive shaft engages the reefing drum gears, so that a 2:1 ratio is established. This gear shift is accomplished by means of pawls and an idler gear. Note that any reasonable gear ratio could be established in this embodiment, to alter the leverage delivered to the linedriver winch 4030 in the cockpit. Note again that the reefing lines could also be doubled through the reef cringles to increase leverage.

When a gear set is utilized as described above, the linedrive 3916 and continuous line 3920 may be replaced by a cockpit drum and cockpit line, where the axis of the cockpit drum is offset from the axis of the reefing drum assembly 3910, and where the axes are coupled by a gear set that provides the desired mechanical advantage. (This is not shown, but will be clear to those skilled in the art from the description and with reference to FIG. 39.)

A motor could also be used to drive the reefing drum assembly 3910, eliminating the linedrive. (This configuration is not shown, but will be clear to those skilled in the art from the description and with reference to FIG. 39.) For example, a motor could be linked by a gear and clutch assembly to a gear set on the axis of the reefing drum assembly 3910. When the motor is activated by pressing a switch from the cockpit or other remote location, its gear assembly engages the axis and makes the drum assembly 3910 turn. In this embodiment, both the clutch and power switch for the motor can be operated at the motor itself or from a remote location.

A motor with a clutch assembly and gear set could be used to drive the linedriver winch 4030. (This configuration is not shown, but will be clear to those skilled in the art from the description and with reference to FIG. 40.)

FIG. 41 describes another embodiment of the invention that does not include the LeverDisc™ drum. This is accomplished by doubling the diameter of the cockpit drum 4114 relative to the luff and leech sections of the drum, 4112 and 4116, respectively, so that positive mechanical advantage is maintained for the crew throughout the reefing process.

In another version of this embodiment, the diameter of the cockpit section of the drum 4114 could be reduced, relative to the luff and leech sections of the drum, if both of the reefing lines were doubled through their respective reef cringles on the mainsail, in the same fashion as a conventional "dual line" reefing system arrangement. This line doubling would provide a 2:1 mechanical advantage to the cockpit line during the reefing process without the need for a LeverDisc™. The reduced size of the drum is indicated in FIG. 41 by callout 4120.

Provided that the final line leads for the luff, leech, and cockpit lines, 32, 31 and 36, respectively, could be positioned far enough away from their respective drum sections to allow the lines to track back and forth consistently, it is also possible that the levelwind mechanism could be eliminated from the alternate embodiment shown in FIG. 41. In this version of the alternate embodiment, the entire reefing system would consist of little more than a three-part drum assembly 4110 and a pair of mounting struts (not shown in FIG. 41, but see FIGS. 8-13), plus a housing arrangement consisting of housing tubes, etc., (not shown in FIG. 41, but see FIGS. 33-37) to keep the lines from falling off their drum sections. Some type of friction or line tensioning block would probably be required at the final leads to the drum, to prevent line fouls and overrides on each of the drum sections. For example, see FIGS. 20-22.

Finally, it should be noted that the overall size of the reefing mechanism, in any of its embodiments, could be considerably reduced if a high-strength, low-stretch line such as Technora T-900 or Vectran is specified for the reefing and cockpit lines instead of conventional polyester double braid. The reason for this is that smaller diameters could be specified for a high strength line. For example, ¼" Vectran V-12 line could make a suitable high strength replacement for 7⁄16" diameter polyester double braid reefing and cockpit line. These reduced line diameters would take up less space on the drum sections and therefore permit a reduction in the overall size of the drum assembly.

The above embodiments of the present invention have been given as examples, illustrative of the principles of the present invention. Variations of the apparatus and method will be apparent to those skilled in the art upon reading the present disclosure. These variations are to be included in the spirit of the present invention.

What is claimed is:

1. A mainsail reefing system, comprising:

a reefing mechanism including:

a drum assembly comprising:

a first drum for collecting a luff-end reefing line; and a second drum for collecting a leech-end reefing line;

wherein said first and second drums are rigidly connected and share a common rotational axis;

a drive mechanism for rotating said first and second drums; and a levelwind mechanism including:

a cam shaft configured to convert rotational motion to reciprocating motion; and a first line guide mechanically coupled to said cam shaft, said first line guide being configured to move in a reciprocating motion across the width of said first drum for guiding said luff-end reefing line onto said first drum; and a second line guide mechanically coupled to said cam shaft, said second line guide being configured to move in a reciprocating motion across the width of said second drum for guiding said leech-end reefing line onto said second drum;

wherein said levelwind mechanism is mechanically coupled to said reefing mechanism for coordination of movement of said line guides with rotation of said drum assembly.

2. The reefing system of claim 1, wherein said drive mechanism is a linedriver coupled to a cockpit winch by a continuous line.

3. The reefing system of claim 1, wherein said drive mechanism comprises a motor mechanically coupled to said drum assembly by a clutch and a gear set.

4. The reefing system of claim 1, wherein said drive mechanism comprises a third drum, wherein said first, second, and third drums are rigidly connected and share a common rotational axis, and wherein a cockpit line is attached at a first end to said third drum and at the other end to a cockpit winch.

5. The reefing system of claim 4, wherein said third drum has a larger diameter than said first drum and said second drum.

6. The reefing system of claim 4, further comprising a third line guide mechanically coupled to said cam shaft, said third line guide being configured to move in a reciprocating motion across the width of said third drum for guiding said cockpit line onto said third drum.

7. The reefing system of claim 4, further comprising a set of leverage battens attached to the surface of said third drum, said leverage battens being configured on the surface of said third drum, to increase the drum radius.

8. The reefing system of claim 1, wherein said drive mechanism comprises:

a third drum, wherein said first, second, and third drums are rigidly connected and share a common rotational axis; and a threaded disc coaxially attached to an end of said third drum, said threaded disc having a larger diameter than said third drum;

wherein said threaded disc and said third drum are configured to enable a cockpit line to be fixed to said threaded disc and wound around said threaded disc and said third drum.

9. The reefing system of claim 8, further comprising a third line guide mechanically coupled to said cam shaft, said third line guide being configured to move in a reciprocating motion across the width of said third drum for guiding said cockpit line onto said third drum.

10. The reefing system of claim 1, wherein said first line guide and said second line guide are configured to tension said luff-end and leech-end reefing lines, respectively.

11. The reefing system of claim 1, further comprising line tensioners configured to tension said reefing lines.

12. The reefing system of claim 11, wherein said line tensioners comprise friction blocks.

13. The reefing system of claim 1, further comprising an outhaul fairlead car configured to hold said leech-end reefing line in proper alignment with a sheave on a boom-mounted fairlead block and to prevent loose sail material from hindering the movement of said leech-end reefing line.

14. The reefing system of claim 1, further comprising a housing for said reefing mechanism, said housing being in close proximity to said reefing mechanism, said housing being configured to prevent fouling of said reefing mechanism by sail material or loose line.

15. The reefing system of claim 14, wherein said housing comprises a plurality of tubes spaced around said reefing mechanism.

16. The reefing system of claim 1, further comprising a set of timing battens attached to the surface of a drum in said drum assembly, said timing battens being configured on the surface of said drum to increase the drum radius.

17. A reefing mechanism comprising:

a drum assembly including:

a first drum for collecting a luff-end reefing line;

a second drum for collecting a leech-end reefing line;

a third drum for rotating said first and second drums, wherein said first, second and third drums are rigidly connected and share a common rotational axis; and a threaded disc coaxially attached to an end of said third drum, said threaded disc having a larger diameter than said third drum;

wherein said threaded disc and said third drum are configured to enable a cockpit line to be fixed to said threaded disc and wound around said threaded disc and said third drum.

18. The reefing mechanism of claim 17, further comprising an exit thread positioned between said threaded disc and said third drum, said exit thread being configured to smoothly transition the cockpit line from said third drum to said threaded disc.

19. The reefing mechanism of claim 17, wherein said third drum has a larger diameter than said first drum and said second drum.

20. A reefing mechanism comprising:

a drum assembly including:

a tube;

a center drum disc coaxially attached to said tube;

two end discs fixed to the ends of said tube; and a threaded disc coaxially attached to said tube, said threaded disc having a larger diameter than said tube;

wherein said tube between a first end disc and said threaded disc is a first drum for collecting a first reefing line, said tube between said second end disc and said center disc is a second drum for collecting a second reefing line, and said tube between said threaded disc and said center disc is a third drum, and wherein said threaded disc and said third drum are configured to enable a cockpit line to be fixed to said threaded disc and wound around said threaded disc and said third drum.

21. The reefing mechanism of claim 20, wherein leverage battens are attached to said third drum, whereby said third drum has a larger diameter than said first drum and said second drum.

22. The reefing mechanism of claim 20, wherein said threaded disc is attached to said tube by mechanical fasteners and keyways.

23. The reefing mechanism of claim 20, wherein said tube is an extruded aluminum tube.

24. A method of reefing a mainsail comprising the steps of:

pulling a cockpit line off a first drum, said first drum being rigidly connected to a second drum and a third drum, wherein said first, second and third drums share a common rotational axis, wherein a luff-end reefing line is attached to said second drum and a leech-end reefing line is attached to said third drum, and wherein said reefing lines are reeled on to said second and third drums as said cockpit line is pulled off said first drum; and pulling said cockpit line off a threaded disc, said threaded disc being coaxially attached to an end of said first drum, said threaded disc having a larger diameter than said first drum, said cockpit line being attached to said threaded disc and wound around said first drum, wherein outhaul tension is applied to said mainsail and said reef is completed as said cockpit line is pulled off said threaded disc.

25. The reefing method of claim 24, wherein said cockpit line automatically transitions from said first drum to said threaded drum when increased leverage is required for application of outhaul tension to said mainsail.

* * * * *